US011364422B1

(12) United States Patent
Parsons et al.

(10) Patent No.: US 11,364,422 B1
(45) **Date of Patent: *Jun. 21, 2022**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Matthew T. Andrews, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/680,520

(22) Filed: Feb. 25, 2022

Related U.S. Application Data

(63) Continuation-in-part of application No. 17/474,925, filed on Sep. 14, 2021, now Pat. No. 11,298,597, and (Continued)

(51) Int. Cl.
*A63B 53/04* (2015.01)
*A63B 53/06* (2015.01)
*A63B 60/02* (2015.01)

(52) U.S. Cl.
CPC ..... *A63B 53/0487* (2013.01); *A63B 53/065* (2013.01); *A63B 60/02* (2015.10); (Continued)

(58) Field of Classification Search
CPC ..... A63B 53/0441; A63B 53/0487
(Continued)

(56) References Cited

U.S. PATENT DOCUMENTS 723,534 A 3/1903 Knight
779,433 A 1/1905 Long
(Continued)

FOREIGN PATENT DOCUMENTS

JP 11253590 A * 9/1999 ..... A63B 53/0487
JP 2004223184 A 8/2004
(Continued)

OTHER PUBLICATIONS

Odyssey Backstryke Dart Putter Review, JacksGolfingSolutions.com (http://www.jacksgolfingsolutions.com/odyssey-dart-golf-putter-review.html), 2011-2012.
(Continued)

*Primary Examiner* — Alvin A Hunter

(57) ABSTRACT

Examples of golf club heads and methods to manufacture golf club heads are generally described herein. In one example, a top portion of a golf club head includes an alignment aid having a first plurality of strip portions and a second plurality of strip portions bounded by a virtual outline. The first plurality of strip portions have different surface areas. The second plurality of strip portions have different surface areas. The first plurality of strip portions and the second plurality of strip portions touch or border upon the virtual outline. The first plurality of strip portions are spaced apart in a rear-to-front direction of the golf club head and are ordered by decreasing surface area. The second plurality of strip portions are spaced apart in the rear-to-front direction and are ordered by decreasing surface area. Other examples and examples may be described and claimed.

20 Claims, 27 Drawing Sheets

Related U.S. Application Data a continuation-in-part of application No. 17/472,321, filed on Sep. 10, 2021, and a continuation-in-part of application No. 17/378,252, filed on Jul. 16, 2021, and a continuation-in-part of application No. 17/344,705, filed on Jun. 10, 2021, said application No. 17/378,252 is a continuation of application No. 17/232,401, filed on Apr. 16, 2021, now Pat. No. 11,090,535, application No. 17/680,520, which is a continuation-in-part of application No. 17/133,260, filed on Dec. 23, 2020, and a continuation-in-part of application No. 17/123,325, filed on Dec. 16, 2020, said application No. 17/472,321 is a continuation of application No. 16/940,806, filed on Jul. 28, 2020, now Pat. No. 11,141,635, said application No. 17/344,705 is a continuation of application No. 16/751,500, filed on Jan. 24, 2020, now Pat. No. 11,045,698, application No. 17/680,520, which is a continuation-in-part of application No. 16/674,332, filed on Nov. 5, 2019, now Pat. No. 11,311,781, said application No. 17/232,401 is a continuation of application No. 16/567,937, filed on Sep. 11, 2019, now Pat. No. 10,981,038, said application No. 16/674,332 is a continuation of application No. 16/275,883, filed on Feb. 14, 2019, now Pat. No. 10,493,331, said application No. 16/751,500 is a continuation-in-part of application No. 16/035,271, filed on Jul. 13, 2018, now Pat. No. 10,576,339, said application No. 16/940,806 is a continuation of application No. 16/006,055, filed on Jun. 12, 2018, now Pat. No. 10,737,153, and a continuation-in-part of application No. 15/987,731, filed on May 23, 2018, now Pat. No. 10,821,341, which is a continuation-in-part of application No. 15/922,506, filed on Mar. 15, 2018, now abandoned, and a continuation-in-part of application No. 15/831,151, filed on Dec. 4, 2017, now Pat. No. 10,478,680, and a continuation-in-part of application No. 15/489,366, filed on Apr. 17, 2017, now Pat. No. 10,124,221, and a continuation-in-part of application No. 15/188,661, filed on Jun. 21, 2016, now Pat. No. 10,441,858, said application No. 15/489,366 is a continuation of application No. 15/078,749, filed on Mar. 23, 2016, now Pat. No. 9,649,540, said application No. 15/188,661 is a continuation of application No. 14/812,212, filed on Jul. 29, 2015, now Pat. No. 9,387,375.

(60) Provisional application No. 63/215,078, filed on Jun. 25, 2021, provisional application No. 63/008,654, filed on Apr. 10, 2020, provisional application No. 62/949,064, filed on Dec. 17, 2019, provisional application No. 62/798,277, filed on Jan. 29, 2019, provisional application No. 62/755,241, filed on Nov. 2, 2018, provisional application No. 62/745,194, filed on Oct. 12, 2018, provisional application No. 62/659,060, filed on Apr. 17, 2018, provisional application No. 62/644,233, filed on Mar. 16, 2018, provisional application No. 62/574,071, filed on Oct. 18, 2017, provisional application No. 62/536,266, filed on Jul. 24, 2017, provisional application No. 62/533,481, filed on Jul. 17, 2017, provisional application No. 62/518,715, filed on Jun. 13, 2017, provisional application No. 62/480,338, filed on Mar. 31, 2017, provisional application No. 62/431,157, filed on Dec. 7, 2016, provisional application No. 62/213,933, filed on Sep. 3, 2015, provisional application No. 62/212,462, filed on Aug. 31, 2015, provisional application No. 62/146,114, filed on Apr. 10, 2015, provisional application No. 62/138,925, filed on Mar. 26, 2015, provisional application No. 62/030,820, filed on Jul. 30, 2014.

(52) U.S. Cl.
CPC ..... *A63B 53/047* (2013.01); *A63B 53/0408* (2020.08); *A63B 53/0437* (2020.08); *A63B 53/0441* (2020.08); *A63B 53/0466* (2013.01); *A63B 2053/0491* (2013.01)

(58) Field of Classification Search
USPC ..... 473/251–254, 324–350
See application file for complete search history.

(56) References Cited

U.S. PATENT DOCUMENTS

| | | | | | |
|---|---|---|---|---|---|
| 922,444 | A | | 5/1909 | Youds | |
| 1,094,599 | A | | 4/1914 | Samson | |
| D57,980 | S | | 5/1921 | Kraeuter | |
| D63,284 | S | | 11/1923 | Challis | |
| 1,485,272 | A | | 2/1924 | John | |
| RE19,178 | E | | 5/1934 | Spiker | |
| 2,859,972 | A | * | 11/1958 | Reach | A63B 60/00 473/242 |
| 3,199,873 | A | | 8/1965 | Surratt | |
| 3,199,874 | A | | 8/1965 | Blasing | |
| D205,041 | S | * | 6/1966 | Capps | D10/64 |
| D231,850 | S | | 6/1974 | Winter | |
| D236,736 | S | | 9/1975 | Winter | |
| 3,921,984 | A | * | 11/1975 | Winter | A63B 53/0487 473/251 |
| 3,989,257 | A | | 11/1976 | Barr | |
| 4,043,562 | A | | 8/1977 | Shillington | |
| 4,077,633 | A | * | 3/1978 | Studen | A63B 53/0487 473/340 |
| D248,783 | S | | 8/1978 | Long | |
| 4,291,883 | A | | 9/1981 | Smart et al. | |
| 4,340,230 | A | | 7/1982 | Churchward | |
| D279,497 | S | | 7/1985 | Brown | |
| D281,092 | S | | 10/1985 | Mills | |
| 4,659,083 | A | * | 4/1987 | Szczepanski | A63B 69/3685 D21/745 |
| 4,688,798 | A | | 8/1987 | Pelz | |
| 4,693,478 | A | | 9/1987 | Long | |
| 4,754,977 | A | | 7/1988 | Sahm | |
| D298,767 | S | * | 11/1988 | Szczepanski | D21/744 |
| 4,869,507 | A | | 9/1989 | Sahm | |
| 4,872,683 | A | | 10/1989 | Doran et al. | |
| 4,964,641 | A | | 10/1990 | Miesch et al. | |
| D313,451 | S | | 1/1991 | Shearer | |
| D329,890 | S | * | 9/1992 | Pinder | D21/742 |
| D335,317 | S | | 5/1993 | Shearer | |
| D335,692 | S | | 5/1993 | Antonious | |
| D336,757 | S | | 6/1993 | Antonious | |
| 5,221,086 | A | * | 6/1993 | Antonious | A63B 53/0466 473/327 |
| 5,275,412 | A | | 1/1994 | Innes | |
| D350,582 | S | | 9/1994 | Miansian et al. | |
| 5,390,919 | A | | 2/1995 | Stubbs et al. | |
| D356,131 | S | | 3/1995 | Trimble | |
| 5,409,228 | A | | 4/1995 | Botsch | |
| D359,330 | S | | 6/1995 | Channell | |
| D360,444 | S | | 7/1995 | Takahashi et al. | |
| 5,429,366 | A | | 7/1995 | McCabe | |
| 5,447,313 | A | | 9/1995 | Finley | |
| D363,101 | S | | 10/1995 | Sturm | |
| D364,665 | S | | 11/1995 | Goodrich | |
| D365,864 | S | | 1/1996 | Sturm | |
| 5,489,097 | A | | 2/1996 | Simmons | |
| D368,751 | S | | 4/1996 | Rife | |
| D369,393 | S | | 4/1996 | Takahashi et al. | |

(56) References Cited

U.S. PATENT DOCUMENTS 5,511,786 A * 4/1996 Antonious ..... A63B 60/00 473/327
5,571,053 A 11/1996 Lane
D378,688 S 4/1997 Cameron
D380,514 S 7/1997 Markley
D381,382 S 7/1997 Fenton, Jr.
D385,609 S 10/1997 Cameron
5,683,307 A 11/1997 Rife
D388,143 S 12/1997 Huan-Chiang
D389,207 S 1/1998 Cameron
D398,685 S 9/1998 Masuda
5,807,190 A 9/1998 Krumme et al.
D399,274 S 10/1998 Bradford
D399,290 S 10/1998 Sizemore, Jr.
D399,911 S 10/1998 Nicolette et al.
5,839,974 A 11/1998 McAllister
D401,991 S 12/1998 Collins
D402,722 S 12/1998 Rollinson
D405,836 S 2/1999 Nicolette et al.
D409,701 S 5/1999 Ashcraft et al.
D411,275 S 6/1999 Bottema et al.
5,924,938 A 7/1999 Hines
D412,728 S 8/1999 Broadbridge et al.
D415,809 S 10/1999 Bottema et al.
D416,062 S 11/1999 Solheim et al.
D416,969 S 11/1999 Solheim et al.
D416,970 S 11/1999 Solheim et al.
6,007,434 A 12/1999 Baker et al.
D421,473 S 3/2000 Solheim et al.
D422,041 S 3/2000 Bradford
D422,655 S 4/2000 Hicks
6,050,903 A 4/2000 Lake
6,062,986 A * 5/2000 Kaise ..... A63B 53/0487 473/254
D426,276 S 6/2000 Besnard et al.
6,089,993 A 7/2000 Woodward et al.
D429,302 S 8/2000 Antonious
6,110,057 A 8/2000 McKinnon
D430,914 S 9/2000 Antonious
D431,853 S 10/2000 Antonious
D431,854 S 10/2000 Cameron
D432,192 S 10/2000 Hicks
D434,821 S 12/2000 Farrar
D436,151 S 1/2001 Nicolette et al.
D437,374 S 2/2001 Cameron
6,200,227 B1 3/2001 Sery
6,200,229 B1 * 3/2001 Grace ..... A63B 53/0487 473/409
D441,820 S 5/2001 Nicolette et al.
D443,668 S 6/2001 Nicolette et al.
D443,905 S 6/2001 Nicolette et al.
6,244,974 B1 * 6/2001 Hanberry, Jr. ..... A63B 53/007 473/340
D444,833 S 7/2001 Wells et al.
D444,835 S 7/2001 Wahl et al.
6,257,994 B1 7/2001 Antonious
6,264,571 B1 7/2001 Lekavich
D449,664 S 10/2001 Beebe et al.
D449,865 S 10/2001 Fife, Jr. et al.
D450,799 S 11/2001 Nicolette et al.
D451,973 S 12/2001 Wells et al.
6,348,014 B1 2/2002 Chiu
6,354,959 B1 3/2002 Nicolette et al.
6,379,258 B1 * 4/2002 To ..... A63B 69/3676 473/409
6,394,910 B1 5/2002 McCarthy
D458,656 S 6/2002 Tang et al.
6,435,975 B2 8/2002 Middleton
6,471,600 B2 10/2002 Tang et al.
6,506,125 B2 1/2003 Helmstetter et al.
D472,949 S 4/2003 Serrano
D474,821 S 5/2003 Wells et al.
6,558,268 B2 5/2003 Tindale
D479,291 S * 9/2003 Murray ..... D21/742
6,634,955 B2 10/2003 Middleton
D482,087 S 11/2003 Burrows
6,652,390 B2 11/2003 Bradford
D483,086 S 12/2003 Schweigert et al.
D483,825 S 12/2003 Green
D486,539 S 2/2004 Burrows
D486,872 S 2/2004 Schweigert et al.
D488,200 S 4/2004 Olsavsky et al.
D490,487 S 5/2004 Burrows
6,743,112 B2 6/2004 Nelson
D494,239 S 8/2004 Green
D498,276 S 11/2004 Schweigert et al.
D500,823 S 1/2005 Aldrich
D502,518 S 3/2005 Smart
6,893,355 B2 5/2005 Souza et al.
6,902,496 B2 6/2005 Solheim et al.
6,902,498 B2 6/2005 Sullivan et al.
6,905,420 B2 6/2005 Tang et al.
D509,273 S 9/2005 Morris et al.
6,949,028 B1 9/2005 Hueber
D511,801 S 11/2005 Garcia
D512,114 S 11/2005 Garcia
D512,116 S 11/2005 Miraflor et al.
6,974,394 B1 12/2005 Tang et al.
6,988,955 B2 1/2006 Stoakes
6,988,956 B2 1/2006 Cover et al.
7,001,284 B2 * 2/2006 Edel ..... A63B 69/3685 473/226
D520,088 S 5/2006 Parr
D520,584 S 5/2006 Karlsen
7,048,648 B2 5/2006 Breier et al.
D529,109 S 9/2006 Jones
7,101,288 B2 9/2006 Thomas
D531,242 S 10/2006 Adams
7,125,341 B1 10/2006 D'Eath
D532,067 S 11/2006 Soracco et al.
7,147,569 B2 12/2006 Tang et al.
7,153,220 B2 12/2006 Lo
D534,595 S 1/2007 Hasebe
7,156,752 B1 1/2007 Bennett
7,166,036 B2 1/2007 Byrne et al.
D536,401 S 2/2007 Kawami
D536,403 S 2/2007 Kawami
D537,898 S 3/2007 Kuan et al.
D538,371 S 3/2007 Kawami
7,204,765 B2 4/2007 Cover et al.
D542,869 S 5/2007 Adams
D542,873 S 5/2007 Oldknow
D543,598 S 5/2007 Kuan et al.
D543,601 S 5/2007 Kawami
D555,219 S 11/2007 Lin
D556,277 S 11/2007 Broom
7,309,297 B1 12/2007 Solari
D561,854 S 2/2008 Morris
7,331,876 B2 2/2008 Klein
D565,137 S 3/2008 Oldknow et al.
7,344,451 B2 3/2008 Tang et al.
7,351,162 B2 4/2008 Soracco et al.
D569,460 S 5/2008 Walker et al.
D569,461 S 5/2008 Morris
D569,930 S 5/2008 Nehrbas
7,371,184 B2 * 5/2008 Tao ..... A63B 53/0487 473/251
7,384,345 B2 6/2008 Sherman
7,396,289 B2 7/2008 Soracco et al.
D577,085 S 9/2008 Nicolette et al.
D577,086 S 9/2008 Nicolette et al.
D579,506 S 10/2008 Nicolette et al.
7,431,659 B2 10/2008 Williams et al.
D579,995 S 11/2008 Nicolette et al.
D582,497 S 12/2008 Rollinson
7,473,189 B2 1/2009 Schweigert et al.
7,485,047 B2 2/2009 Evans
7,491,131 B2 * 2/2009 Vinton ..... A63B 60/02 473/340
7,491,135 B1 2/2009 Rollinson
D594,921 S 6/2009 Bettinardi
D595,370 S 6/2009 Ines et al.
D595,793 S 7/2009 Rollinson

(56) References Cited

U.S. PATENT DOCUMENTS

D599,425 S 9/2009 Laub
D599,867 S 9/2009 Teramoto
D600,295 S 9/2009 Meeks
D600,762 S 9/2009 Serrano et al.
D600,763 S 9/2009 Cameron
D601,214 S 9/2009 Serrano et al.
7,614,960 B2 11/2009 Miller et al.
D606,139 S 12/2009 Ines et al.
D606,140 S 12/2009 Ramsauer
D606,141 S 12/2009 Ramsauer
D606,142 S 12/2009 Ramsauer
D607,951 S 1/2010 Teramoto
D607,952 S 1/2010 Demkowski et al.
D617,857 S 6/2010 Sones
7,744,485 B2 6/2010 Jones et al.
D619,666 S 7/2010 DePaul
7,758,439 B2 7/2010 Roenick
D620,993 S 8/2010 Laub
D621,461 S 8/2010 Serrano et al.
D623,709 S 9/2010 Serrano et al.
D623,710 S * 9/2010 Hilton ..... A63B 53/0487 D21/743
D628,255 S 11/2010 Rollinson
7,867,104 B2 1/2011 Franklin et al.
D631,925 S 2/2011 Broom
7,887,432 B2 2/2011 Jones et al.
D633,964 S 3/2011 Teramoto
7,905,792 B1 3/2011 Stites et al.
7,909,707 B2 3/2011 Klein
7,918,745 B2 4/2011 Morris et al.
7,927,226 B1 4/2011 Twitty
D638,891 S 5/2011 Nicolette et al.
7,942,758 B2 5/2011 Nakamura
D639,369 S 6/2011 Miyamichi
D642,643 S 8/2011 Nicolette et al.
D643,485 S 8/2011 Nicolette et al.
D643,892 S 8/2011 McGrorty
D645,104 S 9/2011 Nicolette et al.
8,075,416 B2 12/2011 Stites et al.
8,096,039 B2 * 1/2012 Soracco ..... A63B 53/0487 473/340
D653,718 S 2/2012 Stokke et al.
8,109,841 B2 2/2012 Miyamichi
D655,361 S 3/2012 Ramsauer
D657,836 S 4/2012 Oldknow et al.
D657,837 S 4/2012 Oldknow et al.
D658,245 S 4/2012 Oldknow et al.
D661,753 S 6/2012 Cameron et al.
D666,260 S 8/2012 Cynn
8,303,434 B1 11/2012 DePaul
D672,418 S 12/2012 Rollinson
8,328,654 B2 12/2012 Demkowski et al.
8,337,320 B2 * 12/2012 Franklin ..... A63B 60/00 473/331
8,371,958 B2 2/2013 Treadwell
8,376,878 B2 2/2013 Bennett et al.
8,480,504 B2 * 7/2013 Hilton ..... A63B 53/0487 473/340
D688,339 S 8/2013 Hilton et al.
D688,341 S 8/2013 Rollinson
8,506,415 B2 * 8/2013 Franklin ..... A63B 53/0487 473/340
D691,226 S 10/2013 Hilton et al.
8,608,590 B2 12/2013 Hackel et al.
D699,308 S 2/2014 Rollinson
8,696,492 B1 4/2014 Hocknell et al.
D704,782 S 5/2014 Rollinson
8,721,472 B2 5/2014 Kuan et al.
8,790,193 B2 7/2014 Serrano et al.
D711,483 S 8/2014 Wong
8,834,285 B2 * 9/2014 Franklin ..... A63B 53/0487 473/340
D715,388 S 10/2014 Serrano et al.
8,900,064 B2 * 12/2014 Franklin ..... A63B 53/0487 473/331
D722,350 S 2/2015 Schweigert
D722,351 S 2/2015 Parsons et al.
D722,352 S 2/2015 Nicolette et al.
D723,120 S 2/2015 Nicolette
D724,164 S 3/2015 Schweigert et al.
D725,208 S 3/2015 Schweigert
D726,265 S 4/2015 Nicolette
D726,270 S 4/2015 Rollinson
D726,846 S 4/2015 Schweigert
D730,462 S 5/2015 Becktor et al.
D732,122 S 6/2015 Becktor
D732,618 S 6/2015 Becktor et al.
D733,234 S 6/2015 Nicolette
D735,283 S 7/2015 Solheim et al.
9,095,759 B2 * 8/2015 Hilton ..... A63B 69/3685
9,108,088 B2 8/2015 Semano et al.
D738,447 S 9/2015 Schweigert
D738,449 S 9/2015 Schweigert
D739,487 S 9/2015 Schweigert
9,144,717 B2 9/2015 Franklin et al.
D741,426 S 10/2015 Schweigert
D746,926 S 1/2016 Parsons et al.
D748,213 S 1/2016 Parsons et al.
D748,215 S 1/2016 Parsons et al.
9,233,283 B2 1/2016 Schweigert
9,265,996 B1 2/2016 Abbott et al.
D752,697 S 3/2016 Claveran
9,289,659 B2 3/2016 Franklin
D753,252 S 4/2016 Schweigert
9,415,279 B2 8/2016 Foster
9,440,124 B2 9/2016 Parsons et al.
D771,209 S * 11/2016 Chen ..... D21/752
9,498,685 B2 11/2016 Abbott et al.
9,566,484 B1 2/2017 Abbott et al.
D783,745 S 4/2017 Chen
D791,254 S 7/2017 Ramsauer
D791,891 S 7/2017 Davis
D794,146 S 8/2017 Davis
D798,975 S 10/2017 Becktor
D798,976 S 10/2017 Becktor
D798,977 S 10/2017 Becktor
D798,978 S 10/2017 Becktor
D798,979 S 10/2017 Becktor
D798,980 S 10/2017 Becktor
D798,981 S 10/2017 Becktor et al.
D799,619 S 10/2017 Becktor et al.
D802,073 S 11/2017 Toulon
D809,616 S 2/2018 Toulon et al.
D812,163 S 3/2018 Kroloff
D812,164 S * 3/2018 Parsons ..... D21/742
9,987,530 B2 6/2018 Jertson et al.
D824,462 S 7/2018 Bruschi et al.
D827,742 S 9/2018 Weaver
10,086,243 B2 * 10/2018 Sheldon ..... A63B 53/0487
D835,217 S 12/2018 Nicolette
D837,911 S 1/2019 Bruschi et al.
10,173,105 B2 1/2019 Myers et al.
D839,977 S 2/2019 Rollinson et al.
D844,085 S 3/2019 Nicolette
D844,723 S 4/2019 Nicolette
D846,672 S 4/2019 Rollinson et al.
D859,545 S 9/2019 Long et al.
D861,091 S 9/2019 Glorioso et al.
D865,091 S 10/2019 Rollinson et al.
D877,831 S 3/2020 Cameron
D880,631 S 4/2020 Demille et al.
D888,174 S 6/2020 Rollinson et al.
D890,277 S 7/2020 Rollinson et al.
D892,243 S 8/2020 Rollinson et al.
D892,955 S 8/2020 Clarke et al.
D893,654 S 8/2020 Price et al.
D893,655 S 8/2020 Schweigert et al.
D895,037 S 9/2020 Clarke et al.
D896,328 S 9/2020 Clarke et al.
D905,185 S 12/2020 Rollinson et al.
D906,453 S 12/2020 Agrella et al.
D906,457 S 12/2020 Lambeth et al.

(56) References Cited

U.S. PATENT DOCUMENTS

| | | | | |
|---|---|---|---|---|
| D907,146 | S | 1/2021 | Cyrulik et al. | |
| D907,147 | S | 1/2021 | Agrella et al. | |
| D907,730 | S | 1/2021 | Rollinson et al. | |
| D909,518 | S | 2/2021 | Rollinson et al. | |
| D912,177 | S | 3/2021 | Greer et al. | |
| 11,298,597 | B2 * | 4/2022 | Parsons | A63B 53/0416 |
| 2004/0138003 | A1 | 7/2004 | Grace | |
| 2004/0180730 | A1 | 9/2004 | Franklin et al. | |
| 2005/0059506 | A1 | 3/2005 | Yamamoto | |
| 2005/0181889 | A1 | 8/2005 | Green | |
| 2005/0187028 | A1 | 8/2005 | Chang et al. | |
| 2005/0192114 | A1 * | 9/2005 | Zider | A63B 53/0487 473/251 |
| 2006/0052178 | A1 | 3/2006 | Franklin et al. | |
| 2006/0094522 | A1 | 5/2006 | Tang et al. | |
| 2006/0223649 | A1 | 10/2006 | Rife | |
| 2007/0004524 | A1 | 1/2007 | Harrison | |
| 2007/0129163 | A1 | 6/2007 | Solari | |
| 2007/0135229 | A1 | 6/2007 | Lo et al. | |
| 2007/0142122 | A1 | 6/2007 | Bonneau | |
| 2007/0207875 | A1 | 9/2007 | Kuan et al. | |
| 2007/0213140 | A1 * | 9/2007 | Miller | A63B 69/3685 473/251 |
| 2007/0238548 | A1 | 10/2007 | Johnson | |
| 2007/0243943 | A1 | 10/2007 | Inouye et al. | |
| 2007/0293346 | A1 * | 12/2007 | Rollinson | A63B 53/12 473/340 |
| 2008/0096682 | A1 * | 4/2008 | Fox | A63B 53/0487 473/340 |
| 2008/0102983 | A1 | 5/2008 | Lee | |
| 2008/0139333 | A1 | 6/2008 | Klein | |
| 2008/0146372 | A1 | 6/2008 | John | |
| 2008/0153623 | A1 * | 6/2008 | Ines | A63B 53/0487 473/340 |
| 2008/0176672 | A1 | 7/2008 | Roach et al. | |
| 2009/0017933 | A1 * | 1/2009 | Stites | A63B 53/007 473/340 |
| 2009/0029800 | A1 | 1/2009 | Jones et al. | |
| 2009/0286620 | A1 * | 11/2009 | Franklin | A63B 60/02 473/340 |
| 2009/0286621 | A1 * | 11/2009 | Franklin | A63B 60/54 473/340 |
| 2010/0234127 | A1 * | 9/2010 | Snyder | A63B 53/04 473/331 |
| 2010/0255922 | A1 | 10/2010 | Lueders | |
| 2010/0304878 | A1 * | 12/2010 | Reichow | A63B 53/0487 473/340 |
| 2011/0165959 | A1 | 7/2011 | Klein | |
| 2012/0034990 | A1 * | 2/2012 | Cohen | A63B 53/007 473/250 |
| 2012/0064992 | A1 * | 3/2012 | Franklin | A63B 53/0487 473/340 |
| 2012/0184393 | A1 * | 7/2012 | Franklin | A63B 53/0487 473/340 |
| 2013/0012331 | A1 * | 1/2013 | Goldsmith | A63B 53/0466 473/409 |
| 2013/0165256 | A1 | 6/2013 | Stevenson | |
| 2013/0210537 | A1 | 8/2013 | Ainscough et al. | |
| 2014/0200095 | A1 | 7/2014 | Kim | |
| 2015/0057100 | A1 | 2/2015 | Serrano et al. | |
| 2015/0258390 | A1 | 9/2015 | DeFrancesco, Jr. | |
| 2015/0306477 | A1 | 10/2015 | Parsons et al. | |
| 2016/0016050 | A1 | 1/2016 | Rife | |
| 2016/0346648 | A1 * | 12/2016 | Sheldon | A63B 53/0487 |
| 2016/0346649 | A1 | 12/2016 | Jertson et al. | |
| 2018/0001163 | A1 | 1/2018 | Becktor et al. | |
| 2018/0311545 | A1 | 11/2018 | Lambeth et al. | |
| 2019/0175995 | A1 | 6/2019 | Kroloff et al. | |
| 2019/0175996 | A1 | 6/2019 | Kroloff et al. | |
| 2020/0061421 | A1 | 2/2020 | Kroloff et al. | |
| 2020/0147460 | A1 | 5/2020 | Serrano et al. | |
| 2021/0331047 | A1 * | 10/2021 | Stites | A63B 53/0487 |
| 2021/0402267 | A1 * | 12/2021 | Parsons | A63B 53/0416 |

FOREIGN PATENT DOCUMENTS

| | | | | |
|---|---|---|---|---|
| JP | 2005065796 | A | 3/2005 | |
| JP | 2005160691 | A | 6/2005 | |
| KR | 200377377 | Y1 | 3/2005 | |
| KR | 200403045 | Y1 | 12/2005 | |
| KR | 20100065481 | A | 6/2010 | |
| KR | 101773069 | B1 | 8/2017 | |
| WO | 2006113966 | A1 | 11/2006 | |
| WO | WO-2006113966 | A1 * | 11/2006 | A63B 69/3685 |
| WO | WO-2008074093 | A1 * | 6/2008 | A63B 69/3632 |
| WO | WO-2011043708 | A1 * | 4/2011 | A63B 53/0487 |
| WO | WO-2012036991 | A1 * | 3/2012 | A63B 53/007 |

OTHER PUBLICATIONS

Plugged in Golf (2015 Bettinardi Putters Review) [online]. Mar. 3, 2015 [retrieve Nov. 25, 2019] Retrieve from the internet.

TourSpecGolf (Gold's Factory Multi Weigted Custom Putter), Published Nov. 20, 2010 [http://blog.tourspecgolf.com/golds-factory-multi-weighted-custom-putter/], Retrieved May 17, 2020.

U.S. Appl. No. 29/523,587, Schweigert, "Golf Club Head," filed Apr. 10, 2015.

* cited by examiner

GOLF CLUB HEADS AND METHODS TO MANUFACTURE GOLF CLUB HEADS

CROSS REFERENCE

This application is a continuation-in-part of application Ser. No. 17/472,321, filed Sep. 10, 2021, which is a continuation of application Ser. No. 16/940,806, filed Jul. 28, 2020, now U.S. Pat. No. 11,141,635, which is a continuation of U.S. application Ser. No. 16/006,055, filed Jun. 12, 2018, now U.S. Pat. No. 10,737,153, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, U.S. Provisional Application No. 62/644,233, filed Mar. 16, 2018, and U.S. Provisional Application No. 62/659,060, filed Apr. 17, 2018.

U.S. patent application Ser. No. 16/940,806, filed Jul. 28, 2020, is a continuation-in-part of application Ser. No. 15/987,731, filed May 23, 2018, now U.S. Pat. No. 10,821,341, which claims the benefit of U.S. Provisional Application No. 62/518,715, filed Jun. 13, 2017, U.S. Provisional Application No. 62/533,481, filed Jul. 17, 2017, U.S. Provisional Application No. 62/536,266, filed Jul. 24, 2017, and U.S. Provisional Application No. 62/574,071, filed Oct. 18, 2017.

U.S. application Ser. No. 15/987,731 is a continuation-in-part of application Ser. No. 15/188,661, filed Jun. 21, 2016, now U.S. Pat. No. 10,441,858, which is a continuation of application Ser. No. 14/812,212, filed Jul. 29, 2015, now U.S. Pat. No. 9,387,375, which claims the benefit of U.S. Provisional Application No. 62/030,820, filed Jul. 30, 2014, and U.S. Provisional Application No. 62/146,114, filed Apr. 10, 2015.

U.S. application Ser. No. 15/987,731 is a continuation-in-part of application Ser. No. 15/489,366, filed Apr. 17, 2017, now U.S. Pat. No. 10,124,212, which is a continuation of application Ser. No. 15/078,749, filed Mar. 23, 2016, now U.S. Pat. No. 9,649,540, which claims the benefit of U.S. Provisional Application No. 62/138,925, filed Mar. 26, 2015, U.S. Provisional Application No. 62/212,462, filed Aug. 31, 2015, and U.S. Provisional Application No. 62/213,933, filed Sep. 3, 2015.

U.S. application Ser. No. 15/987,731 is a continuation-in-part of application Ser. No. 15/831,151, filed Dec. 4, 2017, now U.S. Pat. No. 10,478,680, which claims the benefit of U.S. Provisional Application No. 62/431,157, filed Dec. 7, 2016.

U.S. application Ser. No. 15/987,731 is a continuation-in-part of application Ser. No. 15/922,506, filed Mar. 15, 2018, now abandoned, which claims the benefit of U.S. Provisional Application No. 62/480,338, filed Mar. 31, 2017.

This application is a continuation-in-part of application Ser. No. 16/674,332, filed Nov. 5, 2019, which is a continuation of application Ser. No. 16/275,883, filed Feb. 14, 2019, now U.S. Pat. No. 10,493,331, which claims the benefit of U.S. Provisional Application No. 62/745,194, filed Oct. 12, 2018, and U.S. Provisional Application No. 62/755,241, filed Nov. 2, 2018.

This application is a continuation-in-part of application Ser. No. 17/344,705, filed Jun. 10, 2021, which is a continuation of application Ser. No. 16/751,500, filed Jan. 24, 2020, now U.S. Pat. No. 11,045,698, which claims the benefit of U.S. Provisional Application No. 62/798,277, filed Jan. 29, 2019.

U.S. application Ser. No. 16/751,500 is a continuation-in-part of application Ser. No. 16/035,271, filed Jul. 13, 2018, now U.S. Pat. No. 10,576,339, which claims the benefit of U.S. Provisional Application No. 62/533,481, filed Jul. 17, 2017.

This application is a continuation-in-part of application Ser. No. 17/378,252, filed Jul. 16, 2021, which is a continuation of application Ser. No. 17/232,401, filed Apr. 16, 2021, now U.S. Pat. No. 11,090,535, which is a continuation of application Ser. No. 16/567,937, filed Sep. 11, 2019, now U.S. Pat. No. 10,981,038.

This application is a continuation-in-part of application Ser. No. 17/123,325, filed Dec. 16, 2020, which claims the benefit of U.S. Provisional Application No. 62/949,064, filed Dec. 17, 2019.

This application is a continuation-in-part of application Ser. No. 17/133,260, filed Dec. 23, 2020, which claims the benefit of U.S. Provisional Application No. 63/008,654, filed Apr. 10, 2020.

This application is a continuation-in-part of application Ser. No. 17/474,925, filed Sep. 14, 2021, which claims the benefit of U.S. Provisional Application No. 63/215,078, filed Jun. 25, 2021.

The disclosures of the above listed applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Proper alignment of a golf club head at an address position relative to a golf ball may improve the performance of an individual. Various alignment aids have been used on the golf club heads to improve the individual's visual alignment.

Figure 1:
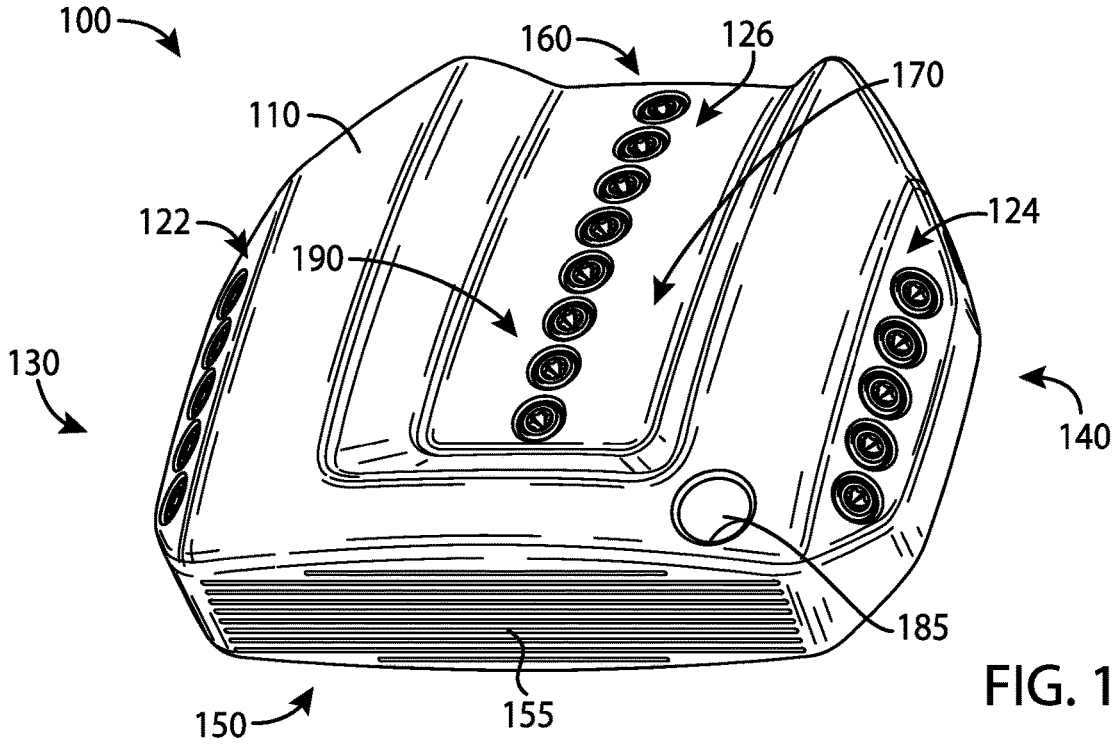
FIG. 1 depicts a front and top perspective view of a golf club head according to an example of the apparatus, methods, and articles of manufacture described herein.
Figure 2:
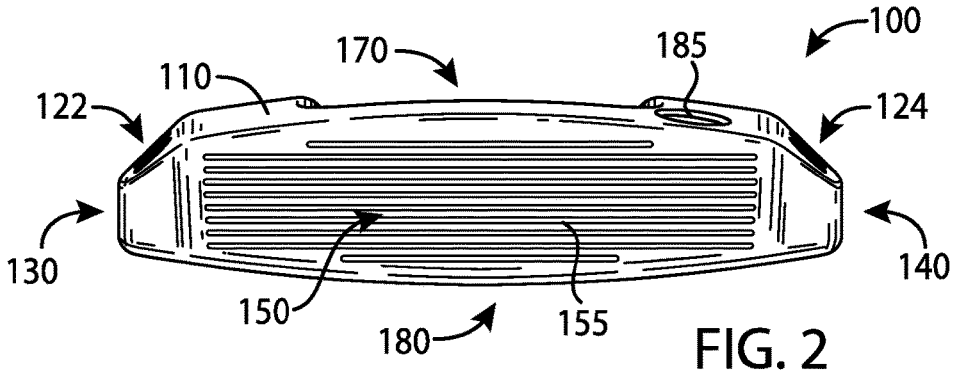
FIG. 2 depicts a front view of the example golf club head of FIG. 1.
Figure 3:
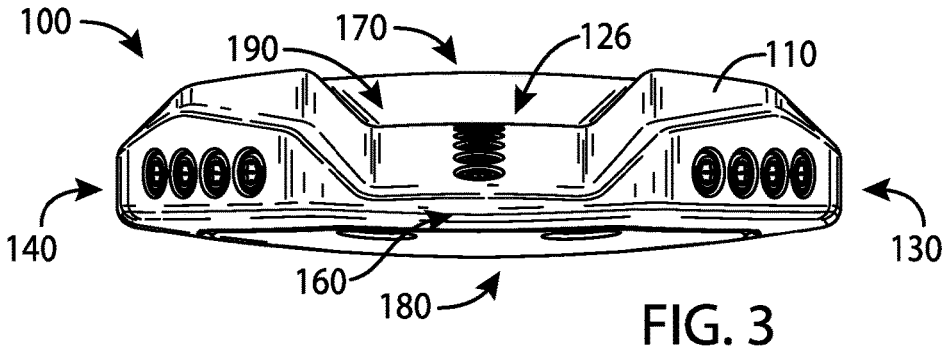
FIG. 3 depicts a rear view of the example golf club head of FIG. 1.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of examples of the present disclosure.

DESCRIPTION

In general, golf club heads and methods to manufacture golf club heads are described herein. The apparatus, methods, and articles of manufacture described herein are not limited in this regard.

In the example of FIGS. 1-13, a golf club head 100 may include a body portion 110 and a visual guide portion, which is generally shown as a first visual guide portion 122, a second visual guide portion 124, and a third visual guide portion 126. The body portion 110 may include a toe portion 130, a heel portion 140, a front portion 150, a rear portion 160, a top portion 170, and a sole portion 180. The body portion 110 may also include a bore 185 to receive a shaft (not shown) with a grip (not shown). Alternatively, the body portion 110 may include a hosel (not shown) to receive the shaft. The golf club head 100 and the grip may be located on opposite ends of the shaft to form a golf club. The apparatus, methods, and articles of manufacture described herein are not limited in this regard.

The body portion 110 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 110 may be partially or entirely made of a non-metal material (e.g., composite, plastic, etc.). The golf club head 100 may be a putter-type golf club head (e.g., a blade-type putter, a mid-mallet-type putter, a mallet-type putter, etc.). Based on the type of putter as mentioned above, the body portion 110 may be at least 200 grams. For example, the body portion 110 may be in a range between 300 to 600 grams. The apparatus, methods, and articles of manufacture described herein are not limited in this regard.

The toe and heel portions 130 and 140, respectively, may be on opposite ends of the body portion 110 and may define a width of the body portion 110. The front and rear portions 150 and 160, respectively, may be on opposite ends of the body portion 110 and may define a length of the body portion 110. The front portion 150 may include a face portion 155 (e.g., a strike face), which may be used to impact a golf ball (not shown). The face portion 155 may be an integral portion of the body portion 110. Alternatively, the face portion 155 may be a separate piece or an insert coupled to the body portion 110 via various manufacturing and/or processes (e.g., a bonding process, a welding process, a brazing process, a mechanical locking method, a mechanical fastening method, any combination thereof, or other suitable types of manufacturing methods and/or processes). The face portion 155 may be associated with a loft plane that defines the loft angle of the golf club head 100. The apparatus, methods, and articles of manufacture described herein are not limited in this regard.

Figure 8:
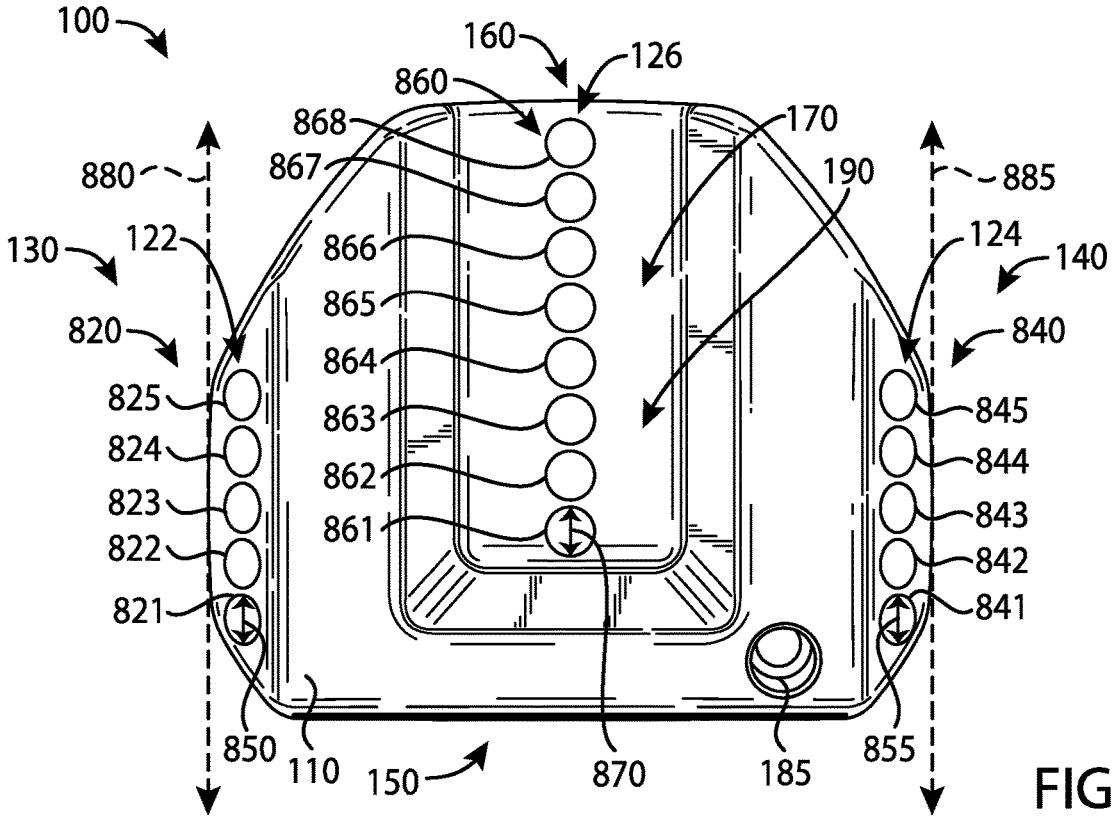
FIG. 8 depicts a top view of a body portion of the example golf club head of FIG. 1.

As illustrated in FIG. 8, for example, the body portion 110 may include two or more weight ports, generally shown as a first set of weight ports 820 (e.g., shown as weight ports 821, 822, 823, 824, and 825) to form the first visual guide portion 122 and a second set of weight ports 840 (e.g., shown as weight ports 841, 842, 843, 844, and 845) to form the second visual guide portion 124. The first and second sets of weight ports 820 and 840, respectively, may be exterior weight ports configured to receive one or more weight portions (e.g., one shown as 1000 in FIG. 10). In particular, the first and second sets of weight ports 820 and 840 may be located at or proximate to a periphery of the golf club head 100. For example, the first and second sets of weight ports 820 and 840, respectively, may be on or proximate to the top portion 170. The first set of weight ports 820 may be at or proximate to the toe portion 130 whereas the second set of weight ports 840 may be at or proximate to the heel portion 140. The apparatus, methods, and articles of manufacture described herein are not limited in this regard.

Each weight port of the first set of weight ports 820 may have a first port diameter ($PD_1$) 850. In particular, a uniform distance of less than the first port diameter 850 may separate any two adjacent weight ports of the first set of weight ports 820 (e.g., (i) weight ports 821 and 822, (ii) weight ports 822 and 823, (iii) weight ports 823 and 824, or (iv) weight ports 824 and 825). In one example, the first port diameter 850 may be about 0.25 inch (6.35 millimeters) and any two adjacent weight ports of the first set of weight ports 820 may be separated by 0.1 inch (2.54 millimeters). In a similar manner, each weight port of the second set of weight ports 840 may have a second port diameter ($PD_2$) 855. A uniform distance of less than the second port diameter 855 may separate any two adjacent weight ports of the second set of weight ports 840 (e.g., (i) weight ports 841 and 842, (ii) weight ports 842 and 843, (iii) weight ports 843 and 844, or (iv) weight ports 844 and 845). For example, the second port diameter 855 may be about 0.25 inch (6.35 millimeters) and any two adjacent weight ports of the second set of weight ports 840 may be separated by 0.1 inch (2.54 millimeters). The first and second port diameters 850 and 855 may be equal (i.e., $PD_1=PD_2$). Alternatively, the first and second port diameters 850 and 855 may be different. The apparatus, methods, and articles of manufacture described herein are not limited in this regard.

As noted above, the visual guide portion may include the third visual guide portion 126. Accordingly, the body portion 110 may include two or more weight ports, generally shown as a third set of weight ports 860 (e.g., shown as weight ports 861, 862, 863, 864, 865, 866, 867, and 868) to form the third visual guide portion 126. In particular, the third visual guide portion 126 may be substantially equidistant from the first and second visual guide portions 122 and 124. For example, the third visual guide portion 126 may extend between the front and rear portions 150 and 160 located at or proximate to a center of the body portion 110. The apparatus, methods, and articles of manufacture described herein are not limited in this regard.

Each weight port of the third set of weight ports 860 may have a third port diameter 870. In one example, the third port diameter 870 may be equal to the first port diameter 850 and/or the second port diameter 855 (e.g., 850=855=870). In another example, the third port diameter 870 may be different from the first port diameter 850 and the second port diameter 855. A uniform distance of less than the third port diameter 870 may separate any two adjacent weight ports of the third set of weight ports 860 (e.g., (i) weight ports 861 and 862, (ii) weight ports 862 and 863, (iii) weight ports 863 and 864, (iv) weight ports 864 and 865, (v) weight ports 865 and 866, (vi) weight ports 866 and 867, or (vii) weight ports 867 and 868). The body portion 110 may also include a U-shape recess portion 190. The third visual guide portion 126 may be located in the U-shape recess portion 190. The apparatus, methods, and articles of manufacture described herein are not limited in this regard.

Figure 9:
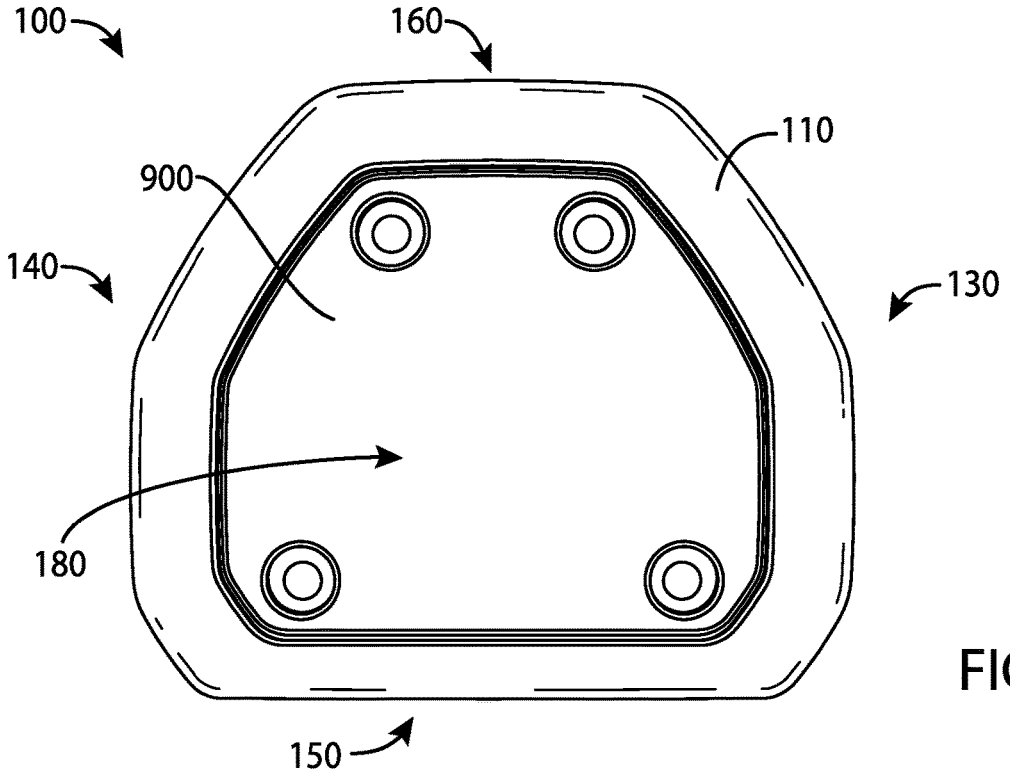
FIG. 9 depicts a bottom view of the example body portion of FIG. 8.

Further, as shown in FIG. 9, the body portion 110 may include an interior cavity 900. The interior cavity 900 may be partially or entirely filled with a polymer material, an elastic polymer or elastomer material, a thermoplastic elastomer material (TPE), a thermoplastic polyurethane material (TPU), and/or other suitable types of materials to absorb shock, isolate vibration, and/or dampen noise. A plate portion 500 (FIG. 5) may cover the interior cavity 900 from the sole portion 180. The plate portion 500 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), any combination thereof, and/or other suitable types of materials. Alternatively, the plate portion 500 may be partially or entirely made of a non-metal material (e.g., composite, plastic, etc.) with one shown as 1300 in FIG. 13. The apparatus, methods, and articles of manufacture described herein are not limited in this regard.

As illustrated in FIG. 8, the first and second visual guide portions 122 and 124, respectively, may be located a distance from a first vertical plane 880 and a second vertical plane 885, respectively. For example, the first visual guide portion 122 may be located less than one inch (25.4 millimeters) from the first vertical plane 880 and the second visual guide portion 124 may be located less than one inch (25.4 millimeters) from the second vertical plane 885. Further, a distance 400 (FIG. 4) may separate the first and second visual guide portions 122 and 124, which may be greater than a diameter of a golf ball (e.g., 1.68 inches or 42.67 millimeters). In one example, the distance 400 may be greater than three inches (76.2 millimeters). In another example, the distance 400 may be about 3.75 inches (95.25 millimeters). The apparatus, methods, and articles of manufacture described herein are not limited in this regard.

The first and second visual guide portions 122 and 124 may be located relative to the periphery of the golf club head 100. In one example, the first visual guide portion 122 may be located less than 0.5 inch (12.7 millimeters) from the periphery at or proximate to the toe portion 130 whereas the second visual guide portion 124 may be located less than 0.5 inch (12.7 millimeters) from the periphery at or proximate to the heel portion 140. In one example, each of the first and second visual guide portions 122 and 124 may extend about a maximum length 405 between the front and rear portions 150 and 160. In another example, each of the first and second visual guide portions 122 and 124 may extend less than 50% of the maximum length 405 between the front and rear portions 150 and 160. In yet another example, each of the first and second visual guide portions 122 and 124 may extend between 50% and 100% of the maximum length 405 between the front and rear portions 150 and 160. The apparatus, methods, and articles of manufacture described herein are not limited in this regard.

Each of the first and second visual guide portions 122 and 124, respectively, may be dotted lines formed by two or more weight portions, generally shown as a first set of weight portions 420 (e.g., shown as weight portions 421, 422, 423, 424, and 425) and a second set of weight portions 440 (e.g., shown as weight portions 441, 442, 443, 444, and 445). In a similar manner, the third visual guide portion 126 may be a dotted line formed by two or more weight portions, generally shown as a third set of weight portions 460 (e.g., shown as weight portions 461, 462, 463, 464, 465, 466, 467, and 468). The first, second, and third sets of weight portions 420, 440, and 460, respectively, may be partially or entirely made of a high-density material such as a tungsten-based material or suitable types of materials. Alternatively, the first, second, and third sets of weight portions 420, 440, and 460, respectively, may be partially or entirely made of any metal material or non-metal material (e.g., composite, plastic, etc.). The apparatus, methods, and articles of manufacture described herein are not limited in this regard.

Figure 10:
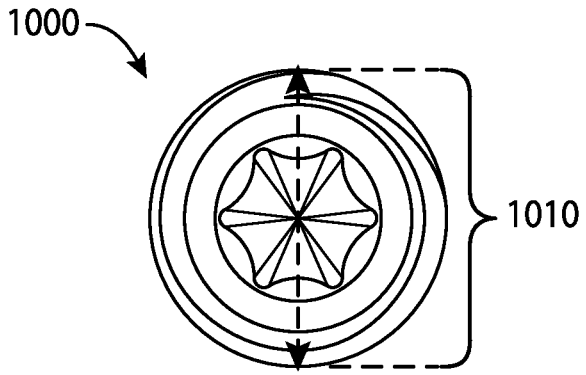
FIG. 10 depicts a top view of a weight portion associated with the example golf club head of FIG. 1.
Figure 11:
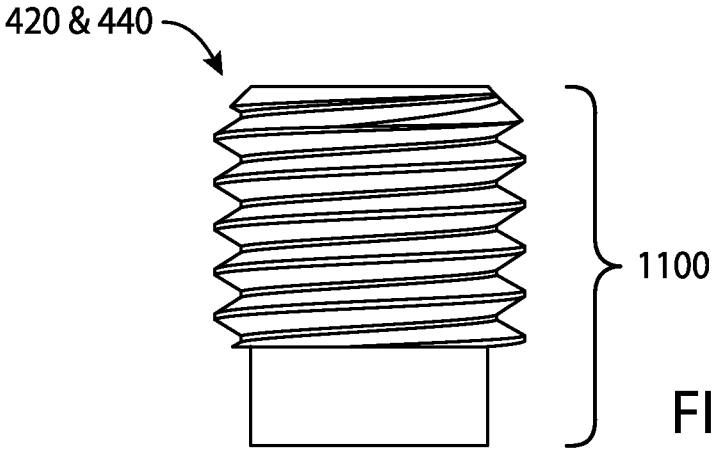
FIG. 11 depicts a side view of a weight portion associated with the example golf club head of FIG. 1.
Figure 12:
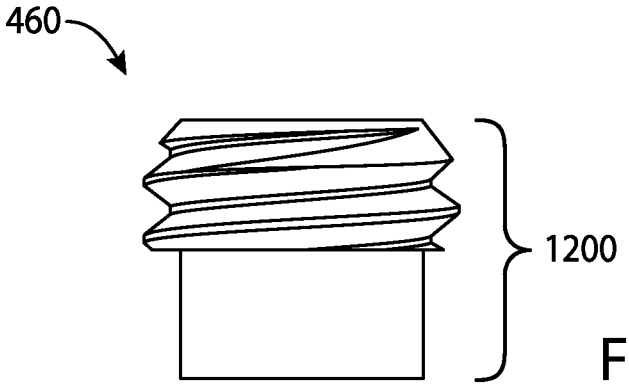
FIG. 12 depicts a side view of another weight portion associated with the example golf club head of FIG. 1.
Figure 13:
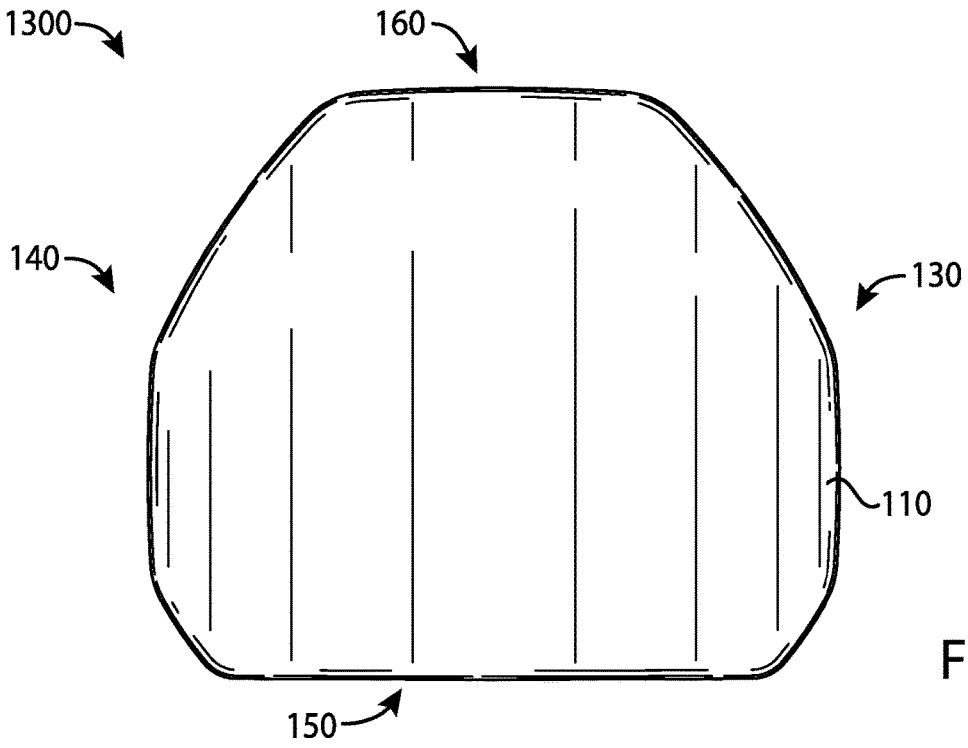
FIG. 13 depicts a bottom view of another example body portion of FIG. 1.

The first, second, and third sets of weight portions 420, 440, and 460, respectively, may have similar or different physical properties (e.g., density, shape, mass, volume, size, color, etc.). In the illustrated example as shown in FIGS. 10-12, each of the weight portions of the first, second, and third sets of weight portions 420, 440, and 460 may have a cylindrical shape (e.g., a circular cross section). Alternatively, each of the weight portions of the first and second sets of weight portions 420 and 440 may have a first shape (e.g., a cylindrical shape) whereas each of the weight portions of the third set of weight portions 460 may have a second shape (e.g., a rectangular shape). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

Further, each of the weight portions of the first, second, and third sets of weight portions 420, 440, and 460, respectively, may have a diameter 1010 (FIG. 10) of about 0.25 inch (6.35 millimeters) but the first, second, and third sets of weight portions 420, 440, and 460, respectively, may be different in height. In particular, each of the weight portions of the first and second sets of weight portions 420 and 440 may be associated with a first height 1100 (FIG. 11), and each of the weight portions of the third set of weight portions 460 may be associated with a second height 1200 (FIG. 12). The first height 1100 may be relatively longer than the second height 1200. In one example, the first height 1100 may be about 0.3 inch (7.62 millimeters) whereas the second height 1200 may be about 0.16 inch (4.06 millimeters). Alternatively, the first height 1100 may be equal to or less than the second height 1200. The apparatus, methods, and articles of manufacture described herein are not limited in this regard.

The first and second sets of weight portions 420 and 440, respectively, may include threads to secure in the weight ports. For example, each weight portion of the first and second sets of weight portions 420 and 440 may be a screw. The first and second sets of weight portions 420 and 440, respectively, may not be readily removable from the body portion 110 with or without a tool. Alternatively, the first and second sets of weight portions 420 and 440, respectively, may be readily removable (e.g., with a tool) so that a relatively heavier or lighter weight portion may replace one or more of the weight portions of the first and second sets 420 and 440, respectively. In another example, the first and second sets of weight portions 420 and 440, respectively, may be secured in the weight ports of the body portion 110 with epoxy or adhesive so that the first and second sets of weight portions 420 and 440, respectively, may not be readily removable. In yet another example, the first and second sets of weight portions 420 and 440, respectively, may be secured in the weight ports of the body portion 110 with both epoxy and threads so that the first and second sets of weight portions 420 and 440, respectively, may not be readily removable. The apparatus, methods, and articles of manufacture described herein are not limited in this regard.

Figure 4:
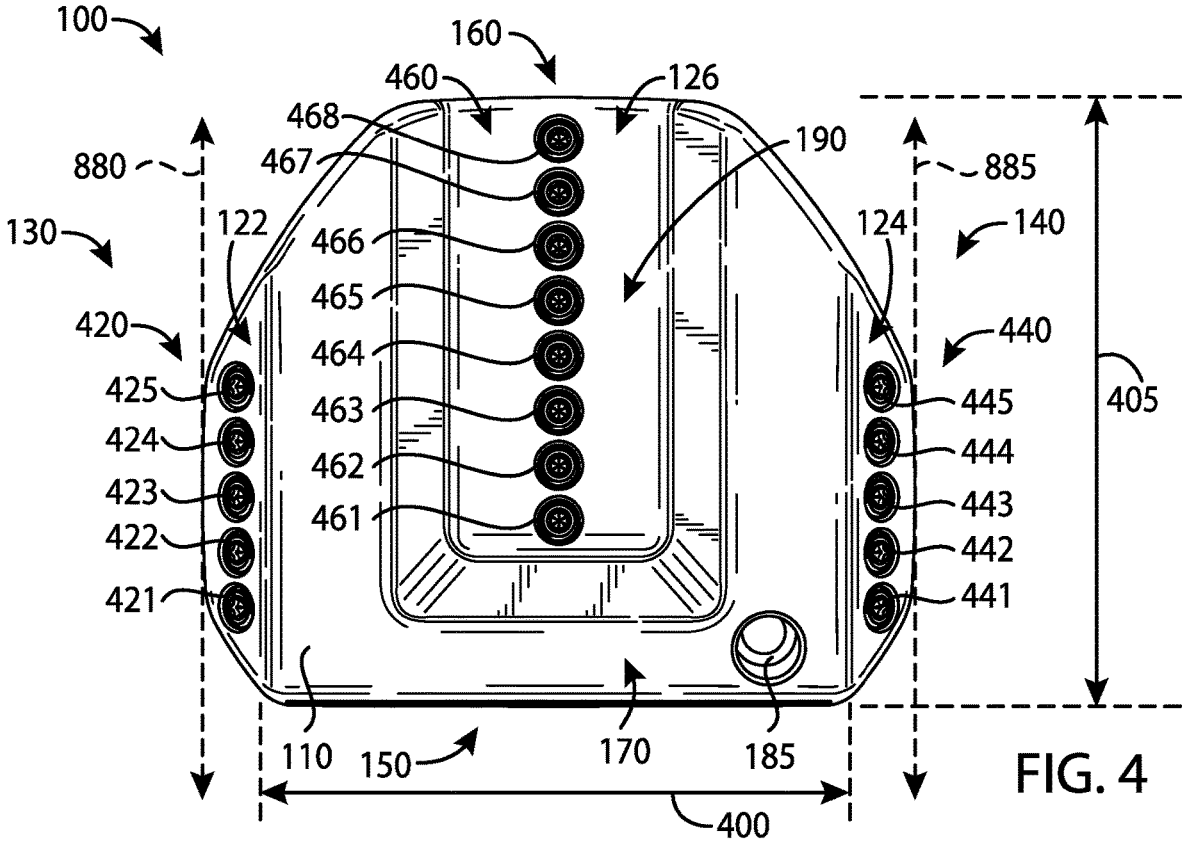
FIG. 4 depicts a top view of the example golf club head of FIG. 1.
Figure 5:
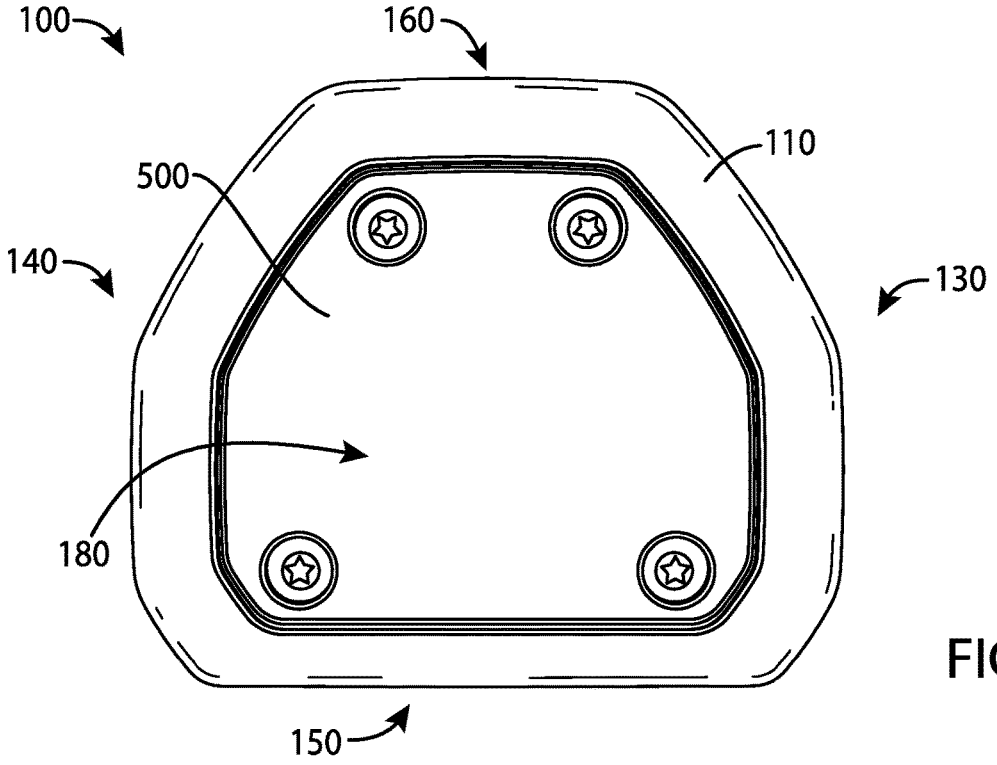
FIG. 5 depicts a bottom view of the example golf club head of FIG. 1.
Figure 6:
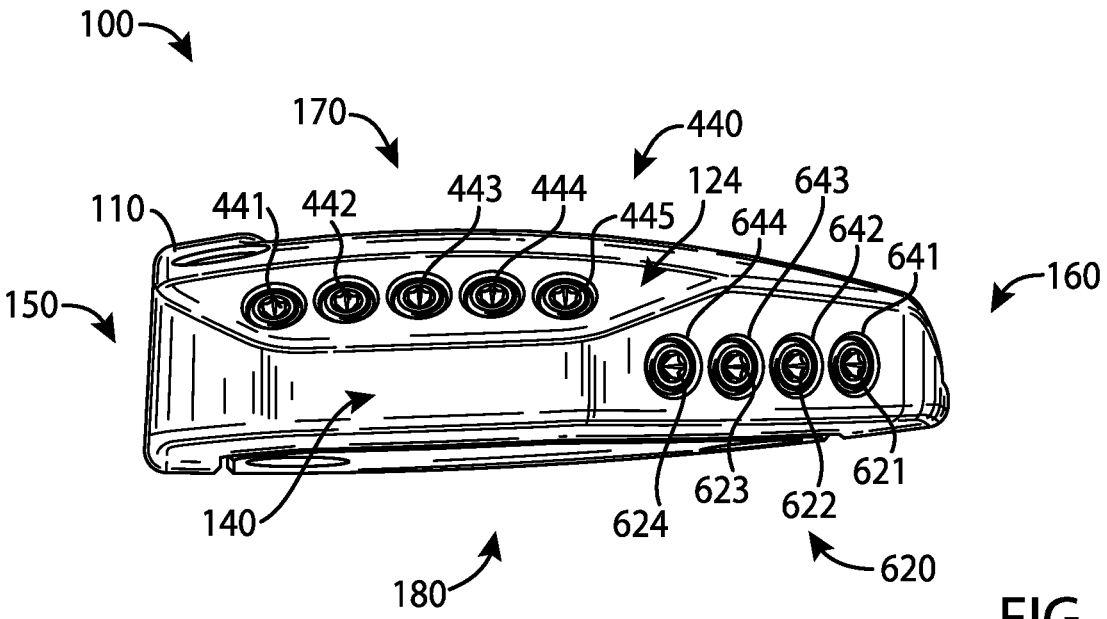
FIG. 6 depicts a left view of the example golf club head of FIG. 1.
Figure 7:
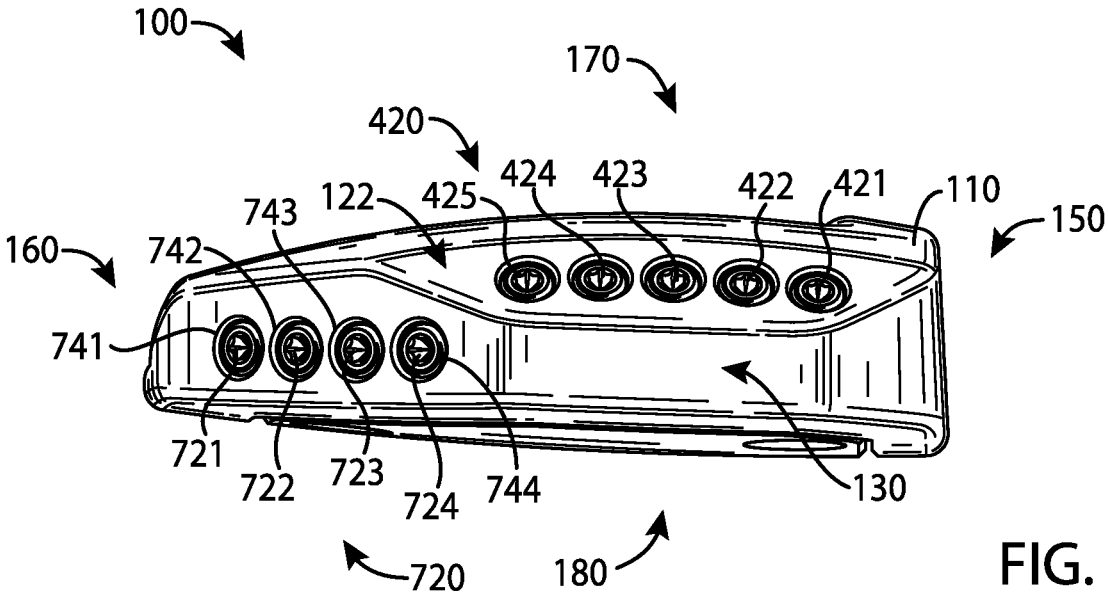
FIG. 7 depicts a right view of the example golf club head of FIG. 1.

As illustrated in FIGS. 6 and 7, the golf club head 100 may also include a fourth set of weight portions 620 (e.g., shown as weight portions 621, 622, 623, and 624) and a fifth set of weight portions 720 (e.g., shown as weight portions 721, 722, 723, and 724). Although both the fourth and fifth sets of weight portions 620 and 720 may be located at or proximate to the rear portion 160, the fourth set of weight portions 620 may be located at or proximate to the heel portion 140 whereas the fifth set of weight portions 720 may be at or proximate to the toe portion 130. Each of the fourth and fifth sets of weight portions 620 and 720 may include at least three weight portions. Each weight portion of the fourth and fifth sets of weight portions 620 and 720 may be coupled (e.g., via threads) to a corresponding weight port (e.g., shown as weight ports 641, 642, 643, 644, 741, 742, 743, and 744) on the periphery of the body portion 110. The corresponding weight ports may be spaced apart and have port diameters similar or different to any one or more of the first, second, and third port diameters 850, 855, and 870 associated with the first, second, and third sets of weight ports 820, 840, and 860. In one example, as shown in FIG. 4, the fourth and fifth sets of weight portions 620 and 720 and the corresponding weight ports may not be visible when the club head 100 is directly viewed from the top. The apparatus, methods, and articles of manufacture described herein are not limited in this regard.

Figure 14:
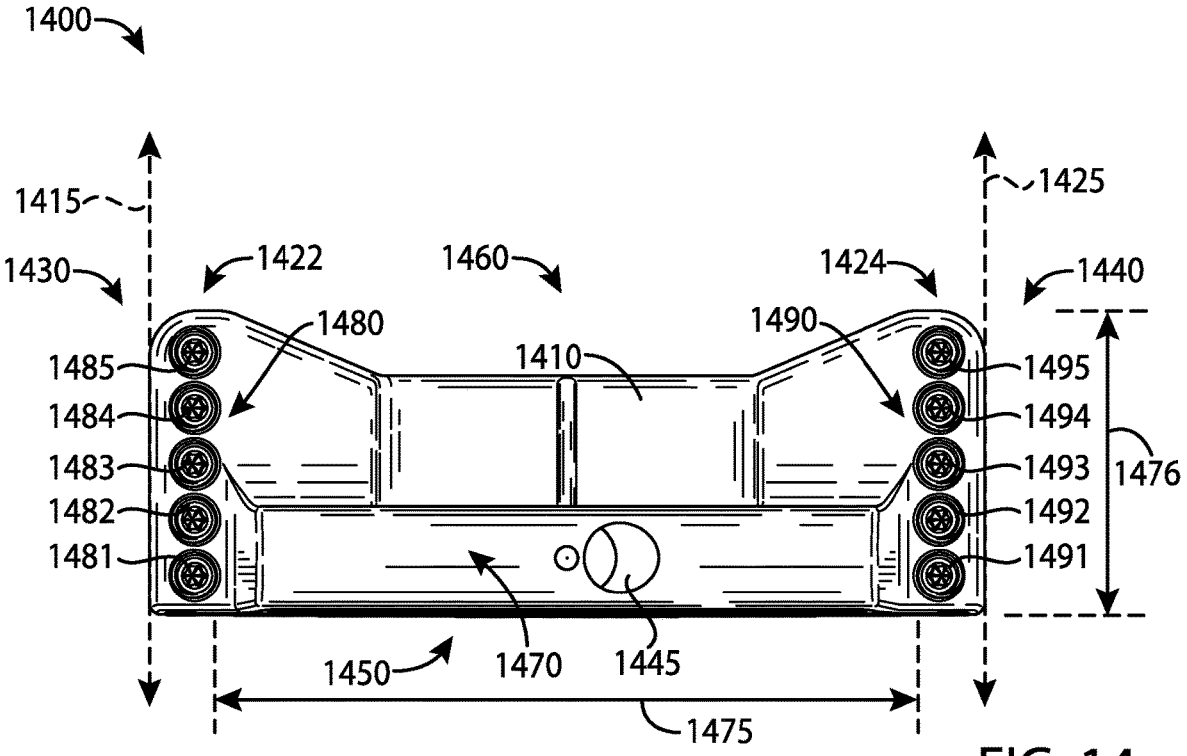
FIG. 14 depicts a top view of a golf club head according to another example of the apparatus, methods, and articles of manufacture described herein.

Although the above examples may describe a particular number of visual guide portions, weight ports, and weight portions, the apparatus, methods, and articles of manufacture described herein may include more or less visual guide portions, weight ports, and/or weight portions. While the golf club head 100 illustrated in FIGS. 1-9 may depict a particular type of putter club head (e.g., a mallet-type putter club head), the apparatus, methods, and articles of manufacture described herein may be applicable to other types of putters. For example, as illustrated in FIG. 14, the apparatus, methods, and articles of manufacture described herein may be applicable to a blade-type putter golf club head 1400. The golf club head 1400 may include a body portion 1410, and a visual guide portion, generally shown as a first visual guide portion 1422 and a second visual guide portion 1424. The body portion 1410 may include a toe portion 1430, a heel portion 1440, a front portion 1450, a rear portion 1460, a sole portion (not shown), and a top portion 1470. The body portion 1410 may also include a bore 1445 to receive a shaft (not shown). Alternatively, the body portion 1410 may include a hosel (not shown) to receive a shaft. The body portion 1410 may be partially or entirely made of a steel-based material (e.g., 17-4 PH stainless steel), a titanium-based material, an aluminum-based material (e.g., a high-strength aluminum alloy or a composite aluminum alloy coated with a high-strength alloy), a tungsten-based material, any combination thereof, and/or other suitable types of materials. Alternatively, the body portion 1410 may be partially or entirely made of a non-metal material (e.g., composite, plastic, etc.). The apparatus, methods, and articles of manufacture described herein are not limited in this regard.

The first and second visual guide portions 1422 and 1424, respectively, may be located a particular distance from a first vertical plane 1415 and a second vertical plane 1425, respectively. For example, the first visual guide portion 1422 may be located less than one inch (25.4 millimeters) from the first vertical plane 1415 and the visual guide portion 1424 may be located less than one inch (25.4 millimeters) from the second vertical plane 1425. Further, a distance 1475 may separate the first and second visual guide portions 1422 and 1424, which may be greater than a diameter of a golf ball. In one example, the distance 1475 may be greater than three inches (76.2 millimeters). In another example, the distance 1475 may be about 3.75 inches (95.25 millimeters).

The first and second visual guide portions 1422 and 1424 may be located relative to a periphery of the golf club head 1400. In one example, the first visual guide portion 1422 may be located less than 0.5 inch (12.7 millimeters) from the periphery at or proximate to the toe portion 1430 whereas the second visual guide portion 1424 may be located less than 0.5 inch (12.7 millimeters) from the periphery at or proximate to the heel portion 1440. In one example, each of the first and second visual guide portions 1422 and 1424 may extend about a maximum length 1476 between the front and rear portions 1450 and 1460. In another example, each of the first and second visual guide portions 1422 and 1424 may extend less than 50% of the maximum length 1476 between the front and rear portions 1450 and 1460. In yet another example, each of the first and second visual guide portions 1422 and 1424 may extend between 50% and 100% of the maximum length 1476 between the front and rear portions 1450 and 1460. The apparatus, methods, and articles of manufacture described herein are not limited in this regard.

Each of the first and second visual guide portions 1422 and 1424, respectively, may be dotted lines formed by two or more weight portions, generally shown as a first set of weight portions 1480 (e.g., shown as weight portions 1481, 1482, 1483, 1484, and 1485) and a second set of weight portions 1490 (e.g., shown as weight portions 1491, 1492, 1493, 1494, and 1495). The first and second sets of weight portions 1480 and 1490, respectively, may be partially or entirely made of a high-density material such as a tungsten-based material or suitable types of materials. Alternatively, the first and second sets of weight portions 1480 and 1490, respectively, may be partially or entirely made of a non-metal material (e.g., composite, plastic, etc.). The apparatus, methods, and articles of manufacture described herein are not limited in this regard.

The first and second sets of weight portions 1480 and 1490, respectively, may have similar or different physical properties (e.g., density, shape, mass, volume, size, color, etc.). In the illustrated example as shown in FIGS. 10-12, each of the weight portions of the first and second sets of weight portions 1480 and 1490 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). The apparatus, methods, and articles of manufacture described herein are not limited in this regard.

The first and second sets of weight portions 1480 and 1490, respectively, may include threads to secure in the weight ports, which may also have corresponding threads. For example, each weight portion of the first and second sets of weight portions 1480 and 1490 may be a screw. The first and second sets of weight portions 1480 and 1490, respectively, may not be readily removable from the body portion 1410 with or without a tool. Alternatively, the first and second sets of weight portions 1480 and 1490, respectively, may be readily removable (e.g., with a tool) so that a relatively heavier or lighter weight portion may replace one or more of the weight portions of the first and second sets of weight portions 1480 and 1490, respectively. In another example, the first and second sets of weight portions 1480 and 1490, respectively, may be secured in the weight ports of the body portion 1410 with epoxy or adhesive so that the first and second sets of weight portions 1480 and 1490, respectively, may not be readily removable. In yet another example, the first and second sets of weight portions 1480 and 1490, respectively, may be secured in the weight ports of the body portion 1410 with both epoxy and threads so that the first and second sets of weight portions 1480 and 1490, respectively, may not be readily removable. The apparatus, methods, and articles of manufacture described herein are not limited in this regard.

Figure 15:
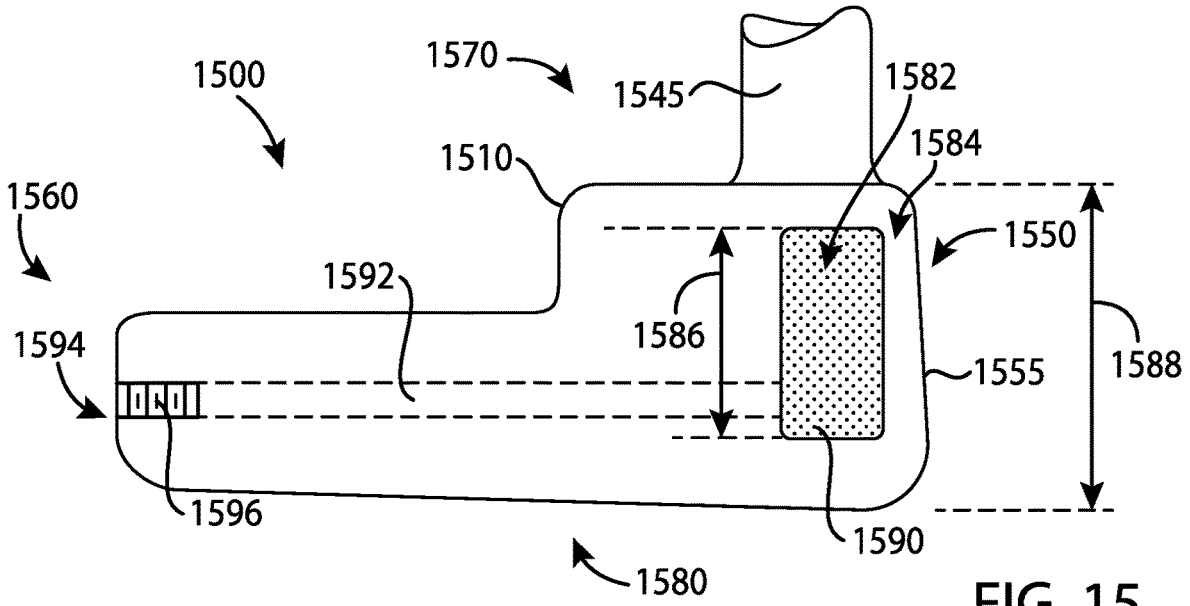
FIG. 15 depicts a schematic cross-sectional view of a golf club head according to yet another example of the apparatus, methods and articles of manufacture described herein.
Figure 16:
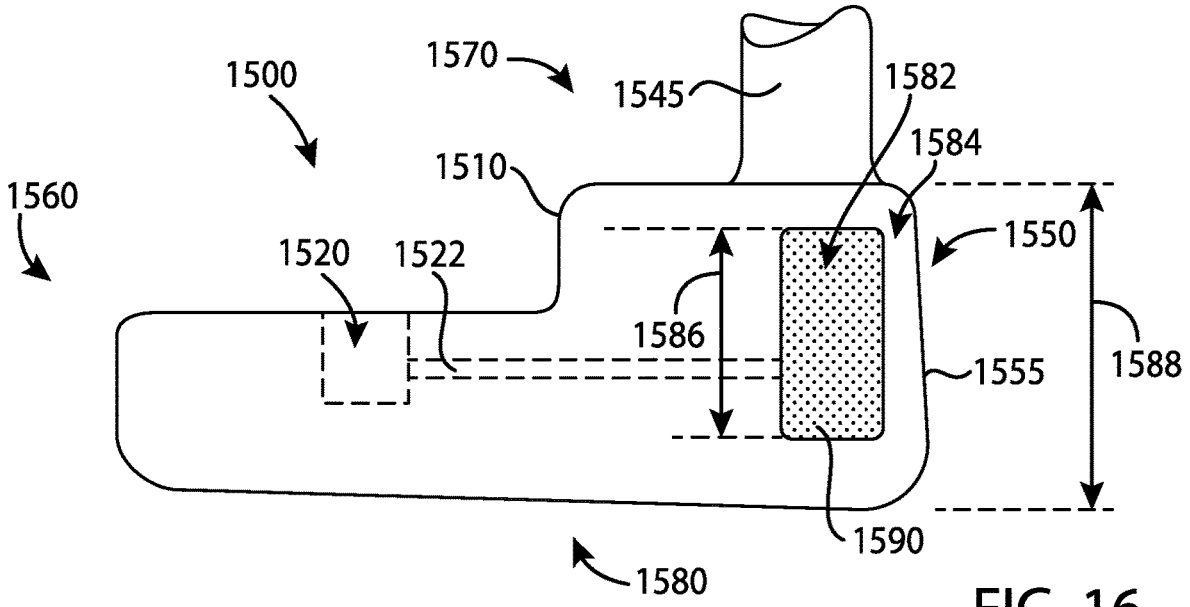
FIG. 16 depicts a schematic cross-sectional view of another example of the golf club head of FIG. 15.

In the example of FIGS. 15 and 16, a golf club head 1500 may include a body portion 1510. The body portion 1510 may include a toe portion (not shown), a heel portion (not shown), a front portion 1550, a rear portion 1560, a top portion 1570, and a sole portion 1580. The body portion 1510 may be manufactured via various manufacturing methods and/or processes (e.g., a casting process, a forging process, a milling process, a cutting process, a grinding process, a welding process, a combination thereof, etc.). The body portion 1510 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1510 may be partially or entirely made of non-metal material (e.g., composite, plastic, etc.). The golf club head 1500 may be a putter-type golf club head (e.g., a blade-type putter, a mid-mallet-type putter, a mallet-type putter, etc.). Based on the type of putter as mentioned above, the body portion 1510 may be at least 200 grams. For example, the body portion 1510 may be in a range between 300 to 600 grams. Although FIGS. 15 and 16 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1510 may include a hosel portion 1545 configured to receive a shaft (not shown) with a grip (not shown). The golf club head 1500 and the grip may be located on opposite ends of the shaft to form a golf club. The front and rear portions 1550 and 1560, respectively, may be on opposite ends of the body portion 1510. The front portion 1550 may include a face portion 1555 (e.g., a strike face). The face portion 1555 may be used to impact a golf ball. The face portion 1555 may be an integral portion of the body portion 1510. Alternatively, the face portion 1555 may be a separate piece or an insert coupled to the body portion 1510 via various manufacturing methods and/or processes (e.g., a bonding process, a welding process, a brazing process, a mechanical locking method, a mechanical fastening method, any combination thereof, or other suitable types of manufacturing methods and/or processes). The face portion 1555 may be associated with a loft plane that defines the loft angle of the golf club head 1500. The apparatus, methods, and articles of manufacture described herein are not limited in this regard.

The body portion 1510 may include one or more weight ports and one or more weight portions similar to any of the golf club heads described herein. For example, a weight port 1520 is shown in FIG. 16. For example, the body portion 1510 may include a first set of weight ports (not shown) similar to the first set of weight ports 820 of the golf club head 100 and a second set of weight ports (not shown) similar to the second set of weight ports 840 of the golf club head 100 that are configured to receive a plurality of weight portions. Accordingly, a detailed description of the weight ports and weight portions of the golf club head 1500 is not described. Alternatively, the body portion 1510 may not include any weight ports and/or weight portions.

The body portion 1510 may be a hollow body including an interior cavity 1582 extending between the front portion 1550 and the rear portion 1560. Further, the interior cavity 1582 may extend between the top portion 1570 and the sole portion 1580. A cavity wall portion 1584 may separate the interior cavity 1582 and the face portion 1555. The interior cavity 1582 may be associated with a cavity height 1586 ($H_C$) and the body portion 1510 may be associated with a body height 1588 ($H_B$). While the cavity height 1586 and the body height 1588 may vary between the toe and heel portions, the cavity height 1586 may be at least 50% of the body height 1588 ($H_C>0.5*H_B$). For example, the cavity height 1586 may vary between 70% and 85% of the body height 1588. With the cavity height 1586 of the interior cavity 1582 being greater than 50% of the body height 1588, the golf club head 1500 may produce relatively more consistent feel, sound, and/or result when the golf club head 1500 strikes a golf ball via the face portion 1555 than a golf club head with a cavity height of less than 50% of the body height. However, the cavity height 1586 may be less than 50% of the body height 1588. The apparatus, methods, and articles of manufacture described herein are not limited in this regard.

In one example, the interior cavity 1582 may be unfilled (i.e., empty space). Alternatively, the interior cavity 1582 may be partially or entirely filled with a filler material (e.g., generally shown as 1590). The filler material 1590 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1582 may be filled with a TPE material to absorb shock, isolate vibration, and/or dampen noise when the golf club head 1500 strikes a golf ball via the face portion 1555. The apparatus, methods, and articles of manufacture described herein are not limited in this regard.

In another example, the filler material 1590 may be a polymer material such as an ethylene copolymer material to absorb shock, isolate vibration, and/or dampen noise when the golf club head 1500 strikes a golf ball via the face portion 1555. In particular, at least 50% of the interior cavity 1582 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material 1590 may be injected into the interior cavity 1582 by an injection molding process via a port 1592 on the body portion 1510 as shown in FIG. 15. The port 1592 may have an opening 1594 on the body portion 1510 to allow injection of the filler material into the interior cavity 1582 through the port 1592. The port 1592 may have a plug 1596, by which the opening 1594 may be closed after injection of the filler material 1590 into the interior cavity 1582. Alternatively, as shown in the example of FIG. 16, at least one of the weight ports (e.g., 1520) on the body portion 1510 may be connected to the interior cavity 1582 through a connection port 1522 that may be similar to the port 1592. Accordingly, the filler material may be injected into the interior cavity 1582 from the at least one weight port (e.g., 1520) through the connection port 1522. The apparatus, methods, and articles of manufacture described herein are not limited in this regard.

For example, at least 50% of the interior cavity 1582 may be filled with a TPE material to absorb shock, isolate vibration, dampen noise, and/or provide structural support when the golf club head 1500 strikes a golf ball via the face portion 1555. With the support of the cavity wall portion 1584 and filling at least a portion of the interior cavity 1582 with an elastic polymer material, the face portion 1555 may be relatively thin without degrading the structural integrity, sound, and/or feel of the golf club head 1500. In one example, the face portion 1555 may have a thickness of less than or equal to 0.075 inch or 1.905 millimeters (e.g., the thickness of the cavity wall portion 1584). In another example, the face portion 1555 may have a thickness of less than or equal to 0.060 inch (1.524 millimeters). In yet another example, the face portion 1555 may have a thickness of less than or equal to 0.050 inch (1.270 millimeters). Further, the face portion 1555 may have a thickness of less than or equal to 0.030 inch (0.762 millimeters). The apparatus, methods, and articles of manufacture described herein are not limited in this regard.

Figure 17:
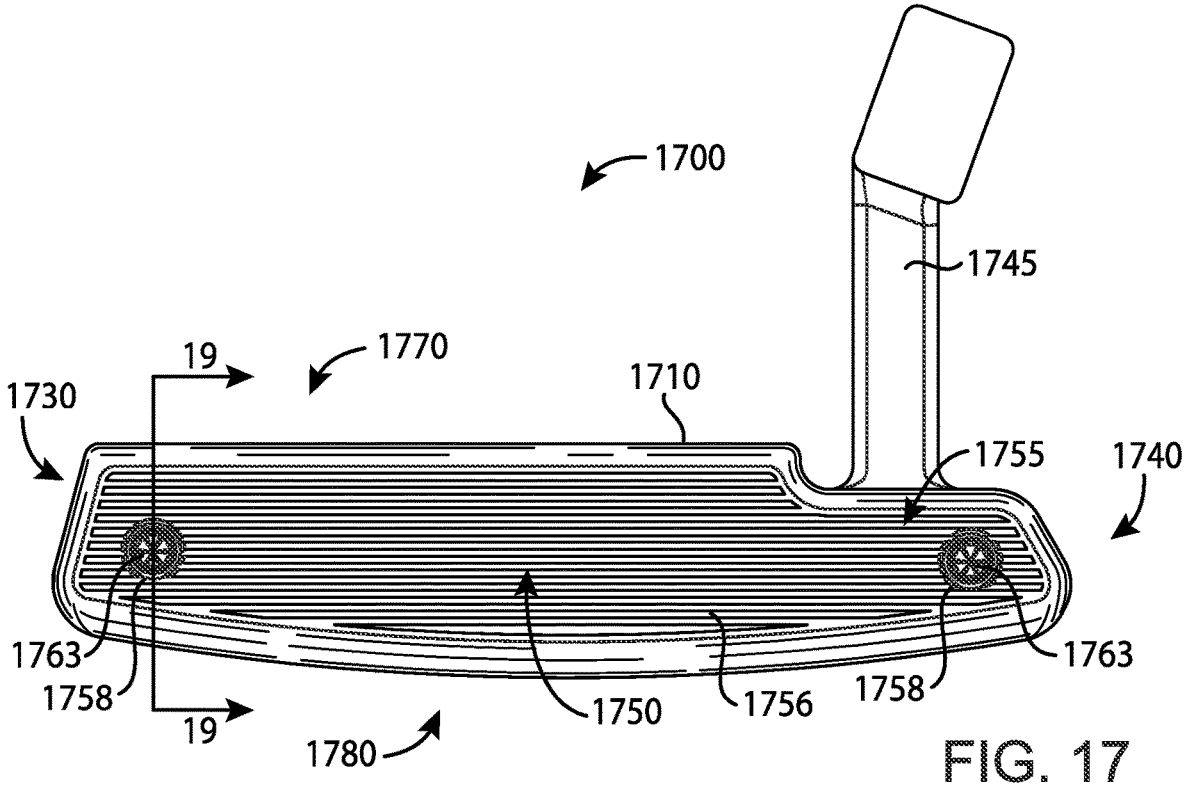
FIG. 17 depicts a front view of a golf club head according to yet another example of the apparatus, methods, and articles of manufacture described herein.
Figure 18:
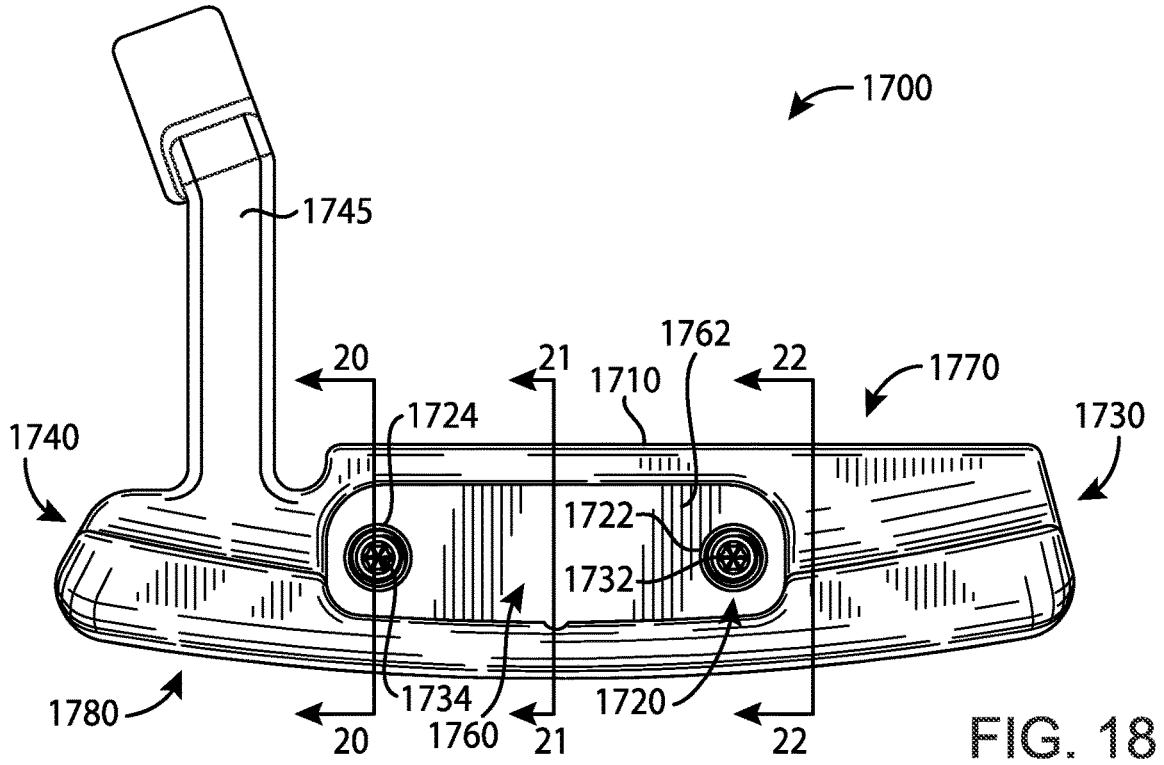
FIG. 18 depicts a rear view of the golf club head of FIG. 17.
Figure 19:
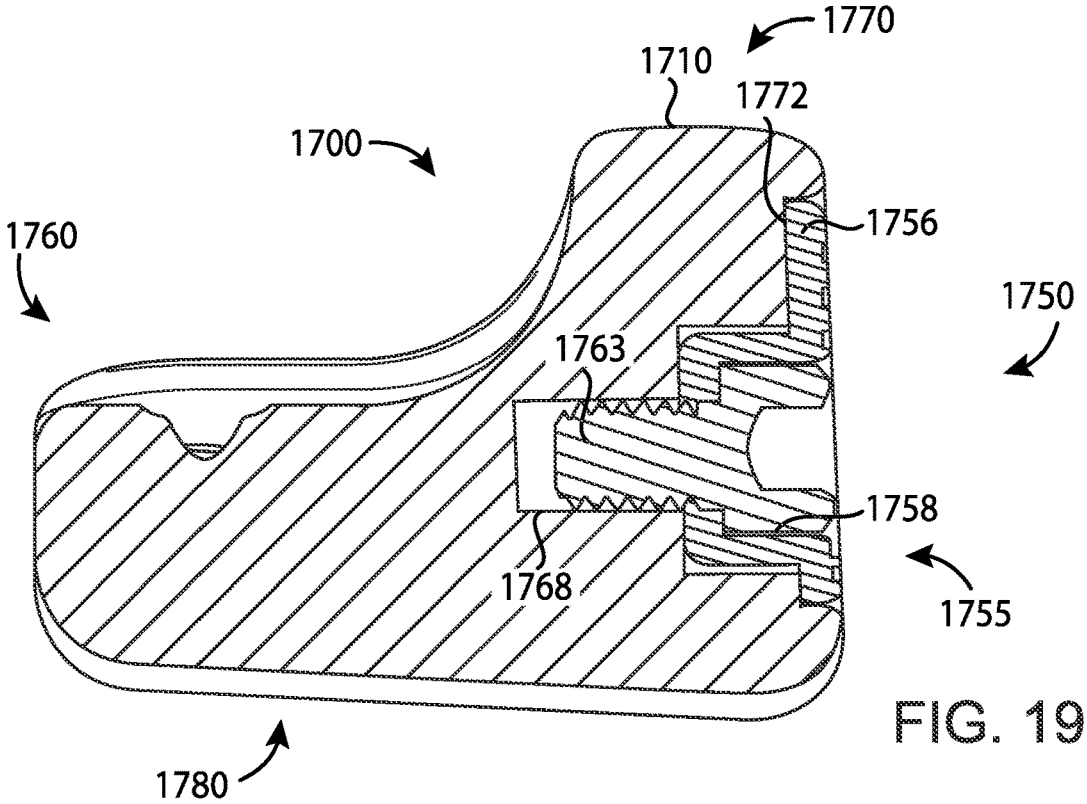
FIG. 19 depicts a cross-sectional view of the golf club head of FIG. 17 at lines 19-19 of FIG. 17.

In the example of FIGS. 17 and 18, a golf club head 1700 may include a body portion 1710. The body portion 1710 may include a toe portion 1730, a heel portion 1740, a front portion 1750, a rear portion 1760, a top portion 1770, and a sole portion 1780. The body portion 1710 may be manufactured via various manufacturing methods and/or processes (e.g., a casting process, a forging process, a milling process, a cutting process, a grinding process, a welding process, a combination thereof, etc.). The body portion 1710 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 1710 may be partially or entirely made of non-metal material (e.g., composite, plastic, etc.). The golf club head 1700 may be a putter-type golf club head (e.g., a blade-type putter, a mid-mallet-type putter, a mallet-type putter, etc.). Based on the type of putter as mentioned above, the body portion 1710 may be at least 200 grams. For example, the body portion 1710 may be in a range between 300 to 600 grams. Although FIGS. 17 and 18 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 1710 may include a hosel portion 1745 configured to receive a shaft (not shown) with a grip (not shown). The golf club head 1700 and the grip may be located on opposite ends of the shaft to form a golf club. The front and rear portions 1750 and 1760, respectively, may be on opposite ends of the body portion 1710. The front portion 1750 may include a face portion 1755 (e.g., a strike face). The face portion 1755 may be used to impact a golf ball. The face portion 1755 may be associated with a loft plane that defines the loft angle of the golf club head 1700. The apparatus, methods, and articles of manufacture described herein are not limited in this regard.

The body portion 1710 may include one or more weight ports and one or more weight portions similar to any of the golf club heads described herein. For example, the body portion 1710 may include a first set of weight ports 1720 at or proximate the rear portion 1760. In the examples of FIGS. 17-22, the rear portion 1760 may include a back wall portion 1762 having a first weight port 1722 of the first set of weight ports 1720 and a second weight port 1724 of the first set of weight ports 1720. The first weight port 1722 may be closer to the toe portion 1730 than the second weight port 1724. The second weight port 1724 may be closer to the heel portion 1740 than the first weight port 1722. The first and second weight ports 1722 and 1724, respectively, may be at any location on the back wall portion 1762 or the rear portion 1760. Alternatively, the body portion 1710 may not include any weight ports on the back wall portion 1762. The apparatus, methods, and articles of manufacture described herein are not limited in this regard.

Figure 20:
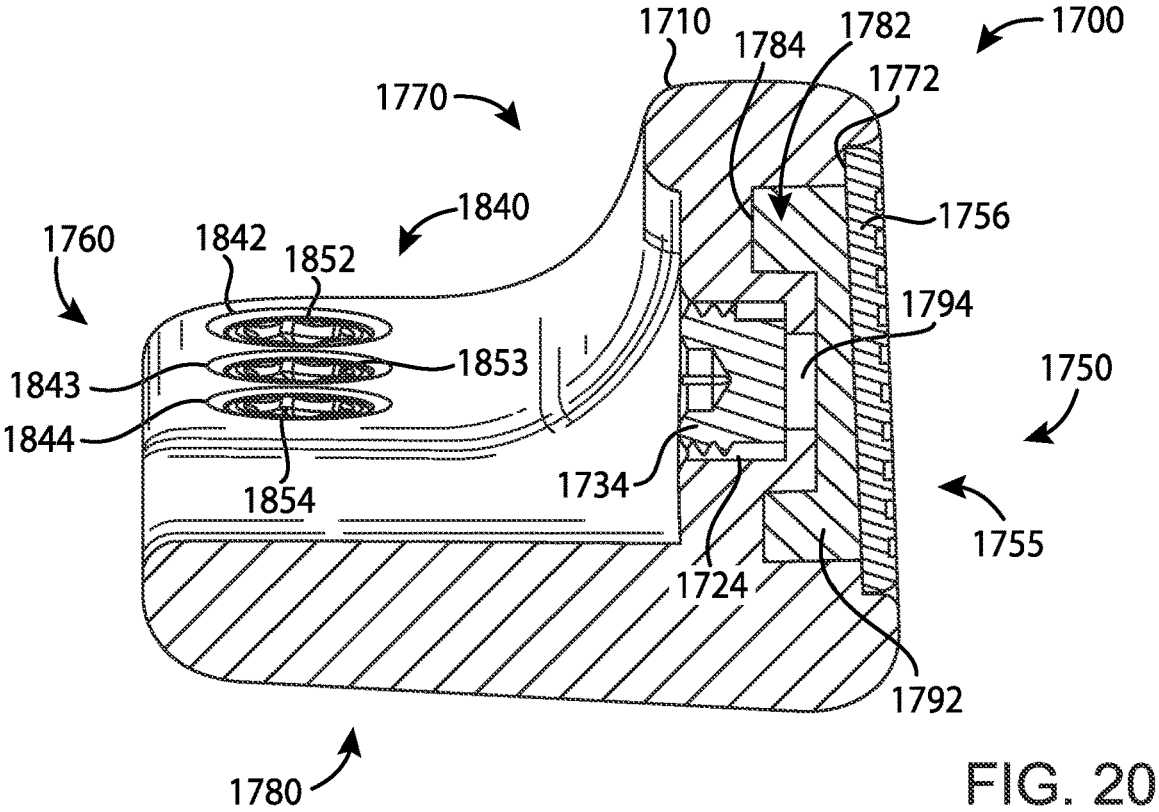
FIG. 20 depicts a cross-sectional view of the golf club head of FIG. 17 at lines 20-20 of FIG. 18.

In the example of FIGS. 17-22, the body portion 1710 may include a second set of weight ports 1840 as shown in FIG. 20 proximate to the heel portion 1740 and extending between the toe portion 1730 and the heel portion 1740. The second set of weight ports 1840 may include any number of weight ports, such as three weight ports as shown in FIG. 20 as weight ports 1842, 1843, and 1844. The body portion 1710 may include a third set of weight ports 1860 that may be located near the toe portion 1730 and extend between the toe portion 1730 and the heel portion 1740. The third set of weight ports 1860 may include any number of weight ports, such as three weight ports similar to the weight ports of the second set of weight ports 1840. The second and third sets of weight ports 1840 and 1860, respectively, may be similar to each other and symmetrically arranged relative to a midpoint of the body portion 1710. The apparatus, methods, and articles of manufacture described herein are not limited in this regard.

Figure 22:
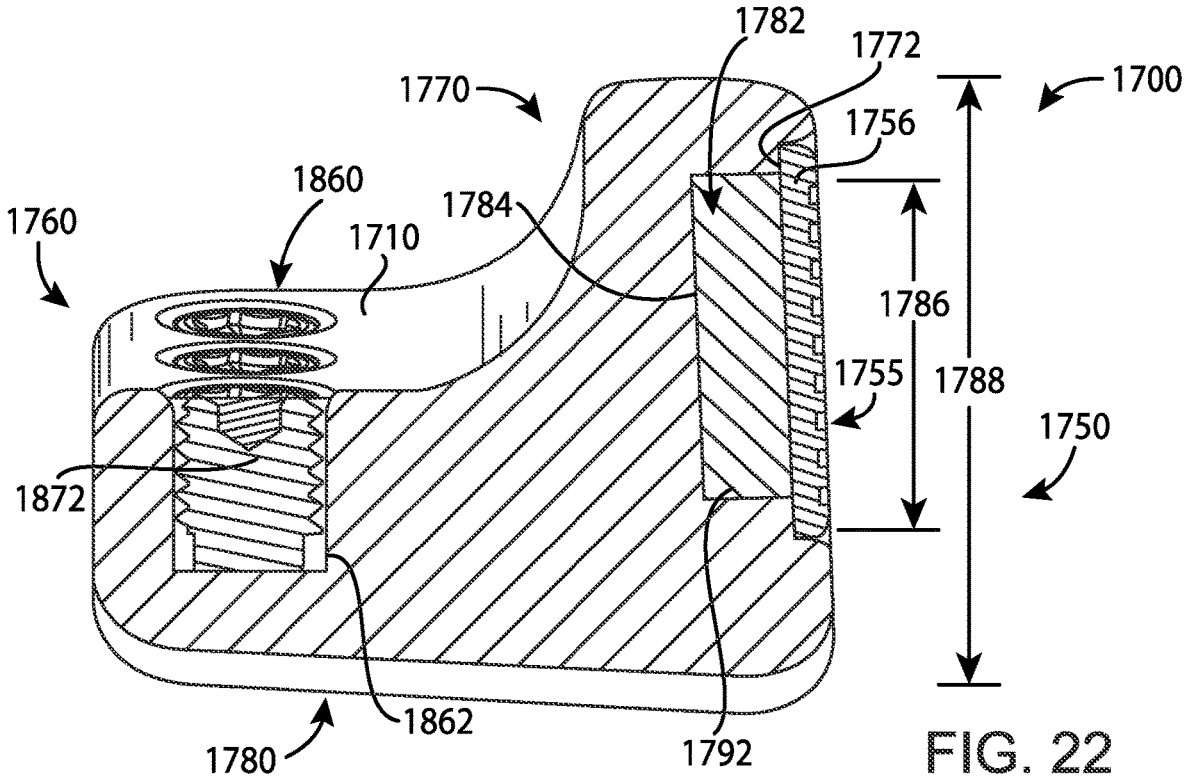
FIG. 22 depicts a cross-sectional view of the golf club head of FIG. 17 at lines 22-22 of FIG. 18.

The golf club head 1700 may include a plurality of weight portions. Each weight port of the first, second, and third sets of weight ports 1720, 1840, and 1860 may be configured to receive a weight portion. For example, the first and second weight ports 1722 and 1724 of the first set of weight ports 1720 may receive weight portions 1732 and 1734, respectively. The weight ports 1842, 1843, and 1844 of the second set of weight ports 1840 may receive weight portions 1852, 1853, and 1854, respectively. The weight ports of the third set of weight ports 1860 may receive weight portions similar to the second set of weight ports 1840. In the example of FIG. 22, a weight port 1862 of the third set of weight ports 1860 is shown to have received a weight portion 1872. The configurations of the weight ports and the weight portions (e.g., inner diameter, outer diameter, size, shape, distance from an adjacent weight port or weight portion, etc.) of the golf club head 1700 may be similar in many respects to the weight ports and weight portions of any of the golf club heads descried herein. Accordingly, a detailed description of the weight ports and weight portions of the golf club head 1700 is not described. Alternatively, the body portion 1710 may not include any weight ports and/or weight portions. The apparatus, methods, and articles of manufacture described herein are not limited in this regard.

In the example of FIGS. 17-22, the face portion 1755 may include a separate piece or an insert coupled to the body portion 1710. The face portion 1755 may include a face insert 1756, which may be attached to the front portion 1750 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 17 and 19, the face insert 1756 may include two fastener holes 1758 proximate to the toe portion and heel portion of the face insert 1756. Each of the fastener holes 1758 may be configured to receive a fastener 1763 for attachment of the face insert 1756 to the body portion 1710. The body portion 1710 may include two fastener ports 1768 (one fastener port 1768 shown in FIG. 19) configured to receive the fasteners 1763. Each fastener port 1768 may have internal threads that are configured to engage external threads on the fasteners 1763. The apparatus, methods, and articles of manufacture described herein are not limited in this regard.

The face portion 1755 may include a peripheral recessed portion 1772 configured to receive the face insert 1756. As shown by example in FIGS. 19-22, the depth of the peripheral recessed portion 1772 may be similar to the thickness of the face insert 1756 such that when the face insert 1756 is fastened to the body portion 1710, the face insert 1756 is positioned flush or substantially flush with the face portion 1755. Alternatively, the face insert 1756 may project from the face portion 1755. The apparatus, methods, and articles of manufacture described herein are not limited in this regard.

The fasteners 1763 may have similar or different weights to balance and/or provide heel or toe weight bias for the golf club head 1700. For example, the weight of the body portion 1710 may be increased or decreased by similarly increasing or decreasing, respectively, the weights of the fasteners 1763. In one example, the golf club head 1700 may be provided with a toe-biased weight configuration by having the fastener 1763 that is closer to the toe portion 1730 be heavier than the fastener 1763 that is closer to the heel portion 1740. Conversely, the golf club head 1700 may be provided with a heel-biased weight configuration by having the fastener 1763 that is closer to the heel portion 1740 be heavier than the fastener 1763 that is closer to the toe portion 1730. The apparatus, methods, and articles of manufacture described herein are not limited in this regard.

To attach the face insert 1756 to the body portion 1710, the face insert 1756 may be inserted in the peripheral recessed portion 1772, thereby generally aligning the fastener holes 1758 of the face insert 1756 and the fastener ports 1768 of the body portion 1710. The fasteners 1763 can be inserted through the fastener holes 1758 and screwed into the fastener ports 1768 to securely attach the face insert 1756 to the body portion 1710. The face insert 1756 may be constructed from any material such as metal, metal alloys, plastic, wood, composite materials or a combination thereof to provide a certain ball striking characteristic to the golf club head 1700. The material from which the face insert 1756 is manufactured may affect ball speed and spin characteristics. Accordingly, the face insert 1756 may be selected to provide a certain ball speed and spin characteristics for an individual. Thus, the face insert 1756 may be interchangeable with other face inserts having different ball speed and spin characteristics. The face insert 1756 may be coupled to the body portion 1710 by other methods or devices, such as by bonding, welding, adhesive and/or other types of fastening devices and/or methods. The apparatus, methods, and articles of manufacture described herein are not limited in this regard.

Figure 21:
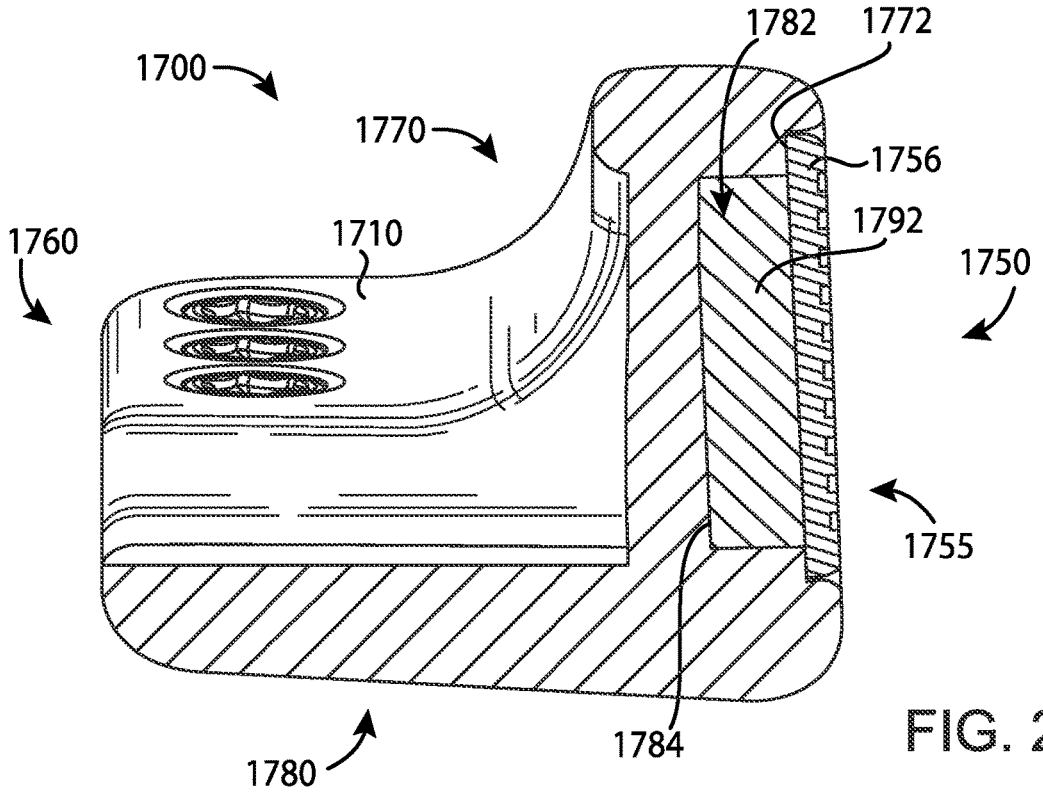
FIG. 21 depicts a cross-sectional view of the golf club head of FIG. 17 at lines 21-21 of FIG. 18.

The body portion 1710 may include an interior cavity 1782 extending between the front portion 1750 and the rear portion 1760 and between the toe portion 1730 and the heel portion 1740. In one example as shown in FIGS. 20-22, the interior cavity 1782 may be defined by a recess 1784 in the front portion 1750 that is covered by the face insert 1756. The recess 1784 may extend from near the toe portion 1730 to near the heel portion 1740 and from near the top portion 1770 to near the sole portion 1780. Alternatively, the recess 1784 may extend between the fastener ports 1768 of the body portion 1710. In one example, the recess 1784 may be located in and/or near the regions of the face portion 1755 that generally strike a golf ball. The apparatus, methods, and articles of manufacture described herein are not limited in this regard.

The interior cavity 1782 may be associated with a cavity height 1786 ($H_C$) and the body portion 1710 may be associated with a body height 1788 ($H_B$). While the cavity height 1786 and the body height 1788 may vary between the toe and heel portions 1730 and 1740, the cavity height 1786 may be at least 50% of a body height 1788 ($H_C>0.5*H_B$). For example, the cavity height 1786 may vary between 70% and 85% of the body height 1788. With the cavity height 1786 of the interior cavity 1782 being greater than 50% of the body height 1788, the golf club head 1700 may produce relatively more consistent feel, sound, and/or result when the golf club head 1700 strikes a golf ball via the face portion 1755 than a golf club head with a cavity height of less than 50% of the body height. However, the cavity height 1786 may be less than 50% of the body height 1788. The apparatus, methods, and articles of manufacture described herein are not limited in this regard.

In one example, the interior cavity 1782 may be unfilled (i.e., empty space). Alternatively, the interior cavity 1782 may be partially or entirely filled with a filler material 1792 to absorb shock, isolate vibration, and/or dampen noise when the face portion 1755 strikes a golf ball. The filler material 1792 may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 1782 may be filled with a TPE material to absorb shock, isolate vibration, and/or dampen noise when the golf club head 1700 strikes a golf ball via the face portion 1755. The apparatus, methods, and articles of manufacture described herein are not limited in this regard.

In another example, the filler material 1792 may be a polymer material such as an ethylene copolymer material to absorb shock, isolate vibration, and/or dampen noise when the golf club head 1700 strikes a golf ball via the face portion 1755. In particular, at least 50% of the interior cavity 1782 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 1782 may be partially or fully filled with the filler material 1792. In one example, the recess 1784 may be filled with the filler material 1792 prior to attaching the face insert 1756 to the face portion 1755. In one example, the interior cavity 1782 may be filled with the filler material 1792 via any one of the first and second weight ports 1722 or 1724 of the first set of weight ports 1720. In one example as shown in FIG. 20, the second weight port 1724 may be connected to the interior cavity 1782 via an opening 1794. Similarly, the first weight port 1722 may be connected to the interior cavity 1782 via an opening (not shown). The filler material 1792 may be injected in the interior cavity 1782 from the second weight port 1724 via the opening 1794. As the filler material 1792 fills the interior cavity 1782, the air inside the interior cavity 1782 that is displaced by the filler material 1792 may exit the interior cavity 1782 from the first weight port 1722 through the opening (not shown) that connects the first weight port 1722 to the interior cavity 1782. Accordingly, the first weight port 1722 may function as an exit port for the displaced air inside the interior cavity 1782. After the interior cavity 1782 is partially or fully filled with the filler material 1792, the first and second weight ports 1722 and 1724 may be closed by inserting and securing weight portions 1732 and 1734, respectively, therein as described in detail herein. Alternatively, the filler material 1792 may be injected in the interior cavity 1782 from the first weight port 1722 while the second weight port 1724 functions as an exit port for the displaced air inside the interior cavity 1782. The apparatus, methods, and articles of manufacture described herein are not limited in this regard.

For example, at least 50% of the interior cavity 1782 may be filled with the filler material 1792 to absorb shock, isolate vibration, dampen noise, and/or provide structural support when the golf club head 1700 strikes a golf ball via the face portion 1755. With the support of the back wall portion 1762 and filling at least a portion of the interior cavity 1782 with the filler material 1792, the face portion 1755 may be relatively thin without degrading the structural integrity, sound, and/or feel of the golf club head 1700. In one example, the face portion 1755 may have a thickness of less than or equal to 0.075 inch (1.905 millimeters). In another example, the face portion 1755 may have a thickness of less than or equal to 0.060 inch (1.524 millimeters). In yet another example, the face portion 1755 may have a thickness of less than or equal to 0.050 inch (1.270 millimeters). Further, the face portion 1755 may have a thickness of less than or equal to 0.030 inch (0.762 millimeters). The apparatus, methods, and articles of manufacture described herein are not limited in this regard.

In one example, the face portion 1755 may be in one-piece with the body portion 1710 or be an integral part of the body portion 1710 (not shown). The body portion 1710 may include an interior cavity near the face portion 1755 that may be similar in many respects to the interior cavity 1782. However, unlike the interior cavity 1782 which may be partially defined by the face insert 1756, an interior cavity of the body portion 1710 having a one-piece face portion 1755 may be an integral part of the body portion 1710. The interior cavity may be partially or fully filled with a filler material 1792 via the first and second weight ports 1722 and/or 1724 as described in detail herein. The apparatus, methods, and articles of manufacture described herein are not limited in this regard.

In the example of FIGS. 23-31, a golf club head 2300 may include a body portion 2310. The body portion 2310 may include a toe portion 2330, a heel portion 2340, a front portion 2350, a rear portion 2360, a top portion 2370, and a sole portion 2380. The body portion 2310 may be manufactured via various manufacturing methods and/or processes (e.g., a casting process, a forging process, a milling process, a cutting process, a grinding process, a welding process, a combination thereof, etc.). The body portion 2310 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. Alternatively, the body portion 2310 may be partially or entirely made of non-metal material (e.g., composite, plastic, etc.). The golf club head 2300 may be a putter-type golf club head (e.g., a blade-type putter, a mid-mallet-type putter, a mallet-type putter, etc.). Based on the type of putter as mentioned above, the body portion 2310 may be at least 200 grams. For example, the body portion 2310 may be in a range between 300 to 600 grams. Although FIGS. 23-31 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

The body portion 2310 may include a hosel portion 2345 configured to receive a shaft (not shown) with a grip (not shown). The golf club head 2300 and the grip may be located on opposite ends of the shaft to form a golf club. Alternatively, the body portion 2310 may include a bore (not shown) for receiving the shaft (not shown). The front and rear portions 2350 and 2360, respectively, may be on opposite ends of the body portion 2310. The front portion 2350 may include a face portion 2355 (e.g., a strike face). The face portion 2355 may be used to impact a golf ball. The face portion 2355 may be associated with a loft plane that defines the loft angle of the golf club head 2300. The apparatus, methods, and articles of manufacture described herein are not limited in this regard.

Figure 23:
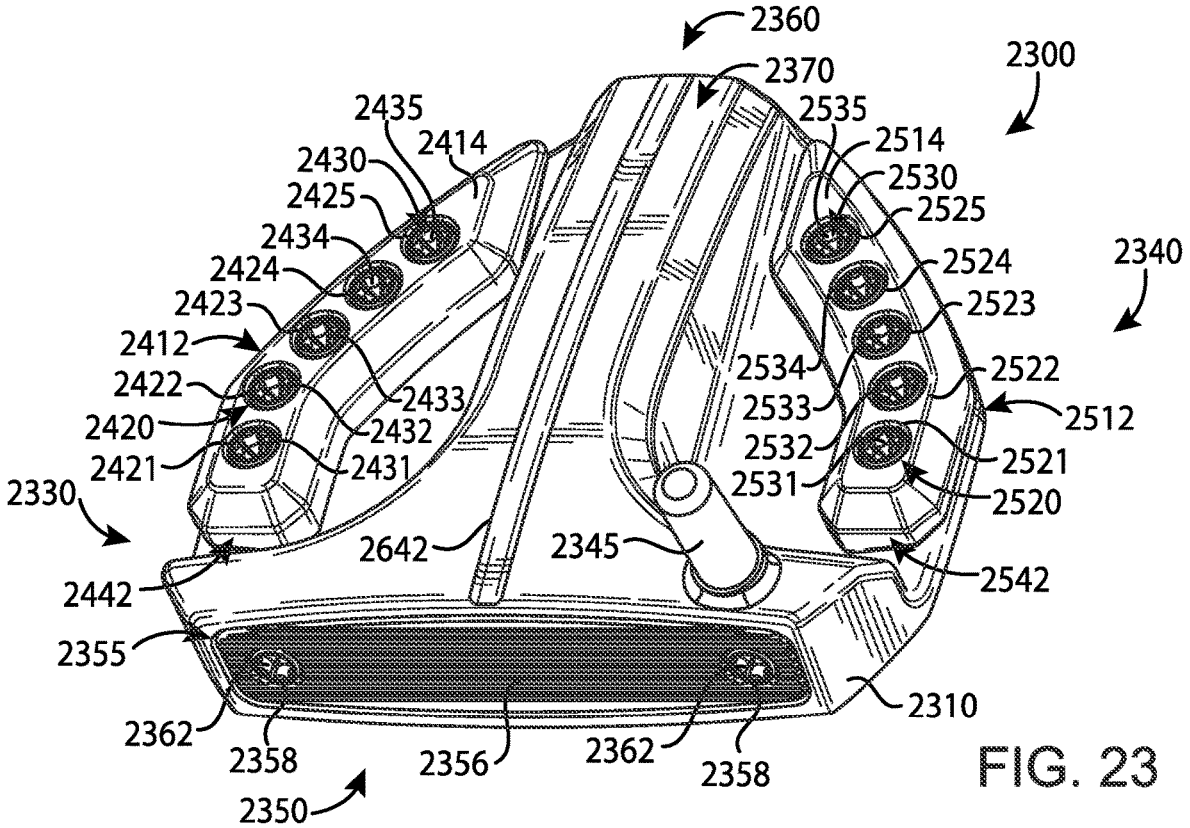
FIG. 23 depicts a front and top perspective view of a golf club head according to yet another example of the apparatus, methods, and articles of manufacture described herein.
Figure 24:
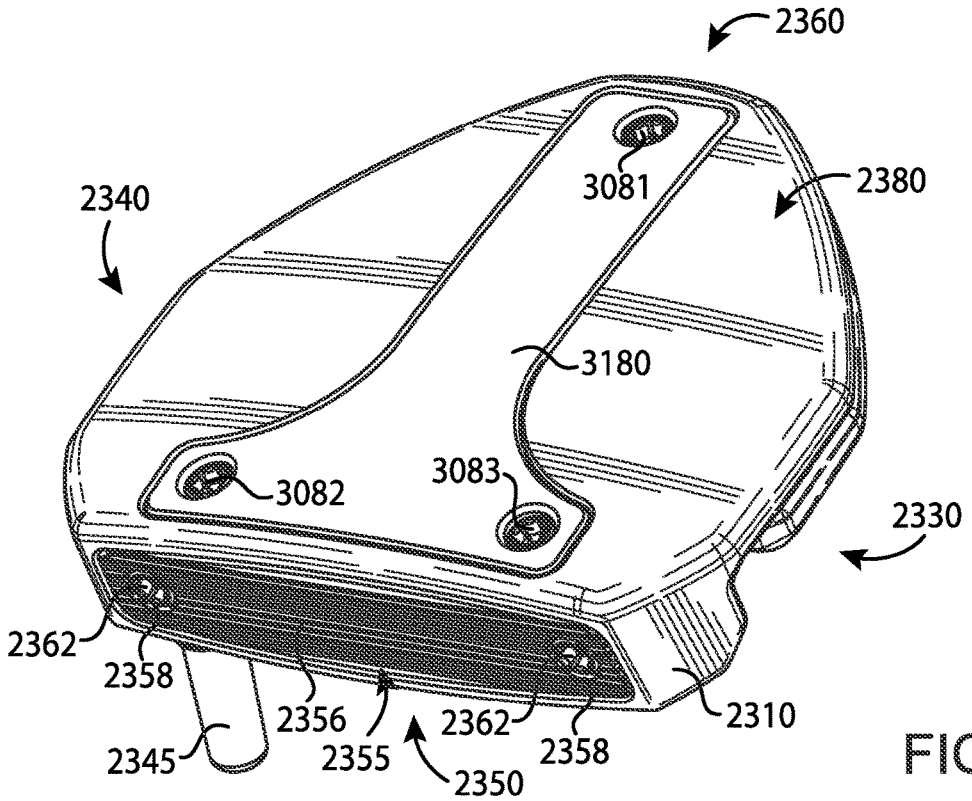
FIG. 24 depicts a front and bottom perspective view of the golf club head of FIG. 23.
Figure 25:
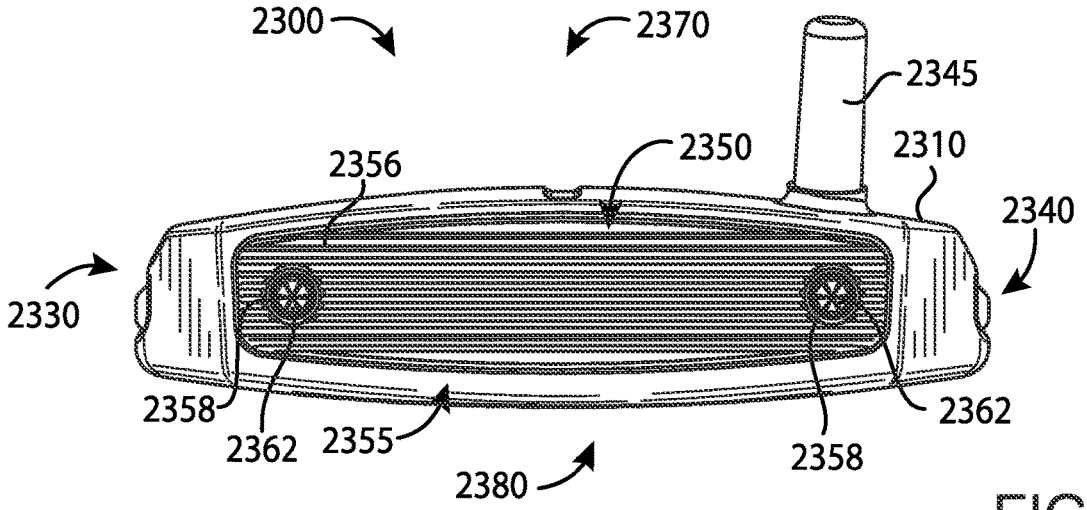
FIG. 25 depicts a front view of the golf club head of FIG. 23.
Figure 26:
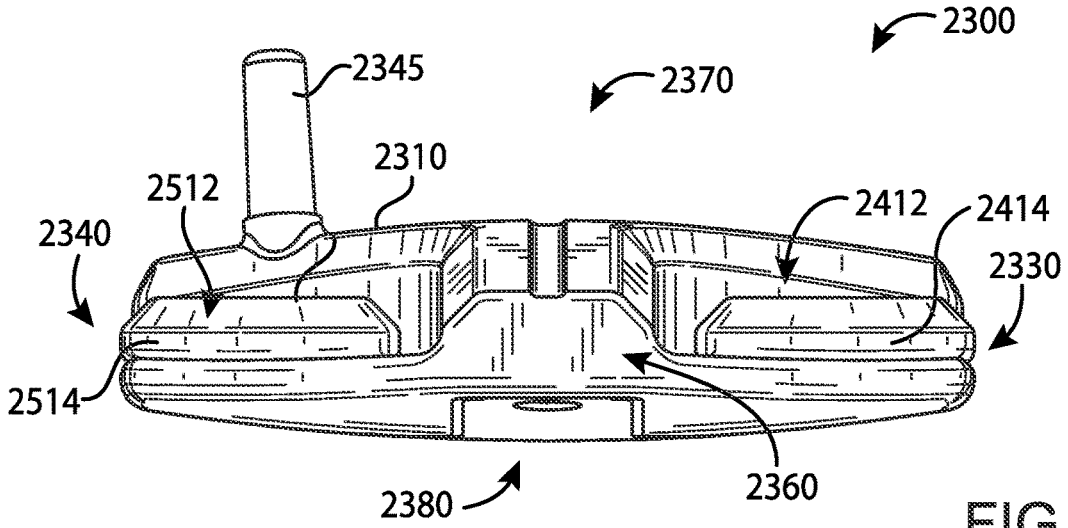
FIG. 26 depicts a rear view of the golf club head of FIG. 23.
Figure 27:
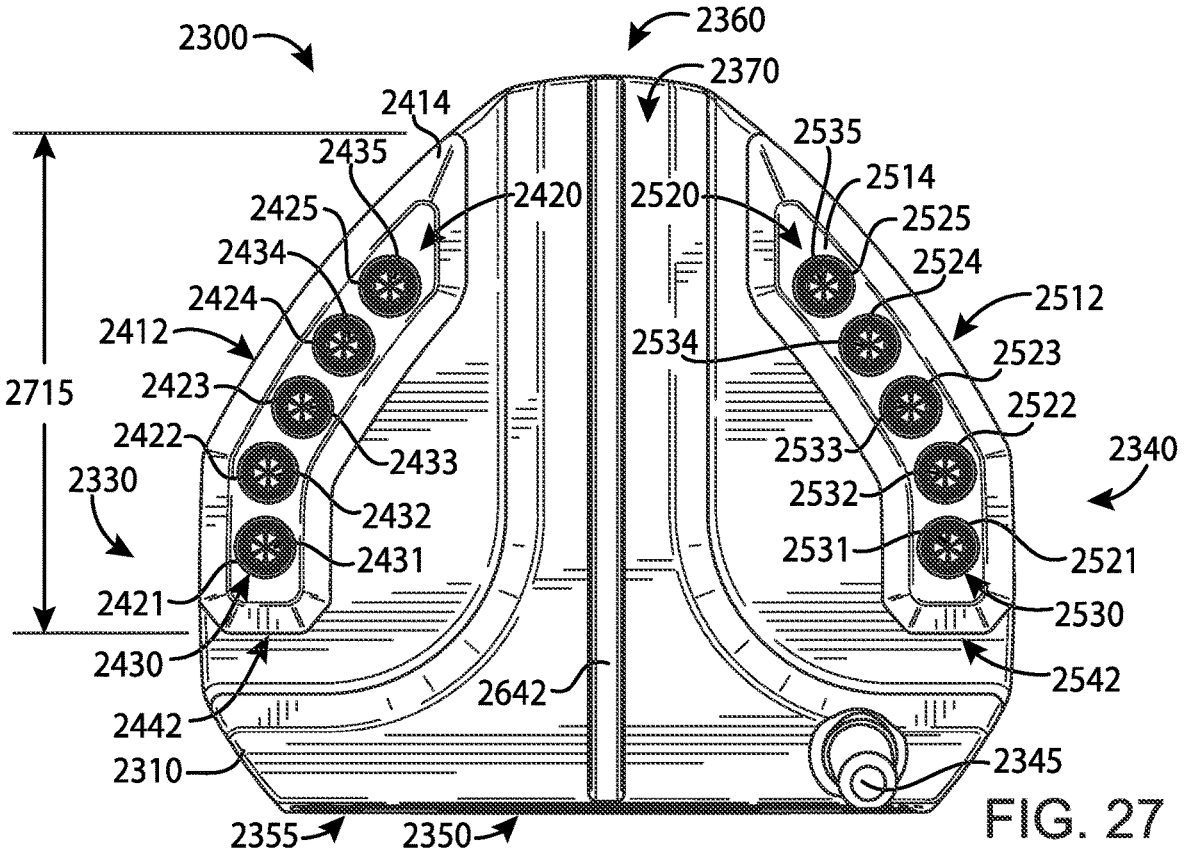
FIG. 27 depicts a top view of the golf club head of FIG. 23.

As illustrated in FIGS. 23 and 27, for example, the body portion 2310 may include two or more weight regions, generally shown as a first weight region 2412 and a second weight region 2512. The first weight region 2412 may include a first weight platform portion 2414 having a first set of weight ports 2420 (e.g., shown as weight ports 2421, 2422, 2423, 2424, and 2425). Each weight port of the first set of weight ports 2420 is configured to receive a weight portion of a first set of weight portions 2430 (e.g. shown as weight portions 2431, 2432, 2433, 2434 and 2435). The second weight region 2512 may include a second weight platform portion 2514 having a second set of weight ports 2520 (e.g., shown as weight ports 2521, 2522, 2523, 2524, and 2525). Each weight port of the second set of weight ports 2520 is configured to receive a weight portion of a second set of weight portions 2530 (e.g. shown as weight portions 2531, 2532, 2533, 2534 and 2535). Each weight portion of the first set of weight portions 2430 may be interchangeable with each weight portion of the second set of weight portions 2530. Accordingly, each weight port of the first set of weight ports 2420 and the second set of weight ports 2520 may be configured to interchangeably receive any of the weight portions of the first set of weight portions 2430 or the second set of weight portions 2530. The apparatus, methods, and articles of manufacture described herein are not limited in this regard.

Figure 28:
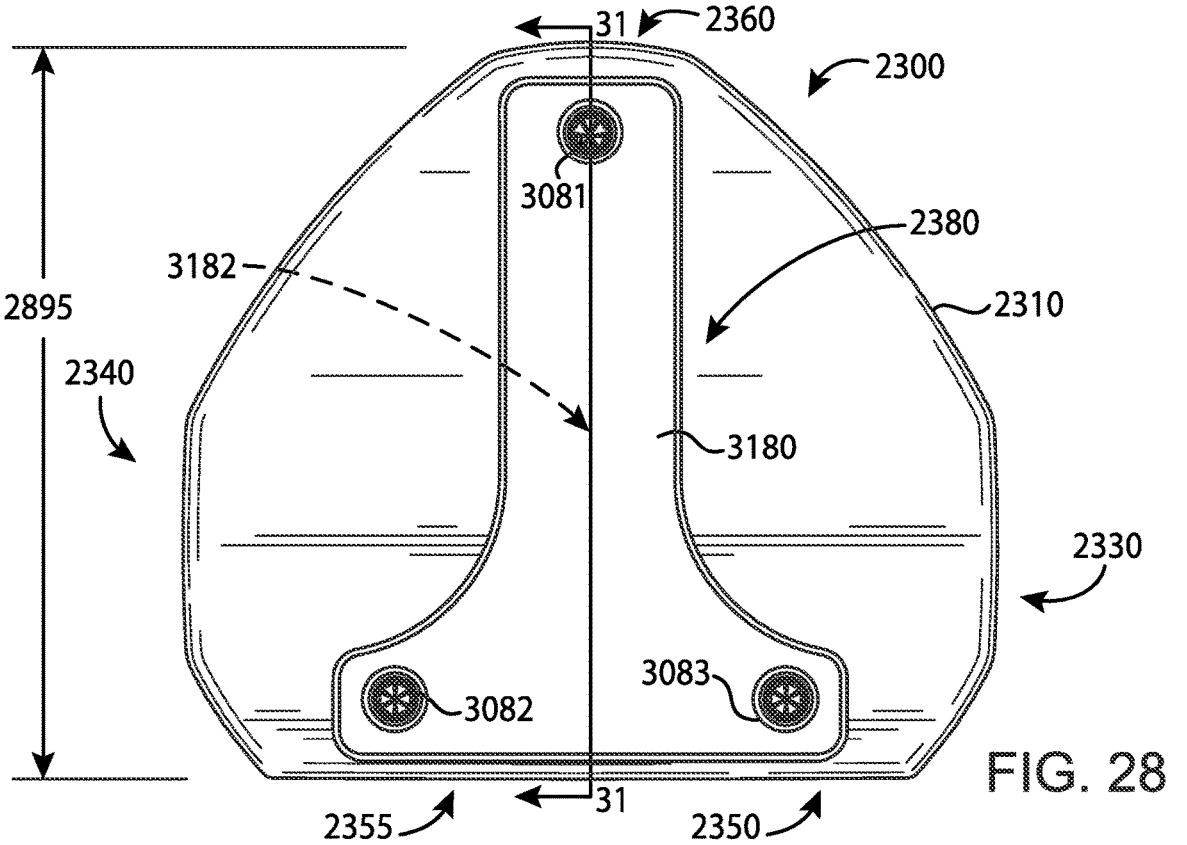
FIG. 28 depicts a bottom view of the golf club head of FIG. 23.
Figure 29:
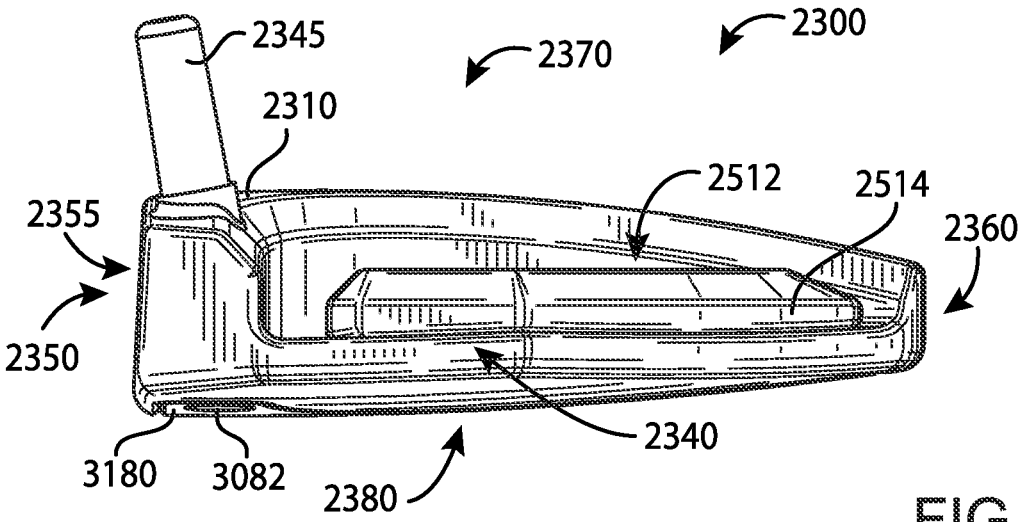
FIG. 29 depicts a left view of the golf club head of FIG. 23.
Figure 30:
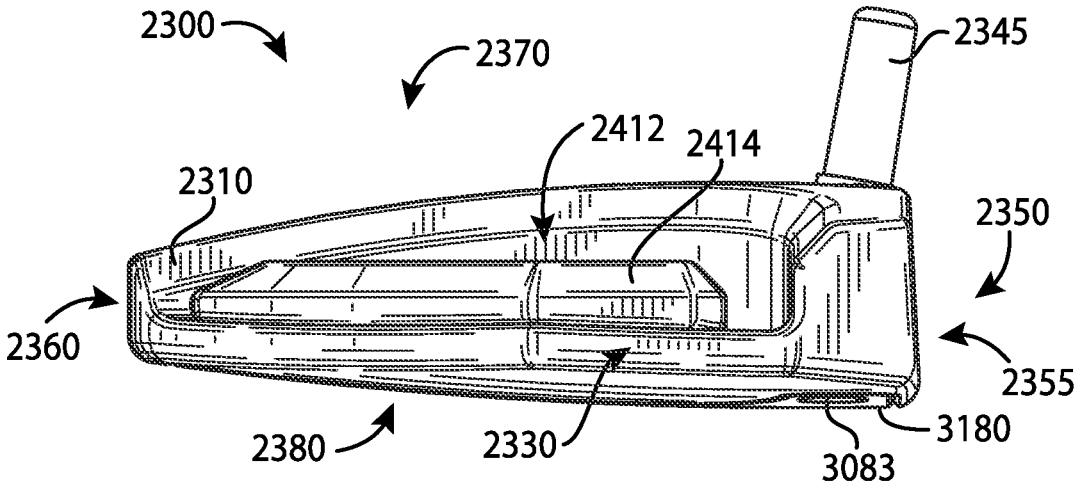
FIG. 30 depicts a right view of the golf club head of FIG. 23.

The first weight platform portion 2414 and the second weight platform portion 2514 may have a weight platform portion length ($L_{wp}$) 2715 that may be greater than about 40% of a body portion length ($L_B$) 2895 (FIG. 28). In one example, the weight platform portion length 2715 may be greater than 50% of the body portion length 2895. In one example, the weight platform portion length 2715 may be greater than 60% of the body portion length 2895. In one example, the weight platform portion length 2715 may be greater than 70% of the body portion length 2895. Accordingly, the mass of each of the first and second weight platform portions 2414 and 2514 may be distributed along a substantial portion of the body portion length 2895. The apparatus, methods, and articles of manufacture described herein are not limited in this regard.

The masses of the first and second weight platform portions 2414 and 2514 may be moved laterally outward on the body portion 2310. The mass of each of the first and second weight platform portions 2414 and 2514 may be between 5% and 30% of the mass of the body portion 2310 including the mass of the first weight platform portion 2414 and the second weight platform portion 2514. In one example, the mass of each of the first and second weight platform portions 2414 and 2514 may be between about 3% and about 13% of the mass of the body portion 2310 if the first and second weight platform portions 2414 and 2514 are made from relatively lighter metals such as metals including titanium or titanium alloys. In another example, the mass of each of the first and second weight platform portions 2414 and 2514 may be between about 8% and about 21% of the mass of the body portion 2310 if the first and second weight platform portions 2414 and 2514 are made from metals including steel. In yet another example, the mass of each of the first and second weight platform portions 2414 and 2514 may be between about 10% and about 30% of the mass of the body portion 2310 if the first and second weight platform portions 2414 and 2514 are made from relatively heavier metals such as metals including magnesium or magnesium alloys. Accordingly, between about 3% and about 30% of the mass of the body portion 2310 may be redistributed to the toe portion 2330 and the heel portion 2340 by the first and second weight platform portions 2414 and 2514 from other parts of the body portion 2310. Further, the first weight platform portion 2414 may be located at or proximate to the periphery of the toe portion 2330 and the second weight platform portion 2514 may be located at or proximate to the periphery of the heel portion 2340. The apparatus, methods, and articles of manufacture described herein are not limited in this regard.

Each weight port of the first set of weight ports 2420 may have a first port diameter ($PD_1$). In particular, a uniform distance of less than the first port diameter may separate any two adjacent weight ports of the first set of weight ports 2420 (e.g., (i) weight ports 2421 and 2422, (ii) weight ports 2422 and 2423, (iii) weight ports 2423 and 2424, or (iv) weight ports 2424 and 2425). In one example, the first port diameter may be about 0.25 inch (6.35 millimeters) and any two adjacent weight ports of the first set of weight ports 2420 may be separated by 0.1 inch (2.54 millimeters). Each weight port of the second set of weight ports 2520 may have a second port diameter ($PD_2$). A uniform distance of less than the second port diameter may separate any two adjacent weight ports of the second set of weight ports 2520 (e.g., (i) weight ports 2521 and 2522, (ii) weight ports 2522 and 2523, (iii) weight ports 2523 and 2524, or (iv) weight ports 2524 and 2525). For example, the second port diameter may be about 0.25 inch (6.35 millimeters) and any two adjacent weight ports of the second set of weight ports 2520 may be separated by 0.1 inch (2.54 millimeters). The first and second port diameters may be equal to each other (i.e., $PD_1=PD_2$). Alternatively, the first and second port diameters may be different. The apparatus, methods, and articles of manufacture described herein are not limited in this regard.

The first weight platform portion 1414, the first set of weight ports 2420 (weight ports 2421, 2422, 2423, 2424, and 2425), and/or the first set of weight portions 2430 (weight portions 2431, 2432, 2433, 2434, and 2435) may form a first visual guide portion 2442. The second weight platform portion 2514, the second set of weight ports 2520 (weight ports 2521, 2522, 2523, 2524, and 2525), and/or the second set of weight portions 2530 (weight portions 2531, 2532, 2533, 2534, and 2535) may form a second visual guide portion 2542. The first weight region 2412 may be located at or proximate to a periphery of the toe portion 2330 of the golf club head 2300. Accordingly, the first visual guide portion 2442 may be located at or proximate to the periphery of the toe portion 2330. The second weight region 2512 may be located at or proximate to the periphery of the heel portion 2340 of the golf club head 2300. Accordingly, the second visual guide portion 2542 may be located at or proximate to the periphery of the heel portion 2340. The first weight platform portion 2414 and/or any of the weight portions of the first set of weight portions 2430 may have distinct colors, markings and/or other visual features so as to be visually distinguished from the surrounding portions of the body portion 2310. Similarly, the second weight platform portion 2514 and/or any of the weight portions of the second set of weight portions 2530 may have distinct colors, markings and/or other visual features so as to be visually distinguished from the surrounding portions of the body portion 2310. The apparatus, methods, and articles of manufacture described herein are not limited in this regard.

The golf club head 2300 may also include a third visual guide portion 2642, which may be substantially equidistant from the first and second visual guide portions 2442 and 2542. For example, the third visual guide portion 2642 may extend between the front and rear portions 2350 and 2360 located at or proximate to a center of the body portion 2310. The third visual guide portion 2642 may be the same as or different from the first and/or second visual guide portions 2442 and 2542, respectively. In one example, the third visual guide portion 2642 may be a recessed line portion having a certain color. In another example, the third visual guide portion 2642 may include a plurality of weight ports (not shown) with a plurality of weight portions (not shown) received therein. Alternatively, the third visual guide portion 2642 may be defined by a raised portion of the top portion 2370. The third visual guide portion 2642 may be similar in many respects to any of the visual guide portions described herein. Therefore, a detailed description of the third visual guide portion 2642 is not provided. The apparatus, methods, and articles of manufacture described herein are not limited in this regard.

The first and second sets of weight portions 2430 and 2530, respectively, may have similar or different physical properties (e.g., density, shape, mass, volume, size, color, etc.). The first and second sets of weight portions 2430 and 2530, respectively, may include threads to secure in the weight ports of the first and second sets of weight ports 2420 and 2520, respectively. The physical properties of the weight portions of the first and second sets of weight portions 2430 and 2530, respectively, may be similar in many respects to any of the weight portions described herein. Therefore, a detailed description of the physical properties of the weight portions of the first and second sets of weight portions 2430 and 2530, respectively, is not provided. The apparatus, methods, and articles of manufacture described herein are not limited in this regard.

The first weight platform portion 2414 may be attached to the body portion 2310 with any one or more weight portions of the first set of weight portions 2430 or the second set of weight portions 2530. The body portion 2310 may include a plurality of toe side threaded bores (not shown) on the top portion 2370 at or proximate to the toe portion 2330. When the first weight platform portion 2414 is placed on the top portion 2370 at or proximate to the periphery of the toe portion 2330 as shown in FIGS. 23 and 27, for example, the toe side threaded bores may generally align with the weight ports of the first set of weight ports 2420. When a weight portion of the first set of weight portions 2430 or the second set of weight portions 2530 is inserted in a weight port of the first set of weight ports 2420, the weight portion extends through a corresponding one of the toe side threaded bores of the body portion 2310 such that the threads on the weight portion engage the corresponding threads in the toe side threaded bore. The weight portion can then be screwed into the corresponding toe side threaded bore to fasten the first weight platform portion 2414 on the body portion 2310. The apparatus, methods, and articles of manufacture described herein are not limited in this regard.

The second weight platform portion 2514 may be attached to the body portion 2310 with any one or more weight portions of the first set of weight portions 2430 or the second set of weight portions 2530. The body portion 2310 may include a plurality of heel side threaded bores (not shown) on the top portion 2370 at or proximate to the heel portion 2340. When the second weight platform portion 2514 is placed on the top portion 2370 at or proximate to the periphery of the heel portion 2340 as shown in FIGS. 23 and 27, for example, the heel side threaded bores generally align with the weight ports of the second set of weight ports 2520. When a weight portion of the first set of weight portions 2430 or the second set of weight portions 2530 is inserted in a weight port of the second set of weight ports 2520, the weight portion extends through a corresponding one of the heel side threaded bores of the body portion 2310 such that the threads on the weight portion engage the corresponding threads in the heel side threaded bore. The weight portion can then be screwed into the corresponding heel side threaded bore to fasten the second weight platform portion 2514 on the body portion 2310. The apparatus, methods, and articles of manufacture described herein are not limited in this regard.

Each of the weight portions of the first and second sets of weight portions 2430 and 2530, respectively, may have sufficient length to extend through a weight port and into a corresponding threaded bore of the body portion 2310 as described herein to fasten the first weight platform portion 2414 and the second weight platform portion 2514 to the body portion 2310. One or more weight portions of the first set of weight portions 2430 and/or one or more weight portions of the second set of weight portions 2530 may function both as weights for configuring a weight distribution of the golf club head 2300 and as fasteners for fastening the first weight platform portion 2414 and/or the second weight platform portion 2514 on the body portion 2310. Alternately, the first weight platform portion 2414 and/or the second weight platform portion 2514 may be fastened on the body portion 2310 by using other types of fastening mechanisms such that one or more weight portions of the first set of weight portions 2430 and/or one or more weight portions of the second set of weight portions 2530 may only function as weight portions. The apparatus, methods, and articles of manufacture described herein are not limited in this regard.

Each of the first and second weight platform portions 2414 and 2514, respectively, may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The first and second weight platform portions 2414 and 2514, respectively, may have a similar mass or different masses to optimally affect the weight distribution, center or gravity location, and/or moment of inertia of the golf club head 2300. Each of the first and second weight platform portions 2414 and 2514 may function as an added weight for the body portion 2310 and as a platform for receiving additional weights for the body portion 2310 in the form of the first and second sets of weight portions 2430 and 2530. Thus, the physical properties and the materials of construction of the first and second weight platform portions 2414 and/or 2514 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

In one example, the face portion 2355 may be in one-piece with the body portion 2310 or be an integral part of the body portion 2310 (not shown). The face portion 2355 may include a separate piece or an insert coupled to the body portion 2310. The face portion 2355 may include a face insert 2356, which may be attached to the front portion 2350 via any manufacturing methods and/or processes (e.g., a bonding process, a welding process, a brazing process, a mechanical locking method, a mechanical fastening method, any combination thereof, or other suitable types of manufacturing methods and/or processes). In one example shown in FIGS. 23-25, the face insert 2356 may include two fastener holes 2358 proximate to the toe portion and heel portion of the face insert 2356. Each of the fastener holes 2358 may be configured to receive a fastener 2362 for attachment of the face insert 2356 to the body portion 2310. The body portion 2310 may include two fastener ports (not shown) configured to receive the fasteners 2362. The fasteners 2362 may be similar or substantially similar to the weight portions of the first set of weight portions 2430 and/or the weight portions of the second set of weight portions 2530. Accordingly, the fasteners 2362 may function both as weights for configuring a weight distribution of the golf club head 2300 and as fasteners for fastening the face insert 2356 to the face portion 2355. Each fastener port may have internal threads that are configured to engage external threads on the fasteners 2362. The fastener ports of the body portion 2310 may be similar in many respects to the fastener ports 1768 of the golf club head 1700 described herein. The apparatus, methods, and articles of manufacture described herein are not limited in this regard.

The face portion 2355 may include a peripheral recessed portion 3172 (shown in FIG. 31) configured to receive the face insert 2356. As shown by example in FIG. 31, the depth of the peripheral recessed portion 3172 may be similar to the thickness of the face insert 2356 such that when the face insert 2356 is fastened to the body portion 2310, the face insert 2356 is positioned flush or substantially flush with the face portion 2355. Alternatively, the face insert 2356 may project from the face portion 2355. The apparatus, methods, and articles of manufacture described herein are not limited in this regard.

As described, the fasteners 2362 may be similar or substantially similar to the weight portions of the first set of weight portions 2430 and/or the weight portions of the second set of weight portions 2530 so that the fasteners 2362 may function to configure the weight distribution of the golf club head 2300. Accordingly, the fasteners 2362 may have similar or different weights to balance and/or provide heel or toe weight bias for the golf club head 2300. For example, the weight of the body portion 2310 may be increased or decreased by similarly increasing or decreasing, respectively, the weights of the fasteners 2362. In one example, the golf club head 2300 may be provided with a toe-biased weight configuration by having the fastener 2362 that is closer to the toe portion 2330 be heavier than the fastener 2362 that is closer to the heel portion 2340. Conversely, the golf club head 2300 may be provided with a heel-biased weight configuration by having the fastener 2362 that is closer to the heel portion 2340 be heavier than the fastener 2362 that is closer to the toe portion 2330. The apparatus, methods, and articles of manufacture described herein are not limited in this regard.

To attach the face insert 2356 to the body portion 2310, the face insert 2356 may be inserted in the peripheral recessed portion 3172, thereby generally aligning the fastener holes 2358 of the face insert 2356 and the fastener ports (not shown) of the body portion 2310. The fasteners 2362 can be inserted through the fastener holes 2358 and screwed into the fastener ports of the body portion 2310 to securely attach the face insert 2356 to the body portion 2310. The face insert 2356 may be constructed from any material such as metal, metal alloys, plastic, wood, composite materials or a combination thereof to provide a certain ball striking characteristic to the golf club head 2300. The material from which the face insert 2356 is manufactured may affect ball speed and spin characteristics. Accordingly, the face insert 2356 may be selected to provide a certain ball speed and spin characteristics for an individual. Thus, the face insert 2356 may be interchangeable with other face inserts having different ball speed and spin characteristics. The face insert 2356 may be coupled to the body portion 2310 by other methods or devices, such as by bonding, welding, adhesive and/or other types of fastening devices and/or methods. The apparatus, methods, and articles of manufacture described herein are not limited in this regard.

The body portion 2310 may include an interior cavity 3182 (shown in FIG. 31) extending between the front portion 2350 and the rear portion 2360 and between the toe portion 2330 and the heel portion 2340. The interior cavity 3182 may be open or accessible at the face portion 2355 and/or at the sole portion 2380. Accordingly, the interior cavity 3182 may have a first opening 3176 at the face portion 2355 and/or a second opening 3178 at the sole portion 2380. The interior cavity 3182 allows the mass of the body portion 2310 to be removed at or around the center portion of the body portion 2310 so that removed mass may be redistributed to the toe portion 2330 and the heel portion 2340 using the first weight platform portion 2414 and the second weight platform portion 2514 without affecting or substantially affecting the overall mass of the golf club head 2300. The apparatus, methods, and articles of manufacture described herein are not limited in this regard.

Figure 31:
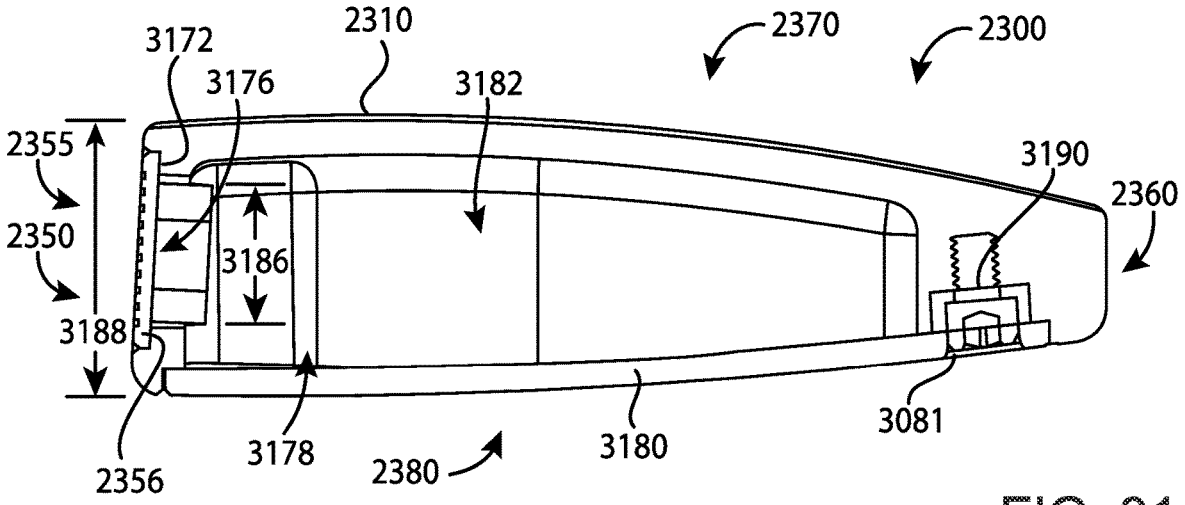
FIG. 31 depicts a cross-sectional view of the golf club head of FIG. 23 taken at lines 31-31 of FIG. 31.

In one example as shown in FIGS. 28 and 31, the interior cavity 3182 may be covered at the face portion 2355 by the face insert 2356 and at the sole portion 2380 by a cover or sole plate 3180. In one example, the sole plate 3180 may have a mass between 7% and 17% of the mass of the golf club head 2300. In one example, the sole plate 3180 may have a mass between 10% and 15% of the mass of the golf club head 2300. As described herein, the interior cavity 3182 allows the mass of the body portion 2310 to be removed at or around the center portion of the body portion 2310. The removed mass can be also redistributed to the sole portion 2380 using the sole plate 3180 to lower the center of gravity of the golf club head 2300 without affecting or substantially affecting the overall mass of the golf club head 2300. The apparatus, methods, and articles of manufacture described herein are not limited in this regard.

The sole plate 3180 may be attached to the sole portion 2380 with one or more fasteners. In the example of FIGS. 24 and 28-31, the sole plate 3180 may be attached to the sole portion 2380 with fasteners 3081, 3082, and 3083 to cover the second opening 3178 of the interior cavity 3182 at the sole portion 2380. Each of the fasteners 3081, 3082, and 3083 may have a threaded portion that is configured to engage a correspondingly threaded bore 3190 (shown in FIG. 31) in the body portion 2310. The fasteners 3081, 3082, and/or 3083 may be similar or substantially similar to the weight portions of the first set of weight portions 2430 and/or the weight portions of the second set of weight portions 2530. Accordingly, the fasteners 3081, 3082, and/or 3083 may function both as weights for configuring a weight distribution of the golf club head 2300 and as fasteners for fastening the sole plate 3180 to the sole portion 2380. The fasteners 3081, 3082, and/or 3083 may also lower the center of gravity of the golf club head 2300 by adding more mass to the sole portion 2380 without affecting or substantially affecting the overall mass of the golf club head 2300 as described herein with respect to the sole plate 3180. The apparatus, methods, and articles of manufacture described herein are not limited in this regard.

The sole plate 3180 may be partially or entirely made of an aluminum-based material (e.g., a high-strength aluminum alloy or a composite aluminum alloy coated with a high-strength alloy), a magnesium-based material, a stainless steel-based material, a titanium-based material, a tungsten-based material, any combination thereof, and/or other suitable types of materials. The physical properties and the materials of construction of the sole plate 3180 may be determined to optimally affect the weight, weight distribution, center of gravity, moment of inertia characteristics, structural integrity and/or or other static and/or dynamic characteristics of the golf club head 2300. The apparatus, methods, and articles of manufacture described herein are not limited in this regard.

The interior cavity 3182 may extend from near the toe portion 2330 to near the heel portion 2340 and from near the top portion 2370 to near the sole portion 2380. Alternatively, the interior cavity 3182 may extend between the front portion 2350 and the rear portion 2360 and include a portion of the body portion 2310 between the toe portion 2330 and near the heel portion 2340 and between the top portion 2370 and near the sole portion 2380. In one example, a portion of the interior cavity 3182 may be located proximate to the regions of the face portion 2355 that generally strike a golf ball. In one example, the interior cavity 3182 may be only at the face portion 2355 similar to the interior cavity 1782 of the golf club head 1700 described herein. The apparatus, methods, and articles of manufacture described herein are not limited in this regard.

The interior cavity 3182 proximate to the face portion 2355 may be associated with a cavity height 3186 ($H_C$), and the body portion 2310 proximate to the face portion 2355 may be associated with a body height 3188 ($H_B$). While the cavity height 3186 and the body height 3188 may vary between the toe and heel portions 2330 and 2340, the front and rear portions 2350 and 2360, and the top and sole portions 2370 and 2380, the cavity height 3186 may be at least 50% of the body height 3188 ($H_C>0.5*H_B$) proximate to the face portion 2355 or an any location of the interior cavity 3182. For example, the cavity height 3186 may vary between 70% and 85% of the body height 3188. With the cavity height 3186 of the interior cavity 3182 being greater than 50% of the body height 3188, the golf club head 2300 may produce relatively more consistent feel, sound, and/or result when the golf club head 2300 strikes a golf ball via the face portion 2355 than a golf club head with a cavity height of less than 50% of the body height. However, the cavity height 3186 may be less than 50% of the body height 3188. The apparatus, methods, and articles of manufacture described herein are not limited in this regard.

In one example, the interior cavity 3182 may be unfilled (i.e., empty space). Alternatively, the interior cavity 3182 may be partially or entirely filled with a filler material (not shown) to absorb shock, isolate vibration, and/or dampen noise when the face portion 2355 strikes a golf ball. The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 3182 may be filled with a TPE material to absorb shock, isolate vibration, and/or dampen noise when the golf club head 2300 strikes a golf ball via the face portion 2355. In one example, the mass of the filler material (e.g., TPE, TPU, etc.) may be between 3% and 13% of the mass of the golf club head 2300. In one example, the mass of the filler material may be between 6% and 10% of the mass of the golf club head 2300. The apparatus, methods, and articles of manufacture described herein are not limited in this regard.

In another example, the filler material may be a polymer material such as an ethylene copolymer material to absorb shock, isolate vibration, and/or dampen noise when the golf club head 2300 strikes a golf ball via the face portion 2355. In particular, at least 50% of the interior cavity 3182 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The interior cavity 3182 may be partially or fully filled with the filler material. In one example, the interior cavity 3182 may be filled with the filler material from the first opening 3176 and/or the second opening 3178 prior to attaching the face insert 2356 and/or the sole plate 3180, respectively, to the body portion 2310. In one example, the interior cavity 3182 may be filled with the filler material after the face insert 2356 and the sole plate 3180 are attached to the body portion 2310 by injecting the filler material into the interior cavity 3182 through one or more ports (not shown) on the sole plate 3180. The filler material may be injected into the interior cavity 3182 from one or more ports on the sole plate 3180 while the air inside the interior cavity 3182 that is displaced by the filler material may exit the interior cavity 3182 from one or more other ports on the sole plate 3180. The apparatus, methods, and articles of manufacture described herein are not limited in this regard.

For example, at least 50% of the interior cavity 3182 may be filled with the filler material to absorb shock, isolate vibration, dampen noise, and/or provide structural support when the golf club head 2300 strikes a golf ball via the face portion 2355. With the filler material, the face portion 2355 may be relatively thin without degrading the structural integrity, sound, and/or feel of the golf club head 2300. In one example, the face portion 2355 may have a thickness of less than or equal to 0.075 inch (1.905 millimeters). In another example, the face portion 2355 may have a thickness of less than or equal to 0.060 inch (1.524 millimeters). In yet another example, the face portion 2355 may have a thickness of less than or equal to 0.050 inch (1.270 millimeters). Further, the face portion 2355 may have a thickness of less than or equal to 0.030 inch (0.762 millimeters). The apparatus, methods, and articles of manufacture described herein are not limited in this regard.

In the example of FIGS. 32-39, a face portion 3200 of a golf club head may include a strike portion 3210, a toe portion 3230 having a toe edge 3231, a heel portion 3240 having a heel edge 3241, a top portion 3270 having a top edge 3271, a sole portion 3280 having a sole edge 3281, and a central strike portion 3285. The toe edge 3231, the heel edge 3241, the top edge 3271, and the sole edge 3281 may define a periphery or perimeter 3290 of the face portion 3200. The central strike portion 3285 may be located inside the perimeter 3290 and may include a geometric center 3286 of the face portion 3200. The face portion 3200 may be used with any golf club head including any of the golf club heads described herein. In one example, the face portion 3200 may be co-manufactured with a body portion (e.g., one shown as 2310) of a golf club head (e.g., one shown as 2300) to be an integral part of the body portion of the golf club head (e.g., milling and/or other techniques such as grinding, etching, laser milling, etc. to the body portion). In another example, the face portion 3200 may be a separate piece from a body portion of a golf club and attached to the body portion by welding, soldering, adhesive bonding, press fitting, and/or other suitable attachment methods. In yet another example, the face portion 3200 may be a separate piece from a body portion of a golf club head and attached to the body portion by one or more fasteners such as bolts and/or screws. The apparatus, methods, and articles of manufacture described herein are not limited in this regard.

In the example of FIGS. 32-39, the strike portion 3210 may include a plurality of projections 3330 (e.g., two projections generally shown in FIGS. 32-36 as 3331 and 3332). In the example of FIGS. 32-39, the entire strike portion 3210 of the face portion 3200 may include the plurality of projections 3330. In another example, the strike portion 3210 of the face portion 3200 may partially include the plurality of projections 3330. In one example, the face portion 3200 may be a separate piece and the strike portion 3210 may be located opposite a back portion 3220 (FIG. 34) of the face portion 3200. The back portion 3220 may be coupled to and/or in contact with a filler material that may at least partially structurally support the face portion 3200, dampen noise, and/or reduce vibration when the face portion 3200 strikes a golf ball as described herein. The apparatus, methods, and articles of manufacture described herein are not limited in this regard.

Figure 34:
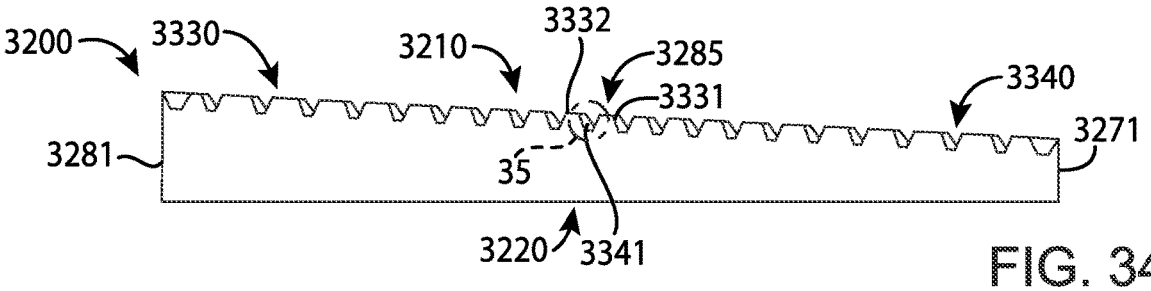
FIG. 34 depicts a perspective cross-sectional view of the face portion of FIG. 32.
Figure 35:
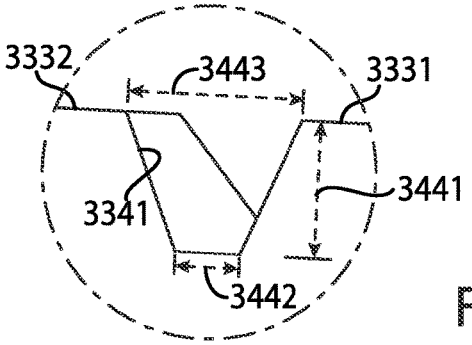
FIG. 35 depicts an enlarged view of area 35 of the face portion of FIG. 34.
Figure 36:
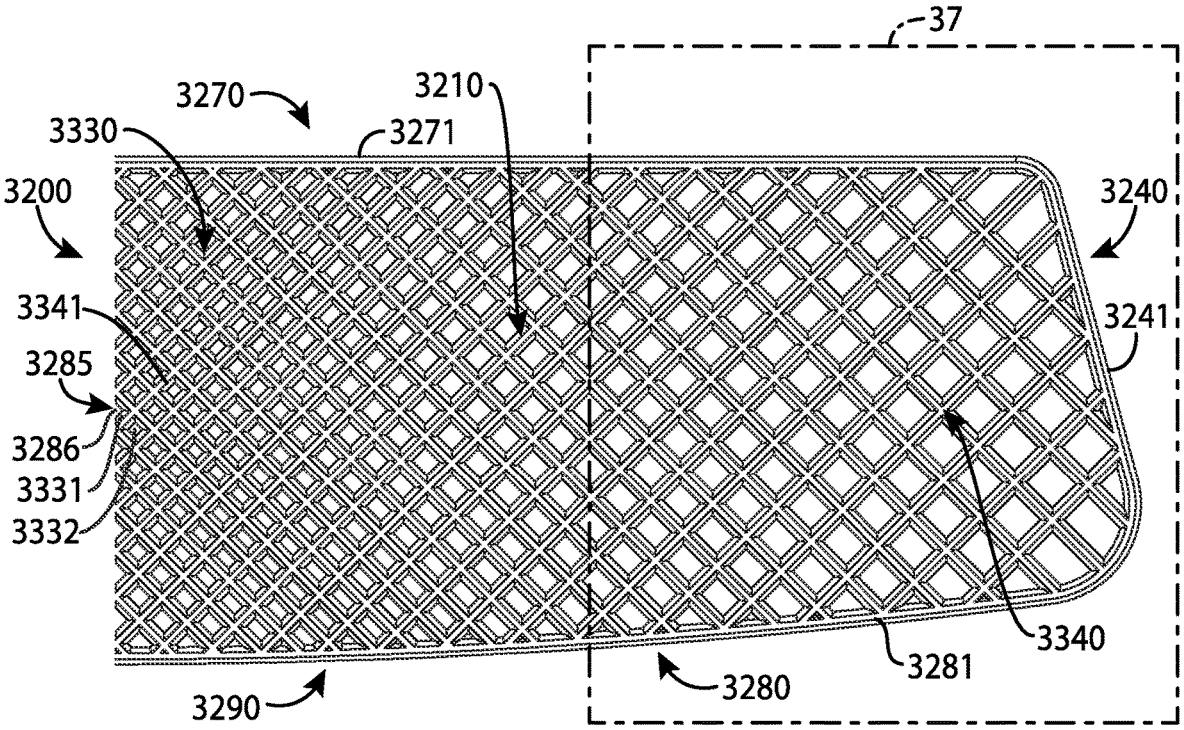
FIG. 36 depicts an enlarged view of area 36 of the face portion of FIG. 32.

In the example of FIGS. 32-39, each one of the plurality of projections 3330 may be separated from and linearly aligned with an adjacent projection by one of a plurality of grooves 3340 (e.g., one groove generally shown in FIGS. 34-36 as 3341). The plurality of grooves 3340 may be arranged on the strike portion 3210 of the face portion 3200 in a grid pattern with each grid cell corresponding to one of the plurality of projections 3330 (e.g., one projection shown in FIG. 38 as 3331). In other words, the plurality of projections 3330 may be configured on the strike portion 3210 of the face portion 3200 in an array defined by the plurality of grooves 3340. The apparatus, methods, and articles of manufacture described herein are not limited in this regard.

Figure 37:
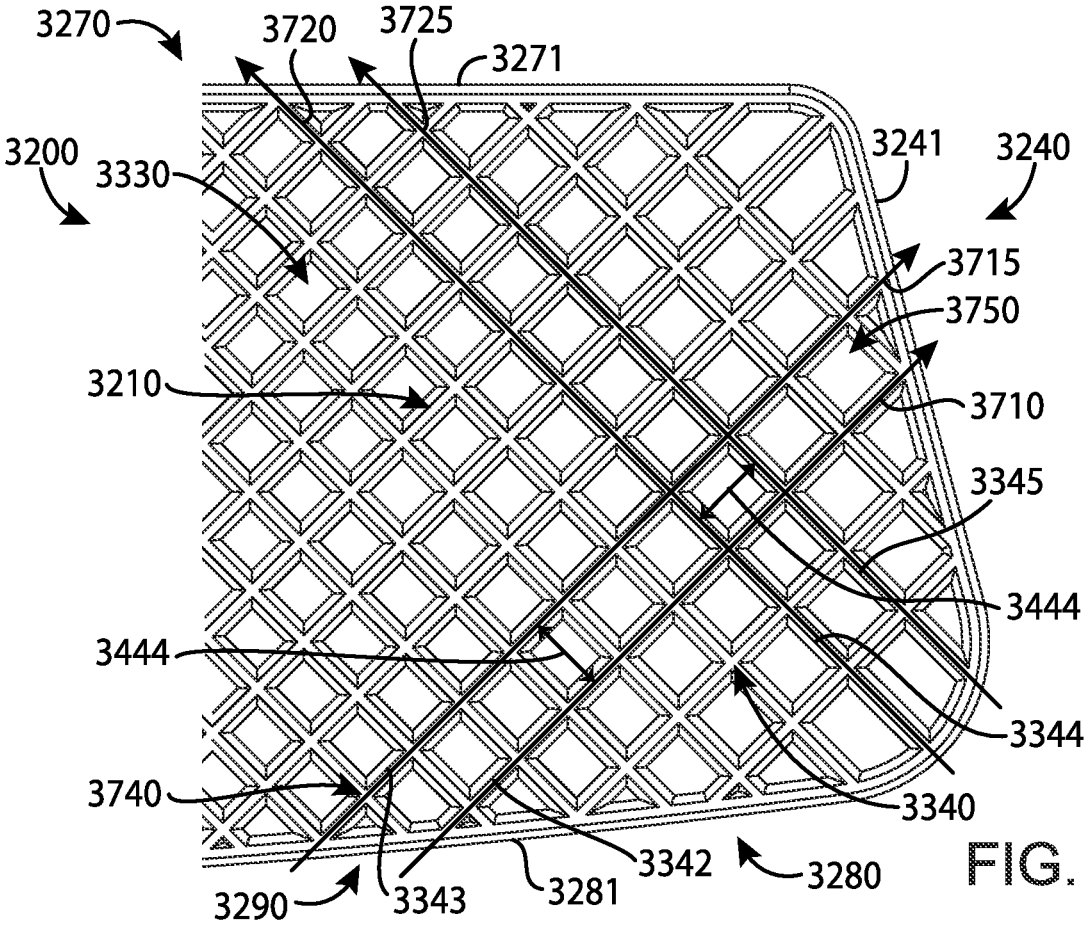
FIG. 37 depicts an enlarged view of area 37 of the face portion of FIG. 36.

In the example of FIGS. 32-39, the plurality of grooves 3340 may include a first plurality of grooves 3740 (FIG. 37) and a second plurality of grooves 3750 (FIG. 37). The first plurality of grooves 3740 may include two or more grooves (e.g., generally shown in FIG. 37 as grooves 3342 and 3343) extending across the strike portion 3210 in a first direction (e.g., as indicated in FIG. 37 by direction arrows 3710 and 3715 associated with grooves 3342 and 3343, respectively). The second plurality of grooves 3750 may include two or more grooves (e.g., generally shown in FIG. 37 as grooves 3344 and 3345) extending across the strike portion 3210 in a second direction (e.g., as indicated in FIG. 37 by direction arrows 3720 and 3725 associated with grooves 3344 and 3345, respectively). The second direction may be different from the first direction. In one example, the second direction may be transverse to the first direction. Each one of the first plurality of grooves 3740 (e.g., groove 3342) may be linear and may be parallel or substantially parallel with each other one of the first plurality of grooves 3740 (e.g., groove 3343). Similarly, each one of the second plurality of grooves 3750 (e.g., groove 3344) may be linear and may be parallel or substantially parallel with each other one of the second plurality of grooves 3750 (e.g., groove 3345). In another example (not shown), each one of the first plurality of grooves 3740 (e.g., groove 3342) may be non-linear (e.g., s-shaped, arcuate, serpentine shape, etc.) and/or non-parallel with each other one of the first plurality of grooves 3740. Similarly, each one of the second plurality of grooves 3750 (e.g., groove 3344) may be non-linear (e.g., s-shaped, arcuate, serpentine shape, etc.) and/or non-parallel with each other one of the second plurality of grooves 3750 (e.g., groove 3345). The first plurality of grooves 3740 may intersect with the second plurality of grooves 3750. In one example, one or more grooves of the first plurality of grooves 3740 and one or more grooves of the second plurality of grooves 3750 may intersect a horizontal centerline axis 3288 (FIG. 32) of the face portion 3200 at a 45 degree angle. In another example, one or more grooves of the first plurality of grooves 3740 and one or more grooves of the second plurality of grooves 3750 may intersect the horizontal centerline axis 3288 at a 60 degree angle. In yet another example, one or more grooves of the first plurality of grooves 3740 and one or more grooves of the second plurality of grooves 3750 may intersect the horizontal centerline axis 3288 at a 30 degree angle. In yet another example, one or more grooves of the first plurality of grooves 3740 and one or more grooves of the second plurality of grooves 3750 may intersect the horizontal centerline axis 3288 at any angle. The apparatus, methods, and articles of manufacture described herein are not limited in this regard.

In the example of FIGS. 32-39, and generally indicated in FIG. 37 by direction arrows 3710 and 3715, the first direction may include a first diagonal direction extending upwardly from left-to-right across the strike portion 3210. Accordingly, the first plurality of grooves 3740 may include grooves of the plurality of grooves 3340 extending in the first direction between the toe edge 3231 and the top edge 3271, between the sole edge 3281 and the top edge 3271, and between the sole edge 3281 and the heel edge 3241. The second direction, as generally indicated in FIG. 37 by direction arrows 3720 and 3725, may include a second diagonal direction extending upwardly from right-to-left across the strike portion 3210 of the face portion 3200. Accordingly, the second plurality of grooves 3750 may include grooves of the plurality of grooves 3340 extending in the second direction between the heel edge 3241 and the top edge 3271, between the sole edge 3281 and the top edge 3271, and between the sole edge 3281 and the toe edge 3231. The apparatus, methods, and articles of manufacture described herein are not limited in this regard.

Figure 38:
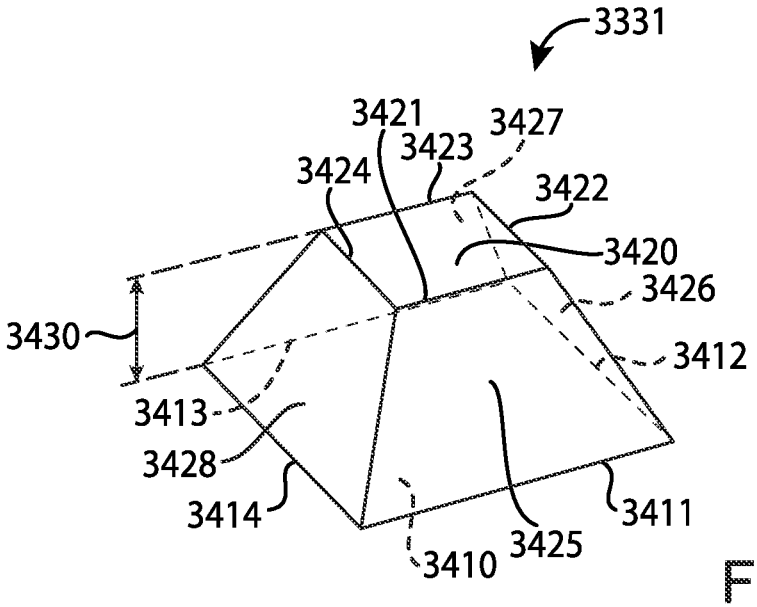
FIG. 38 depicts a perspective schematic view of a pyramidal frustum.

In one example, as shown in FIG. 35, a groove, generally shown as groove 3341, may have a truncated V-shaped cross section, or said differently, an inverted trapezoidal cross section. The groove 3341 may have a depth 3441 and a variable width that transitions from a lowermost width 3442 to an uppermost width 3443. In one example, the width of the groove 3341 linearly transitions from the lowermost width 3442 to the uppermost width 3443. The depth 3441 may be greater than or equal to approximately 0.010 inch (0.254 millimeters) and less than or equal to approximately 0.020 inch (0.508 millimeters). The lowermost width 3442, as measured between base portions (e.g., a base portion 3410 of projection 3331 is shown in FIG. 38) of adjacent projections (e.g., projections 3331 and 3332) of the plurality of projections 3330, may be greater than or equal to approximately 0.010 inch (0.254 millimeters) and less than or equal to approximately 0.012 inch (0.305 millimeters). The uppermost width 3443, as measured between peak portions (e.g., a peak portion 3420 of projection 3331 is shown in FIG. 38) of adjacent projections (e.g., projections 3331 and 3332), may be greater than or equal to approximately 0.021 inch (0.533 millimeters) and less than or equal to approximately 0.036 inch (0.914 millimeters).

In the example of FIGS. 32-39, each groove of the plurality of grooves 3340 may have a cross section similar to groove 3341. As described herein, the plurality of projections 3330 may be defined by the arrangement of the plurality of grooves 3340. In one example, the resulting geometric shape of each one of the plurality of projections 3330 may be a pyramidal frustum. The distance between adjacent projections of the plurality of projections 3330 may be defined by the width of a groove of the plurality of grooves 3340 extending therebetween. For example, the distance between adjacent projections 3331 and 3332 of the plurality of projections 3330 may be defined by the width of groove 3341 of the plurality of grooves 3340. In one example, each groove of the plurality of grooves 3340 may have the same or substantially the same width, whether the width be constant or variable. Accordingly, distances between adjacent projections of the plurality of projections 3330 may be similar or substantially similar. In another example (not shown), some or all of the grooves of the plurality of grooves 3340 may have different widths. Accordingly, the distance between adjacent projections of the plurality of projections 3330 may also be different. The apparatus, methods, and articles of manufacture described herein are not limited in this regard.

While not shown, the face portion 3200 may be configured such that one or more of the plurality of projections 3330 have other geometric shapes. For example, one or more of the plurality of projections 3330 may be a cube or cuboid. Accordingly, the corresponding grooves of the plurality of grooves 3340 may be an intersecting array of grooves that define one or more cubic or cuboidal grid cells. In another example, one or more of the plurality of projections 3330 may be a triangular pyramidal frustum. Accordingly, the corresponding grooves of the plurality of grooves 3340 may be an intersecting array of grooves that define one or more triangular grid cells. In yet another example, one or more of the plurality of projections 3330 may be a pentagonal pyramidal frustum. Accordingly, the corresponding grooves of the plurality of grooves 3340 may be an intersecting array of grooves that define one or more pentagonal grid cells. In yet another example, one or more of the plurality of projections 3330 may be a hexagonal pyramidal frustum. Accordingly, the corresponding grooves of the plurality of grooves 3340 may be an intersecting array of grooves that define one or more hexagonal grid cells. In yet another example, one or more of the plurality of projections 3330 may be any regular or irregular polygonal pyramidal frustum. In yet another example, one or more of the plurality of projections 3330 may be a conical frustum (e.g., having circular or elliptical base portion). The apparatus, methods, and articles of manufacture described herein are not limited in this regard.

In one example, as shown in FIG. 38, a projection, generally shown as projection 3331, may be a square or rectangular pyramidal frustum having a base portion 3410 proximal to the face portion 3200, a peak portion 3420 distal to the face portion 3200, and a height 3430. The base portion 3410 may include edges 3411, 3412, 3413, and 3414, and the peak portion 3420 may include edges 3421, 3422, 3423, and 3424. The length of edge 3411 or edge 3413 of the base portion 3410 may correspond to a distance (e.g., distance 3444 in FIG. 37) separating two successive grooves of one of the first plurality of grooves 3740 and the second plurality of grooves 3750. The length of edge 3412 or edge 3414 of the base portion 3410 may correspond to the distance separating two successive grooves of the other one of the first plurality of grooves 3740 and the second plurality of grooves 3750. The base portion 3410 may be connected to the peak portion 3420 via at least one side wall generally shown as side walls 3425, 3426, 3427, and 3428. The peak portion 3420 may be flat or textured and may have a smaller area than the base portion 3410. Accordingly, the projection 3331 may taper in a direction from the base portion 3410 to the peak portion 3420. For example, each of the side walls 3425, 3426, 3427, and 3428 may be trapezoidal and may extend inwardly from the base portion 3410 to the peak portion 3420. Said differently, the area of the projection 3331 may gradually diminish when transitioning from the base portion 3410 to the peak portion 3420. The apparatus, methods, and articles of manufacture described herein are not limited in this regard.

In the example of FIGS. 32-39, each projection of the plurality of projections 3330 may be oriented on the face portion 3200 such that the diagonals of the corresponding base portion 3410 and peak portion 3420 generally point in horizontal and vertical directions along the face portion 3200 when directly viewing the strike portion 3210. Accordingly, the projections of the plurality of projections 3330 may be linearly aligned in one or more diagonal directions across the strike portion 3210 of the face portion 3200. Linearly aligned projections of the plurality of projections 3330 may extend diagonally from the toe portion 3230 to the top portion 3270, from the toe portion 3230 to the sole portion 3280, from the top portion 3270 to the sole portion 3280, from the heel portion 3240 to the top portion 3270, from the heel portion 3240 to the sole portion 3280, or a combination thereof. As described herein, the grooves of the plurality of grooves 3340 may also extend diagonally from the toe portion 3230 to the top portion 3270, from the toe portion 3230 to the sole portion 3280, from the top portion 3270 to the sole portion 3280, from the heel portion 3240 to the top portion 3270, from the heel portion 3240 to the sole portion 3280, or a combination thereof. Additionally, or alternatively, the projections of the plurality of projections 3330 and the grooves of the plurality of grooves 3340 may be vertically and/or horizontally configured on the strike portion 3210 of the face portion 3200. For example, at least a portion of the projections of the plurality of projections 3330 may be substantially aligned in one or more horizontal and/or vertical directions across the strike portion 3210 of the face portion 3200. In another example, the projections of the plurality of projections 3330 and the grooves of the plurality of grooves 3340 may have curved configurations on the strike portion 3210 of the face portion 3200. The apparatus, methods, and articles of manufacture described herein are not limited in this regard.

In the example of FIGS. 32-39, the sizes (e.g., volumes) of the plurality of projections 3330 may change in any direction moving from the central strike portion 3285 to the perimeter 3290 of the face portion 3200. In one example, the areas of the peak portions 3420 of the plurality of projections 3330 may successively increase in any direction moving from the central portion 3285 to the perimeter 3290 of the face portion 3200. Additionally, or alternatively, the areas of the base portions 3410 of the plurality of projections 3330 may successively increase in any direction moving from the central strike portion 3285 to the perimeter 3290. Accordingly, a smallest one of the plurality of projections 3330 (e.g., projection 3331) may be located at the central strike portion 3285, and more particularly, at or proximate the geometric center 3286 of the face portion 3200, whereas a largest one of the plurality of projections 3330 may be located farthest from the central strike portion 3285, typically at or proximate the toe edge 3231 and/or the heel edge 3241. The apparatus, methods, and articles of manufacture described herein are not limited in this regard.

Figure 32:
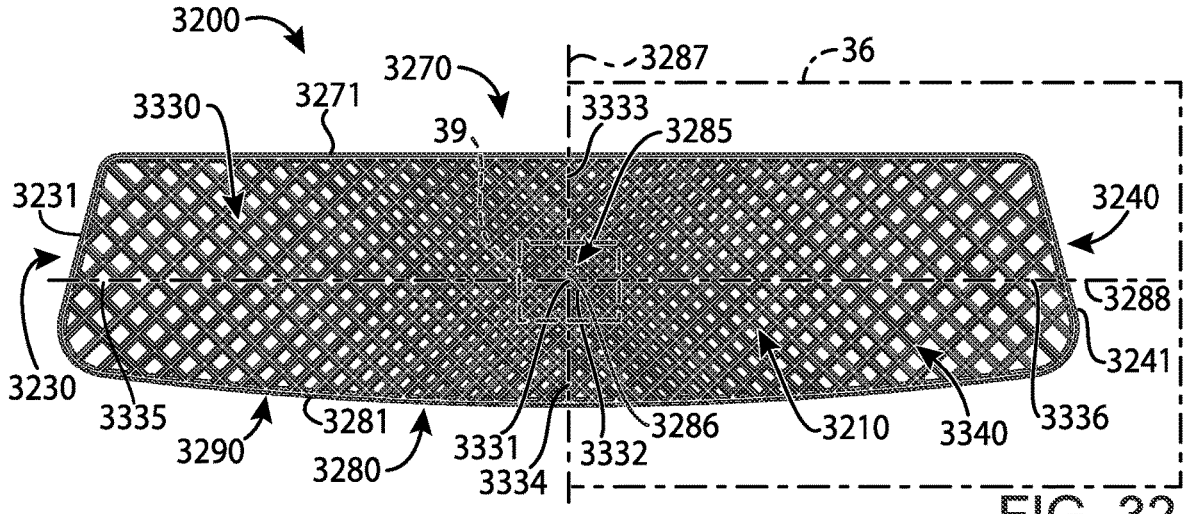
FIG. 32 depicts a front perspective view of a face portion of a golf club head according to an example of the apparatus, methods, and articles of manufacture described herein.
Figure 33:
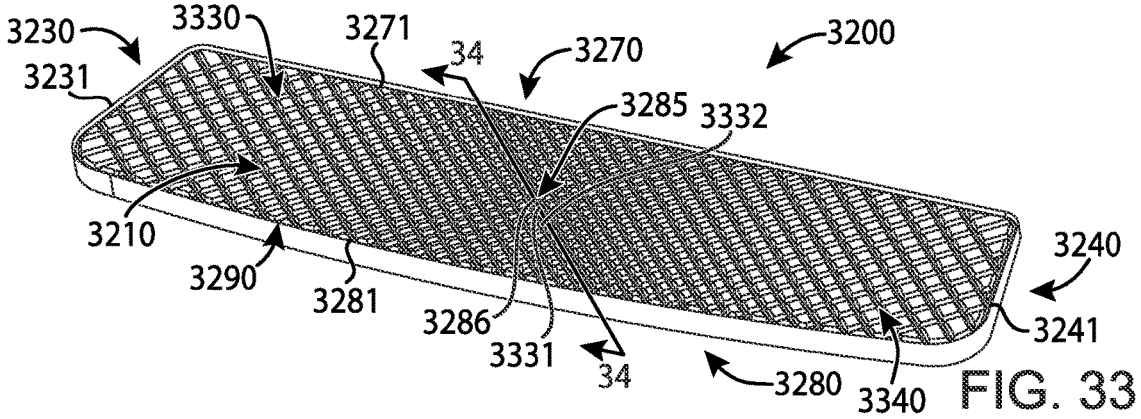
FIG. 33 depicts a side perspective view of the face portion of FIG. 32.

In the example of FIGS. 32-39, at least two projections of the plurality of projections 3330 may have similar sizes if they are located on a line passing through the geometric center 3286 and are equidistant to the geometric center 3286. For purposes of illustration, FIG. 32 shows a vertical centerline axis 3287 extending between the top edge 3271 and the sole edge 3281 and passing through the geometric center 3286. FIG. 32 also shows the horizontal centerline axis 3288 extending between the toe edge 3231 and the heel edge 3241 and passing through the geometric center 3286. At least two projections of the plurality of projections 3330 may have similar sizes due to being located on the vertical centerline axis 3287 and equidistant to the geometric center 3286. For example, the two projections of the plurality of projections 3330 may include a first projection 3333 on the vertical centerline axis 3287 at or proximate the top edge 3271 and a second projection 3334 on the vertical centerline axis 3287 at or proximate the sole edge 3281, the first and second projections 3333 and 3334 being equidistant to the geometric center 3286. Likewise, at least two projections of the plurality of projections 3330 may have similar sizes if they are located on the horizontal centerline axis 3288 and are equidistant to the geometric center 3286. For example, the two projections of the plurality of projections 3330 may include a first projection 3335 on the horizontal centerline axis 3288 at or proximate the toe edge 3231 and a second projection 3336 on the horizontal centerline axis 3288 at or proximate the heel edge 3241, the first and second projections 3335 and 3336 being equidistant to the geometric center 3286. The apparatus, methods, and articles of manufacture described herein are not limited in this regard.

In the example of FIGS. 32-39, each one of the plurality of projections 3330 may be a square or rectangular pyramidal frustum of similar height 3430. The total areas of the base portions 3410 and peak portions 3420 of the plurality of projections 3330 may be approximately 2.15 square inches (1387.09 square millimeters) and 1.04 square inches (670.97 square millimeters), respectively. Accordingly, the total areas of the peak portions 3420 may be less than half the total areas of the base portions 3410. Alternatively, the total areas of the peak portions 3420 may be equal to or greater than half the total areas of the base portions 3410. As described herein, the smallest one of the plurality of projections 3330 (e.g., projection 3331) may be located at the central strike portion 3285 and may be located at or proximate the geometric center 3286 of the face portion 3200. In one example, an area ratio between the base portion 3410 and the peak portion 3420 of the smallest one of the plurality of projections 3330 may be approximately 4.16 or more generally ranging from 4.0 to 5.0. However, area ratios outside the foregoing range are also possible. The largest one of the plurality of projections 3330 on the vertical centerline axis 3287 of the face portion 3200 may be located at or proximate the top edge 3271 and/or the sole edge 3281. For example, the largest one of the plurality of projections 3330 on the vertical centerline axis 3287 may correspond to two projections (e.g., projections 3333 and 3334) equidistant to the geometric center 3286 of the face portion 3200 and oppositely located at or proximate the top edge 3271 and the sole edge 3281, respectively. In one example, the area ratio between the base portion 3410 and the peak portion 3420 belonging to the largest one of the plurality of projections 3330 on the vertical centerline axis 3287 may be approximately 2.68 or more generally ranging from 2.0 to 3.0. However, area ratios outside the foregoing range are also possible. The largest one of the plurality of projections 3330 on the horizontal centerline axis 3288 of the face portion 3200 may be located at or proximate the toe edge 3231 and/or the heel edge 3241. For example, the largest one of the plurality of projections 3330 located on the horizontal centerline axis 3288 may correspond to two projections (e.g., projections 3335 and 3336) equidistant to the geometric center 3286 of the face portion 3200 and oppositely located at or proximate the toe edge 3231 and the heel edge 3241, respectively. In one example, the area ratio between the base portion 3410 and the peak portion 3420 belonging to the largest one of the plurality of projections 3330 on the horizontal centerline axis 3288 may be approximately 1.61 or more generally ranging from 1.0 to 2.0. However, area ratios outside the foregoing range are also possible. Accordingly, the area ratio between the base portion 3410 and the peak portion 3420 of a projection of the plurality of projections 3330 may be inversely related to the size of the projection. In other words, the larger a projection is, the smaller is the area ratio between the base portion 3410 and the peak portion 3420 of the projection. Said differently still, in examples where the base portions 3410 and the peak portions 3420 of the plurality of projections 3330 successively increase in any direction moving from the central strike portion 3285 to the perimeter 3290 of the face portion 3200, the corresponding area ratios between the base portions 3410 and the peak portions 3420 of the plurality of projections 3330 may successively decrease in any direction moving from the central strike portion 3285 to the perimeter 3290. The apparatus, methods, and articles of manufacture described herein are not limited in this regard.

In the example shown in FIGS. 32-39, at least one of the plurality of projections 3330 may be a different size compared to at least one other projection of the plurality of projections 3330 positioned adjacently leftward, rightward, above, below, or at a diagonal with respect thereto. The difference in sizing between two adjacent projections of the plurality of projections 3330 (e.g., projections 3331 and 3332) may result from differences between the areas of their base portions 3410 and/or peak portions 3420. Additionally, or alternatively, the difference in sizing between two adjacent projections of the plurality of projections 3330 may result from differences in height 3430. A change in size between two or more projections of the plurality of projections 3330 successively aligned in a substantially horizontal, vertical, or diagonal direction across the face portion 3200 may be based on a relative proximity between each of the two or more projections of the plurality of projections 3330 and the central strike portion 3285. In one example, the two or more successively aligned projections of the plurality of projections 3330 may successively increase in size in the substantially horizontal, vertical, or diagonal direction moving from the central strike portion 3285 to the perimeter 3290. In one example, Accordingly, the largest one of the plurality of projections 3330 may be located farthest from the central strike portion 3285, generally at or about the perimeter 3290 of the face portion 3200, and more particularly, at or proximate the toe edge 3231 or the heel edge 3241 of the face portion 3200. The apparatus, methods, and articles of manufacture described herein are not limited in this regard.

In one example, two or more of the plurality of projections 3330 may be similar or substantially similar in height such that the peak portions 3420 associated therewith may each provide a ball striking surface. In another example, the plurality of projections 3330 may increase in height 3430 in one or more directions moving from the central strike portion 3285 to the perimeter 3290 of the face portion 3200. In yet another example, the plurality of projections 3330 may decrease in height in one or more directions moving from the central strike portion 3285 to the perimeter 3290. In yet another example, the plurality of projections 3330 may increase, decrease, or otherwise vary in height in one or more directions on the face portion 3200. Accordingly, the depths 3441 of the plurality of grooves 3340 may vary based on the heights 3430 of the plurality of projections 3330, or vice versa. The apparatus, methods, and articles of manufacture described herein are not limited in this regard.

In the example of FIGS. 32-39, a rate of change of the areas of the peak portions 3420 and/or base portions 3410 of the plurality of projections 3330 may be similar in a direction moving from the central strike portion 3285 to the toe edge 3231 and in a direction moving from the central strike portion 3285 to the heel edge 3241. In another example, the rate of change of the areas of the peak portions 3420 and/or base portions 3410 of the plurality of projections 3330 may be similar in a direction moving from the central strike portion 3285 to the top edge 3271 and in a direction moving from the central strike portion 3285 to the sole edge 3281. In yet another example, the rate of change of the areas of the peak portions 3420 and/or base portions 3410 of the plurality projections 3330 may be similar in a direction moving from the central strike portion 3285 to the toe edge 3231, in a direction moving from the central strike portion 3285 to the heel edge 3241, in a direction moving from the central strike portion 3285 to the top edge 3271, and in a direction moving from the central strike portion 3285 to the sole edge 3281. In yet another example, the rate of change of the areas of the peak portions 3420 and/or base portions 3410 of the plurality of projections 3330 may be similar and/or vary in any direction (e.g., horizontal, vertical, diagonal, etc.) moving from the central strike portion 3285 to any location on the perimeter 3290. The apparatus, methods, and articles of manufacture described herein are not limited in this regard.

In one example, the change in areas of the peak portions 3420 and/or base portions 3410 of the plurality of projections 3330 in one or more directions moving from the central strike portion 3285 to the perimeter 3290 of the face portion 3200 may be a function of a distance between the location of the plurality of projections 3330 on the face portion 3200 and the central strike portion 3285. Accordingly, the areas of the peak portions 3420 and/or base portions 3410 of the plurality of projections 3330 may successively increase moving from the central strike portion 3285 to the perimeter 3290 according to a function based on the distance of the projections 3330 from the central strike portion 3285. In one example, the change in areas of the peak portions 3420 and/or base portions 3410 of the plurality of projections 3330 in one or more directions moving from the central strike portion 3285 to the perimeter 3290 of the face portion 3200 may be a linear function of a distance between the location of the plurality of projections 3330 on the face portion 3200 and the central strike portion 3285. In another example, the change in areas of the peak portions 3420 and/or base portions 3410 of the plurality of projections 3330 in one or more directions moving from the central strike portion 3285 to the perimeter 3290 of the face portion 3200 may be a polynomial function (e.g., a quadratic function or cubic function) of a distance between the location of the plurality of projections 3330 on the face portion 3200 and the central strike portion 3285. The areas of the peak portions 3420 and/or base portions 3410 may vary from the central strike portion 3285 to the toe portion 3230, the heel portion 3240, the top portion 3270, and/or the sole portion 3280 according to any relationship based on any physical property of the face portion 3200 and/or any physical property of a portion of the face portion 3200 (e.g., a location on the face portion 3200) relative to the central strike portion 3285. The apparatus, methods, and articles of manufacture described herein are not limited in this regard.

In the example of FIGS. 32-39, the change in areas of the peak portions 3420 and/or base portions 3410 of the plurality of projections 3330 in one or more directions moving from the central strike portion 3285 to the perimeter 3290 may be defined by the change in a distance 3444 (FIG. 37) between successive grooves of the first plurality of grooves 3740 extending in the first direction and between successive grooves of the second plurality of grooves 3750 extending in the second direction. In one example, the distance 3444 between successive grooves of the first and second plurality of grooves 3740 and 3750 may successively increase in any direction moving from the central strike portion 3285 to the perimeter 3290 of the face portion 3200. In other words, the distance 3444 between successive grooves of the first and second plurality of grooves 3740 and 3750 may successively increase moving from the central strike portion 3285 to the toe edge 3231, from the central strike portion 3285 to the heel edge 3241, moving from the central strike portion 3285 to the top edge 3271, and moving from the central strike portion 3285 to the sole edge 3281. In one example, the distance 3444 between successive grooves of the first and second plurality of grooves 3740 and 3750 may increase linearly from the central strike portion 3285 to the perimeter 3290 of the face portion 3200. The distance 3444 between successive grooves of the first and second plurality of grooves 3740 and 3750 may be a linear function of a distance between the location of the first and second plurality of grooves 3740 and 3750 on the face portion 3200 and the central strike portion 3285. In another example, the distance 3444 between successive grooves of the first and second plurality of grooves 3740 and 3750 may be a polynomial function (e.g., a quadratic function or cubic function) of a distance between the location of the first and second plurality of grooves 3740 and 3750 on the face portion 3200 and the central strike portion 3285. In another example, the distance 3444 between successive grooves of the first and second plurality of grooves 3740 and 3750 may successively increase in one or more directions moving from the central strike portion 3285 toward the perimeter 3290 of the face portion 3200. In other words, the distance 3444 between successive grooves of the first and second plurality of grooves 3740 and 3750 may successively increase in one or more of the following directions: from the central strike portion 3285 to the toe edge 3231, from the central strike portion 3285 to the heel edge 3241, from the central strike portion 3285 to the top edge 3271, and from the central strike portion 3285 to the sole edge 3281. In yet another example, the distance 3444 between successive grooves of the first and second plurality of grooves 3740 and 3750 may successively increase at a similar or different rate in one or more directions moving from the central strike portion 3285 toward the perimeter 3290 of the face portion 3200. Accordingly, the change in the distance 3444 between successive grooves of the first and second plurality of grooves 3740 and 3750 located at or proximate to the toe portion 3230, at or proximate to the heel portion 3240, at or proximate to the top portion 3270, and/or at or proximate to the sole portion 3280 may be similar or may vary. The apparatus, methods, and articles of manufacture described herein are not limited in this regard.

Figure 39:
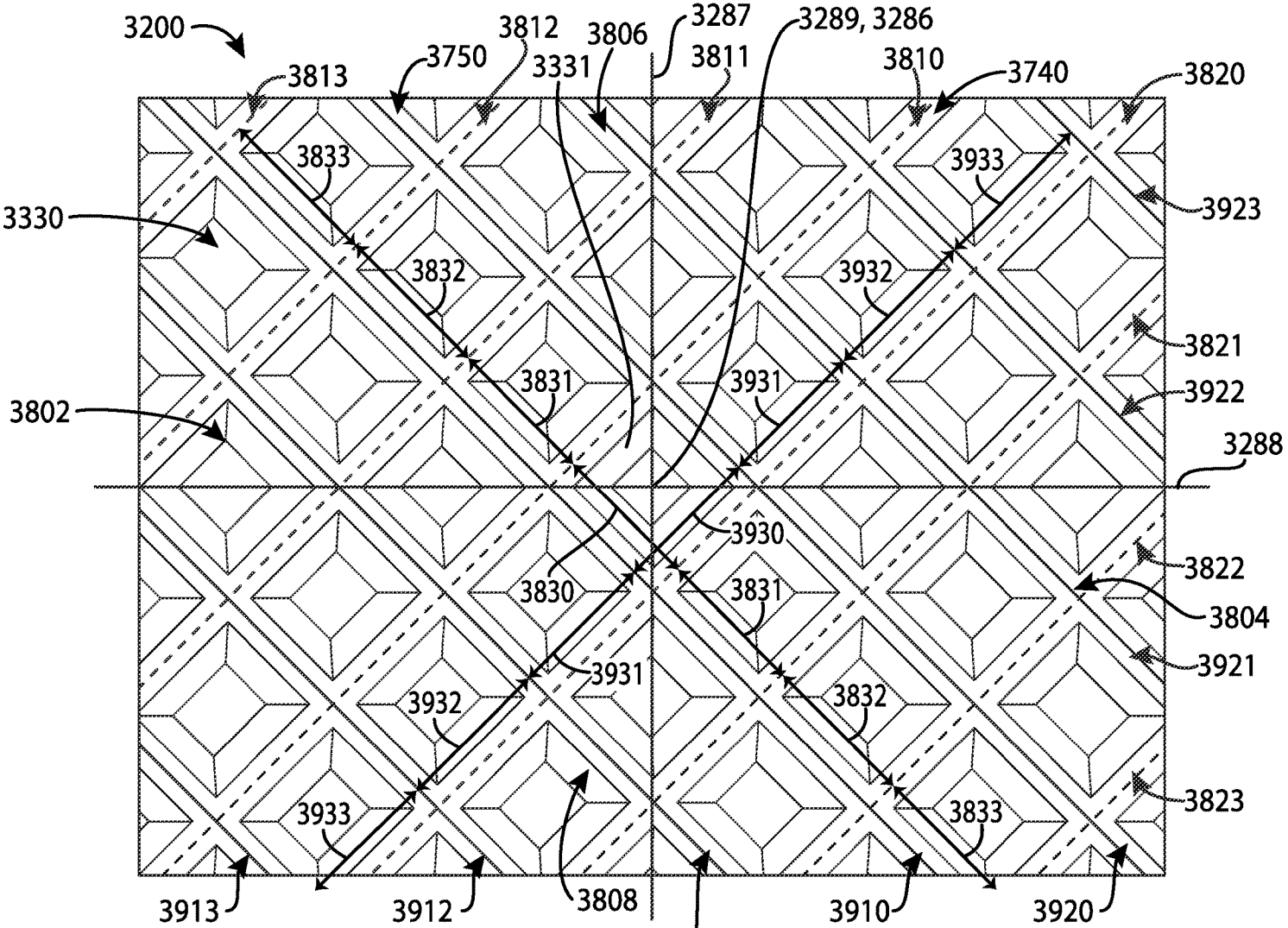
FIG. 39 depicts an enlarged view of area 39 of the face portion of FIG. 32.

In the example of FIG. 39, the center longitudinal axes of the first plurality of grooves 3740 are represented by broken lines, whereas the center longitudinal axes of the second plurality of grooves 3750 are represented by solid lines. As described herein, the first plurality of grooves 3740 and the second plurality of grooves 3750 may have the same width and/or depth. Additionally, the first plurality of grooves 3740 may be parallelly or substantially parallelly arranged with each other and may extend diagonally across the face portion 3200. The second plurality of grooves 3750 may be parallelly arranged with each other and may extend diagonally across the face portion 3200 in a transverse direction to the first plurality of grooves 3740. In other words, the first plurality of grooves 3740 and the second plurality of grooves 3750 may crisscross. The grooves of the first and second plurality of grooves 3740 and 3750 may each extend at a 45 degree angle or approximately 45 degree angle relative to both the vertical centerline axis 3287 and the horizontal centerline axis 3288. The vertical centerline axis 3287 may bisect the face portion 3200 into a toe-ward zone 3802 and a heel-ward zone 3804, while the horizontal centerline axis 3288 may bisect the face portion 3200 into a top-ward zone 3806 and a sole-ward zone 3808. The vertical centerline axis 3287 may intersect the horizontal centerline axis 3288 at intersection point 3289, which may coincide with the geometric center 3286 of the face portion 3200. The intersection point 3289 may not coincide with the geometric center of the face portion 3200. As defined herein, the toe-ward zone 3802 may encompass some or all of the area of the face portion 3200 between the vertical centerline axis 3287 and the toe edge 3231, the heel-ward zone 3804 may encompass some or all of the area of the face portion 3200 between the vertical centerline axis 3287 and the heel edge 3241, the top-ward zone 3806 may encompass some or all of the area of the face portion 3200 between the horizontal centerline axis 3288 and the top edge 3271, and the sole-ward zone 3808 may encompass some or all of the area of the face portion 3200 between the horizontal centerline axis 3288 and the sole edge 3281. Accordingly, the toe-ward, heel-ward, top-ward, and sole-ward zones 3802, 3804, 3806, and 3808 may collectively define part of the face portion 3200 or an entirety thereof. The apparatus, methods, and articles of manufacture described herein are not limited in this regard.

The first plurality of grooves 3740 may include two successive grooves 3810 and 3820 located equidistant from intersection point 3289. Groove 3810 may intersect the vertical centerline axis 3287 in the top-ward zone 3806 and may intersect the horizontal centerline axis 3288 in the toe-ward zone 3802. In contrast, groove 3820 may intersect the vertical centerline axis 3287 in the sole-ward zone 3808 and may intersect the horizontal centerline axis 3288 in the heel-ward zone 3804. The second plurality of grooves 3750 may also include two successive grooves 3910 and 3920 located equidistant from intersection point 3289. Groove 3910 may intersect the vertical centerline axis 3287 in the sole-ward zone 3808 and may intersect the horizontal centerline axis 3288 in the toe-ward zone 3802. In contrast, groove 3920 may intersect the vertical centerline axis 3287 in the top-ward zone 3806 and may intersect the horizontal centerline axis 3288 in the heel-ward zone 3804. In such an arrangement, successive grooves 3810 and 3820 of the first plurality of grooves 3740 may intersect successive grooves 3910 and 3920 of the second plurality of grooves 3750 to define a projection (e.g., projection 3331) centered at the intersection point 3289. The size of projection 3331 may be based on a spacing Do (e.g., represented by bidirectional arrow 3830) between successive grooves 3810 and 3820 and a spacing do (e.g., represented by bidirectional arrow 3930) between successive grooves 3910 and 3920. The spacing Do between successive grooves 3810 and 3820 may be equal or substantially equal to the spacing do between successive grooves 3910 and 3920. Alternatively, the spacing Do between successive grooves 3810 and 3820 may be greater than or less than the spacing do between successive grooves 3910 and 3920. Accordingly, the individual sizes of the plurality of projections 3330 may be determined based on the spacings of the first plurality of grooves 3740 and the spacings of the second plurality of grooves 3750. In one example, each of the plurality of projections 3330 may correspond to a raised structure enclosed by two successive grooves of the first plurality of grooves 3740 and two successive grooves of the second plurality of grooves 3750 intersecting therewith. As used herein, the term "spacing" may correspond to a distance between the center longitudinal axes of two successive grooves of the first plurality of grooves 3740 or the second plurality of grooves 3750. The apparatus, methods, and articles of manufacture described herein are not limited in this regard.

In the example of FIG. 39, the first plurality of grooves 3740 may include a first toe-ward succession of grooves and a first heel-ward succession of grooves. The first toe-ward succession of grooves may include groove 3810 and a number of grooves (e.g., shown as grooves 3811, 3812, and 3813) spaced between groove 3810 and the toe edge 3231 of the face portion 3200. The first heel-ward succession of grooves may include groove 3820 and a number of grooves (e.g., shown as grooves 3821, 3822, and 3823) spaced between groove 3820 and the heel edge 3241 of the face portion 3200. Accordingly, the first toe-ward succession of grooves may include a number of the first plurality of grooves 3740 intersecting the horizontal centerline axis 3288 in the toe-ward zone 3802 whereas the first heel-ward succession of grooves may include a number of the first plurality of grooves 3740 intersecting the horizontal centerline axis 3288 in the heel-ward zone 3804. The spacings of the first toe-ward succession of grooves and the first heel-ward succession of grooves of the first plurality of grooves 3740 may be provided by the following linear equation:

$$D_n = A + nB \tag{1}$$

Where:

$D_n$ is the spacing between successive grooves n and n−1 of the first toe-ward succession of grooves and the first heel-ward succession of grooves;

A and B are predetermined values; and n is an integer starting at 1 and designating a groove based on the groove's order relative to groove 3810 if the groove is in the first toe-ward succession of grooves, or relative groove 3820 if the groove is in the first heel-ward succession of grooves.

With respect to equation 1, the values of A and B may be selected based on a desired spacing between successive grooves of the first toe-ward succession of grooves and between successive grooves of the first heel-ward succession of grooves. Generally, smaller values of A and B will result in successive grooves being spaced closer together whereas larger values of A and B will result in successive grooves being spaced farther apart. The spacing Do between successive grooves 3810 and 3820 may be predetermined independently of equation 1. In the example of FIG. 39, A may be 0.042 inch (0.10668 centimeter) or approximately 0.042 inch and B may be 0.0025 inch or approximately 0.0025 inch (0.00635 centimeter). $D_0$ may be equal to or substantially equal to A. Alternatively, $D_0$ may be greater than or less than A. Accordingly, once $D_0$ has been selected, equation 1 may be iterated n number of times to determine the spacings for grooves n=1 and onward. In the present example, n=1 designates grooves 3811 and 3821 by virtue of grooves 3811 and 3821 being the first grooves moving away from grooves 3810 and 3820 toward the toe edge 3231 and the heel edge 3241, respectively. In like manner, n=2 designates grooves 3812 and 3822, n=3 designates grooves 3813 and 3823, and so on for however many grooves are in the first toe-ward succession of grooves and the first heel-ward succession of grooves. Computing equation 1 for each value of n results in a spacing $D_1$ (e.g., represented by bidirectional arrow 3831) between successive grooves 3810 and 3811 and between successive grooves 3820 and 3821 of 0.0445 inch (0.11303 centimeter) or approximately 0.0445 inch, a spacing $D_2$ (e.g., represented by bidirectional arrow 3832) between successive grooves 3811 and 3812 and between successive grooves 3821 and 3822 of 0.047 inch (0.11938 centimeter) or approximately 0.047 inch, and a spacing $D_3$ (e.g., represented by bidirectional arrow 3833) between successive grooves 3812 and 3813 and between successive grooves 3822 and 3823 of 0.0495 inch (0.12573 centimeter) or approximately 0.0495 inch. Accordingly, the first toe-ward succession of grooves may be spaced apart at different distances and the first heel-ward succession of grooves may also be spaced apart at different distances. More specifically, the first toe-ward succession of grooves may be increasingly spaced apart moving from groove 3810 toward the toe edge 3231 and the first heel-ward succession of grooves may be increasingly spaced apart moving from groove 3820 toward the heel edge 3241. As a result, the first toe-ward succession of grooves may be spaced closer together toward groove 3810 and spaced farther apart toward the toe edge 3231, and the first heel-ward succession of grooves may be spaced closer together toward groove 3820 and spaced farther apart toward the heel edge 3241. In the example of FIG. 39, the first toe-ward succession of grooves are increasingly spaced apart at a same rate or approximately the same rate as the first heel-ward succession of grooves. Specifically, the first toe-ward succession of grooves and the first heel-ward succession of grooves are increasingly spaced apart by a fixed value corresponding to the value of B (e.g., 0.0025 inch (0.00635 centimeter)) of equation 1, that is, $D_0+B=D_1$, $D_1+B=D_2$, $D_2+B=D_3$, $D_3$ $B=D_4$, and so on (i.e., $D_n+B=D_{n+1}$) with $D_0$ being equal to or substantially equal to A for the example of FIG. 39. In alternative examples, equation 1 may be used to first determine only the spacings of the first toe-ward succession of grooves and may be used again (e.g., with different values of A and/or B) to determine only the spacings of the first heel-ward succession of grooves. Doing so results in the first toe-ward succession of grooves becoming increasingly spaced apart at a different rate than the first heel-ward succession of grooves. The apparatus, methods, and articles of manufacture described herein are not limited in this regard.

In the example of FIG. 39, the second plurality of grooves 3750 may include a second toe-ward succession of grooves and a second heel-ward succession of grooves. The second toe-ward succession of grooves may include groove 3910 and a number of grooves (e.g., shown as grooves 3911, 3912, and 3913) spaced between groove 3910 and the toe edge 3231 of the face portion 3200. The second heel-ward succession of grooves may include groove 3920 and a number of grooves (e.g., shown as 3921, 3922, and 3923) spaced between groove 3920 and the heel edge 3241 of the face portion 3200. Accordingly, the second toe-ward succession of grooves may include a number of the second plurality of grooves 3750 intersecting the horizontal centerline axis 3288 in the toe-ward zone 3802 whereas the second heel-ward succession of grooves may include a number of the second plurality of grooves 3750 intersecting the horizontal centerline axis 3288 in the heel-ward zone 3804. The spacings of the second toe-ward succession of grooves and the second heel-ward succession of grooves of the second plurality of grooves 3750 may be provided by the following linear equation:

$$d_n=C+nE \tag{2}$$

Where:

$d_n$ is the spacing between successive grooves n and n−1 of the second toe-ward succession of grooves and the second heel-ward succession of grooves;

C and E are predetermined values; and n is an integer starting at 1 and designating a groove based on the groove's order relative to groove 3910 if the groove is in the second toe-ward succession of grooves, or relative groove 3920 if the groove is in the second heel-ward succession of grooves.

With respect to equation 2, the values of C and E may be selected based on a desired spacing between successive grooves of the second toe-ward succession of grooves and between successive grooves of the second heel-ward succession of grooves. Generally, smaller values of C and E will result in successive grooves being spaced closer together whereas larger values of C and E will result in successive grooves being spaced further apart. The spacing $d_0$ between successive grooves 3910 and 3920 may be predetermined independently of equation 2. In the example of FIG. 39, C may be the same value as A (e.g., 0.042 inch (0.10668 centimeter)) and E may be the same value as B (0.0025 inch (0.00635 centimeter)). Like $D_0$, the spacing $d_0$ between successive grooves 3910 and 3920 may be predetermined independently of equation 1. In the present example, the spacing $d_0$ between successive grooves 3910 and 3920 may be selected to mirror the spacing $D_0$ between successive grooves 3810 and 3820 of the first plurality of grooves 3740. Accordingly, in the example of FIG. 39, $d_0=D_0=A=C$. The selected values of $D_0$ and $d_0$ will determine the size of projection 3331 relative to the other projections of the plurality of projections 3330. Accordingly, projection 3331 may be the single smallest projection, one of a number of smallest projections, or larger than one or more projections of the plurality of projections 3330. Once do has been selected, equation 2 may be iterated n number of times to determine the spacings for groove numbers of n=1 and onward. In the present example, n=1 designates grooves 3911 and 3921 by virtue of grooves 3911 and 3921 being the first grooves moving away from grooves 3910 and 3920 toward the toe edge 3231 and the heel edge 3241, respectively. In like manner, n=2 designates grooves 3912 and 3922, n=3 designates grooves 3913 and 3923, and so on for however many grooves are in the second toe-ward succession of grooves and the second heel-ward succession of grooves. Computing equation 2 for each value of n results in a spacing $d_1$ (e.g., represented by bidirectional arrow 3931) between successive grooves 3910 and 3911 and between successive grooves 3920 and 3921 of 0.0445 inch (0.11303 centimeter) or approximately 0.0445 inch, a spacing $d_2$ (e.g., represented by bidirectional arrow 3932) between successive grooves 3911 and 3912 and between successive grooves 3921 and 3922 of 0.047 inch (0.11938 centimeter) or approximately 0.047 inch, and a spacing $d_3$ (e.g., represented by bidirectional arrow 3933) between successive grooves 3912 and 3913 and between successive grooves 3922 and 3923 of 0.0495 inch (0.12573 centimeter) or approximately 0.0495 inch. Accordingly, the second toe-ward succession of grooves may be spaced apart at different distances and the second heel-ward succession of grooves may also be spaced apart at different distances. More specifically, the second toe-ward succession of grooves may be increasingly spaced apart moving from groove 3910 toward the toe edge 3231 and the second heel-ward succession of grooves may be increasingly spaced apart moving from groove 3920 toward the heel edge 3241. As a result, the second toe-ward succession of grooves may be spaced closer together toward groove 3910 and spaced farther apart toward the toe edge 3231, and the second heel-ward succession of grooves may be spaced closer together toward groove 3920 and spaced farther apart toward the heel edge 3241. In the example of FIG. 39, the second toe-ward succession of grooves are increasingly spaced apart at a same rate or approximately the same rate as the second heel-ward succession of grooves. Specifically, the second toe-ward succession of grooves and the second heel-ward succession of grooves are increasingly spaced apart by a fixed value corresponding to the value of E (e.g., 0.0025 inch (0.00635 centimeter)) of equation 2, that is, $d_0+B=d_1$, $d_1+E=d_2$, $d_2+E=d_3$, $d_3+E=d_4$, and so on (i.e., $d_n+E=_{n+1}$) with $d_0$ being equal to or substantially equal to C for the example of FIG. 39. In alternative examples, equation 2 may be used to first determine only the spacings of the second toe-ward succession of grooves and may be used again (e.g., with different values of C and/or E) to determine only the spacings of the second heel-ward succession of grooves. Doing so results in the second toe-ward succession of grooves becoming increasingly spaced apart at a different rate than the second heel-ward succession of grooves. In the present example, the rate of change in the spacings of the second plurality of grooves 3750 may mirror the rate of change in the spacings of the first plurality of grooves 3740. In alternative examples, the rate of change in the spacings of the second plurality of grooves 3750 may be different than the rate of change in the spacings of the first plurality of grooves 3740. The apparatus, methods, and articles of manufacture described herein are not limited in this regard.

In the example of FIG. 39, the spacings of the first plurality of grooves 3740 in conjunction with the spacings of the second plurality of grooves 3750 may result in the plurality of projections 3330 becoming increasingly larger in size moving outwardly away from projection 3331 in any and all radial directions toward the perimeter 3290 of the face portion 3200. Said differently, the plurality of projections 3330 may become increasingly larger in size pursuant to a circular ripple pattern spreading outwardly away from projection 3331 toward the toe edge 3231, the heel edge 3241, the top edge 3271, and the sole edge 3281 of the face portion 3200. The apparatus, methods, and articles of manufacture described herein are not limited in this regard.

While equations 1 and 2 are described as linear equations, one or both of equations 1 and 2 may be alternatively expressed as a polynomial equation. Additionally or alternatively, one or both of equations 1 and 2 may be rewritten as a subtraction operation instead of an addition operation. In this manner, the first toe-ward succession of grooves and the first heel-ward succession of grooves of the first plurality of grooves 3740 and/or the second toe-ward succession of grooves and the second heel-ward succession of grooves of the second plurality of grooves 3750 may be decreasingly spaced apart moving outwardly away from central strike portion 3285 toward the toe edge 3231 and the heel edge 3241 of the face portion 3200. As a result, the plurality of projections 3330 may become decreasingly smaller spreading outwardly away from projection 3331 toward the toe edge 3231, the heel edge 3241, the top edge 3271, and the sole edge 3281 of the face portion 3200. However, it is generally preferable to space the first and second plurality of grooves 3740 and 3750 such that the plurality of projections 3331 become increasingly larger spreading outwardly away from projection 3331. Additionally, it is generally preferable to configure the first and second plurality of grooves 3740 and 3750 with the same width so that the plurality of projections 3330 are evenly spaced apart while becoming increasingly larger moving outwardly away from projection 3331. Accordingly, the face portion 3200 or strike face may have a gradual increase in surface area away from the central strike portion 3285 toward the toe edge 3231, the heel edge 3241, the top edge 3271, and the sole edge 3281. Advantageously, the increasingly larger surface areas of the plurality of projections 3330 toward the perimeter 3290 may reduce energy loss caused by the gearing effect when a golf ball is mishit (e.g., struck away from the central strike portion 3285). Meanwhile, the relatively smaller surface areas of the plurality of projections 3330 at the central strike portion 3285 limit contact with a golf ball, which may enhance sound, feel, and responsiveness when a golf ball is struck at the center strike portion 3285. Collectively, the smaller projections at the central strike portion 3285 and the increasingly larger projections toward the perimeter 3290 may normalize ball speed across the face portion 3200 such that a more consistent roll (e.g., distance and speed) may be achieved regardless of where a golf ball is struck on the face portion 3200. The apparatus, methods, and articles of manufacture described herein are not limited in this regard.

While the example of the face portion 3200 shown in FIGS. 32-39 generally includes a plurality of projections 3330 increasing in size in any direction moving from the central strike portion 3285 to the perimeter 3290 of the face portion 3200, other examples (not shown) of the face portion 3200 may feature the plurality of projections 3330 decreasing in size in any direction moving from the central strike portion 3285 to the perimeter 3290 of the face portion 3200. For instance, the areas of the peak portions 3420 and/or base portions 3410 may successively decrease in any direction moving from the central portion 3285 to the perimeter 3290 of the face portion 3200. Accordingly, a largest one of the plurality of projections 3330 may be located at the central strike portion 3285, and more particularly, at or proximate the geometric center 3286 of the face portion 3200, whereas a smallest one of the plurality of projections 3330 may be located at or proximate the toe edge 3231 and/or the heel edge 3241. The apparatus, methods, and articles of manufacture described herein are not limited in this regard.

A rate of change of the areas of the peak portions 3420 and/or base portions 3410 of the plurality of projections 3330 may be similar in a direction moving from the central strike portion 3285 to the toe edge 3231 and in a direction moving from the central strike portion 3285 to the heel edge 3241. In another example, the rate of change of the areas of the peak portions 3420 and/or base portions 3410 of the plurality of projections 3330 may be similar in a direction moving from the central strike portion 3285 to the top edge 3271 and in a direction moving from the central strike portion 3285 to the sole edge 3281. In yet another example, the rate of change of the areas of the peak portions 3420 and/or base portions 3410 of the plurality of projections 3330 may be similar in a direction moving from the central strike portion 3285 to the toe edge 3231, in a direction moving from the central strike portion 3285 to the heel edge 3241, in a direction moving from the central strike portion 3285 to the top edge 3271, and in a direction moving from the central strike portion 3285 to the sole edge 3281. In yet another example, the rate of change of the areas of the peak portions 3420 and/or base portions 3410 of the plurality of projections 3330 may be similar and/or vary in any direction (i.e., horizontal, vertical, diagonal, etc.) moving from the central strike portion 3285 to any location on the perimeter 3290. The change in areas of the peak portions 3420 and/or base portions 3410 of the plurality of projections 3330 from the central strike portion 3285 to the perimeter 3290 of the face portion 3200 may be a linear or polynomial function (e.g., a quadratic function or cubic function) of a distance between the location of the plurality of projections 3330 on the face portion 3200 and the central strike portion 3285. Additionally, or alternatively, the plurality of projections 3330 may decrease in height 3430 at a fixed or variable rate from the central strike portion 3285 to the perimeter 3290 of the face portion 3200. The apparatus, methods, and articles of manufacture described herein are not limited in this regard.

The change in areas of the peak portions 3420 and/or base portions 3410 of the plurality of projections 3330 from the central strike portion 3285 to the perimeter 3290 may be defined by the change in the distance 3444 between successive grooves of the first plurality of grooves 3740 extending in the first direction and between successive grooves of the second plurality of grooves 3750 extending in the second direction. In one example, the distance 3444 between successive grooves of the first and second plurality of grooves 3740 and 3750 may successively decrease in any direction moving from the central strike portion 3285 to the perimeter 3290 of the face portion 3200. In other words, the distance 3444 between successive grooves of the first and second plurality of grooves 3740 and 3750 may successively decrease moving from the central strike portion 3285 to the toe edge 3231, moving from the central strike portion 3285 to the heel edge 3241, moving from the central strike portion 3285 to the top edge 3271, and moving from the central strike portion 3285 to the sole edge 3281. The distance 3444 between successive grooves of the first and second plurality of grooves 3740 and 3750 may be a linear or polynomial function (e.g., a quadratic function or cubic function) of a distance between the location of the first and second plurality of grooves 3740 and 3750 on the face portion 3200 and the central strike portion 3285. In another example, the distance 3444 between successive grooves of the first and second plurality of grooves 3740 and 3750 may successively decrease in any direction moving from the central strike portion 3285 toward the perimeter 3290 of the face portion 3200. In other words, the distance 3444 between successive grooves of the first and second plurality of grooves 3740 and 3750 may successively decrease in one or more of the following directions: from the central strike portion 3285 to the toe edge 3231, from the central strike portion 3285 to the heel edge 3241, from the central strike portion 3285 to the top edge 3271, and from the central strike portion 3285 to the sole edge 3281. The distance 3444 between successive grooves of the first and second plurality of grooves 3740 and 3750 may successively decrease at a similar or different rate in one or more directions moving from the central strike portion 3285 toward the perimeter 3290 of the face portion 3200. Accordingly, the decrease in the distance 3444 between successive grooves of the first and second plurality of grooves 3740 and 3750 located at or proximate to the toe portion 3230, at or proximate to the heel portion 3240, at or proximate to the top portion 3270, and/or at or proximate to the sole portion 3280 may be similar or vary. The apparatus, methods, and articles of manufacture described herein are not limited in this regard.

Figure 40:
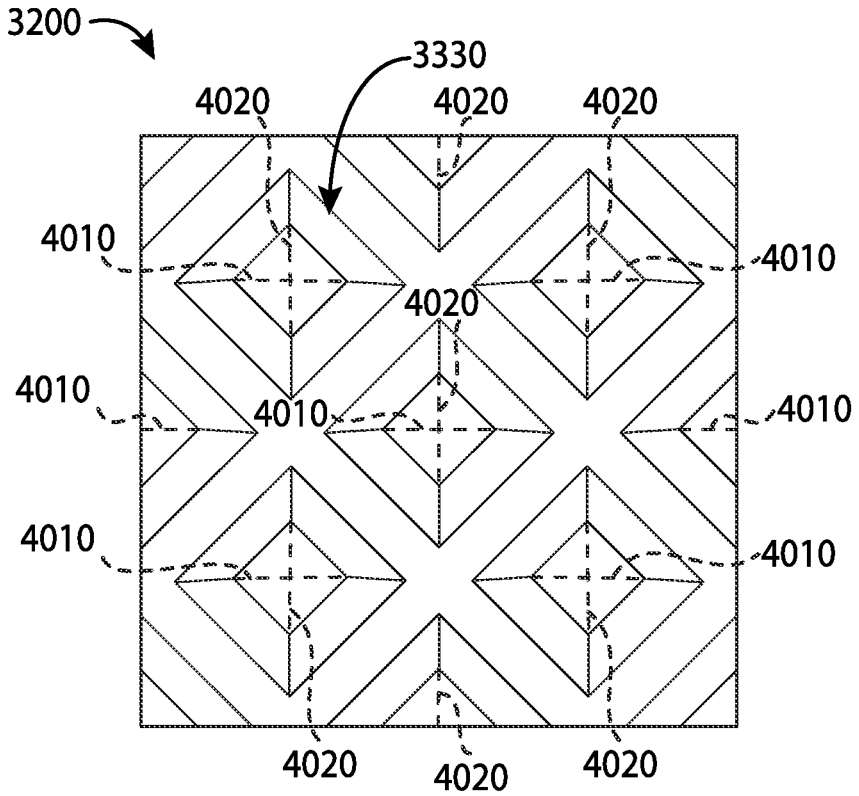
FIG. 40 depicts an alternative face pattern for a face portion of a golf club.
Figure 41:
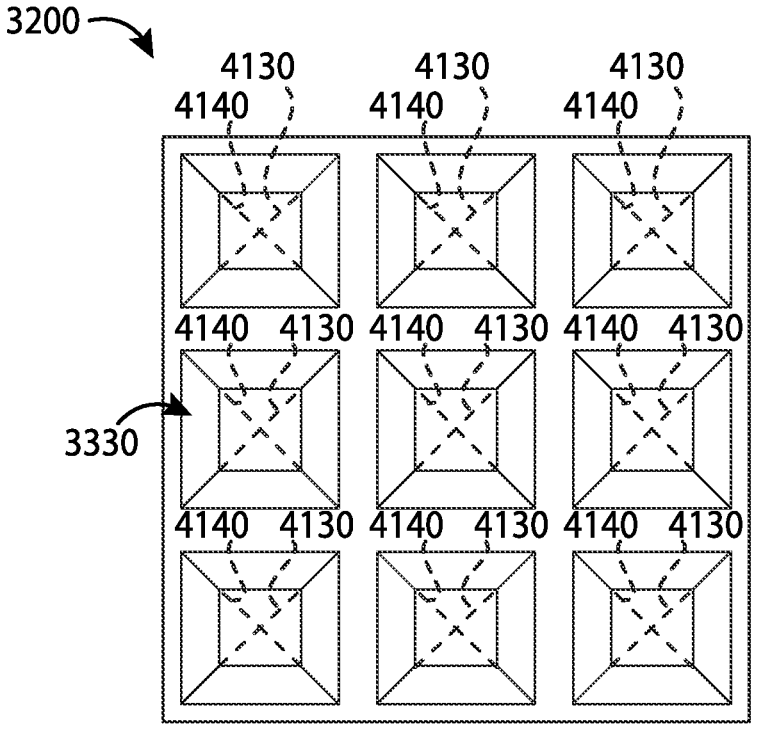
FIG. 41 depicts another alternative face pattern for a face portion of a golf club.

In the examples of FIGS. 40-41, alternative face patterns are shown. The face pattern of FIG. 40 may be similar to the example of FIG. 39 with the exception of one or more horizontal grooves 4010 bisecting one or more of the plurality of projections 3330. Additionally or alternatively, the face pattern may include one or more vertical grooves 4020 bisecting one or more of the plurality of projections 3330. In this configuration, one or more of the plurality of projections 3330 may be divided in half or in quarters. In the example of FIG. 41, the face pattern may be similar to the example of FIG. 39 except rotated 45 degrees counterclockwise. The face pattern may also include one or more diagonal grooves 4130 extending upwardly from left-to-right across the face portion 3200 and bisecting one or more of the plurality of projections 3330. Additionally or alternatively, the face pattern may include one or more diagonal grooves 4140 extending upwardly from right-to-left across the face portion 3200 and bisecting one or more of the plurality of projections 3330. In this configuration, one or more of the plurality of projections 3330 may be divided in half or in quarters. The apparatus, methods, and articles of manufacture described herein are not limited in this regard.

Figure 42:
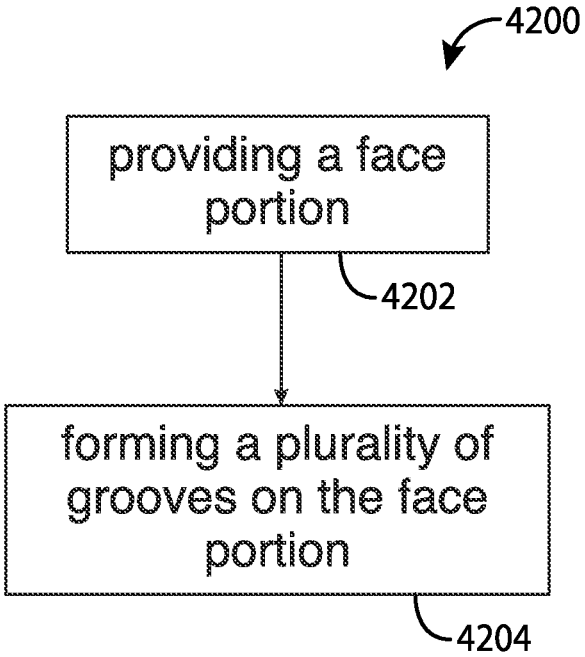
FIG. 42 depicts a method of manufacturing a face portion according to an example of the apparatus, methods and articles of manufacture described herein.
Figure 43:
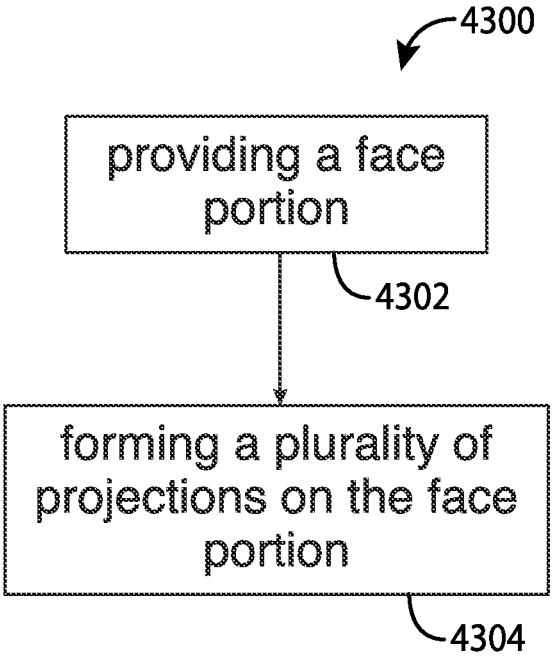
FIG. 43 depicts another method of manufacturing a face portion according to an example of the apparatus, methods and articles of manufacture described herein.
Figure 44:
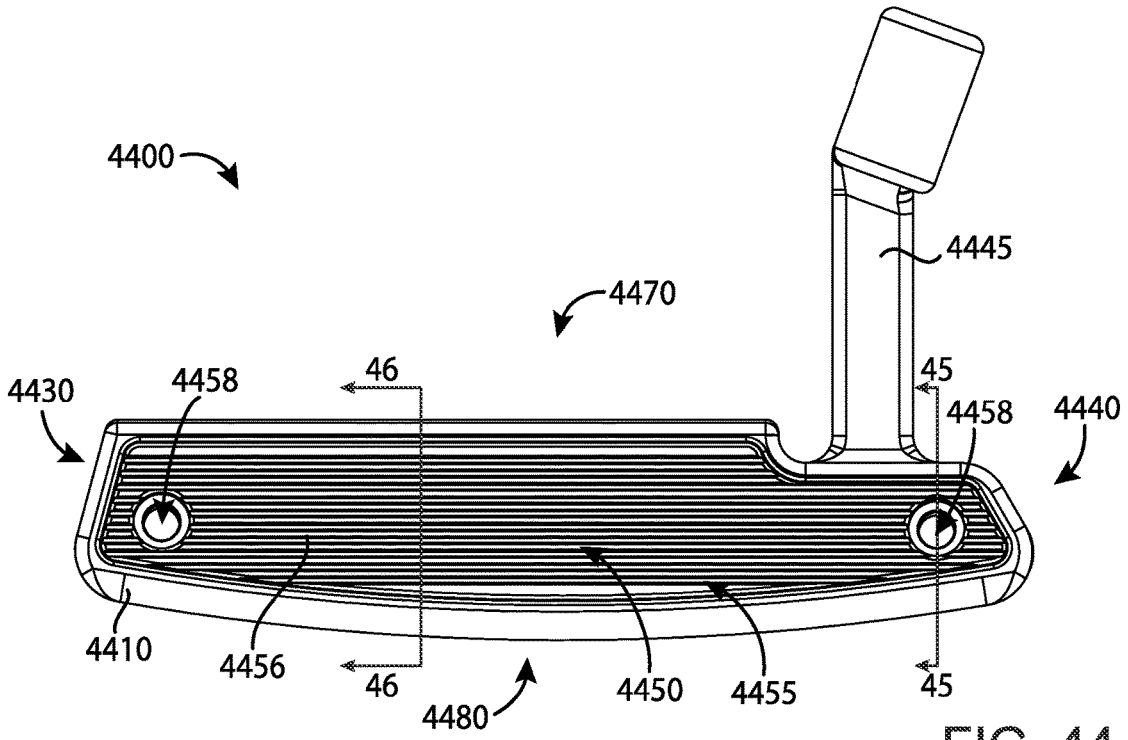
FIG. 44 depicts a front view of a golf club head according to another example of the apparatus, methods, and articles of manufacture described herein.

In one example, as shown in FIG. 42, a process 4200 of manufacturing the face portion 3200 may include providing a face portion (block 4202) having a planar strike portion (i.e., without any grooves). In one example, the face portion 3200 may be an integral part of a golf club head. In another example, the face portion 3200 may be a separate face insert that may be coupled to a front portion of a golf club head by using adhesive, tape, welding, soldering, fasteners and/or other suitable methods and devices. The process 4200 may include forming a plurality of grooves on the strike portion of the face portion (block 4204) with distances between successive grooves of the plurality of grooves changing (e.g., increasing or decreasing) in any direction moving from a central strike portion to a perimeter of the face portion. For example, the grooves may be spaced apart according to equations 1 and 2 described herein with respect to the example of FIGS. 32-39. Alternatively, in another example, as shown in FIG. 43, a process 4300 of manufacturing the face portion 3200 may include providing a face portion (block 4302) having a planar strike portion (i.e., without any grooves), and forming a plurality projections on the strike portion of the face portion (block 4304) with the size of the plurality of projections changing (e.g., increasing or decreasing) in any direction from a central strike portion to a perimeter of the face portion. As described herein, each one of the plurality of projections may include a peak portion separated from a base portion by a height. In one example, two or more of the plurality of projections may be pyramidal frustums. The change in size may include a change to the areas of the peak portions of the plurality of projections, a change to the areas of the base portions of the plurality of projections, and/or a change in height of the plurality of projections. The apparatus, methods, and articles of manufacture described herein are not limited in this regard.

In one example, the plurality of grooves may be manufactured by milling the face portion. Accordingly, the portions of the face portion that are not milled may form the plurality of projections (e.g., residual portion(s)). In another example, the plurality of grooves may be stamped onto the face portion. In yet another example, the face portion including the plurality of projections and/or the plurality of grooves may be manufactured by forging. In yet another example, the face portion including the plurality of projections and/or the plurality of grooves may be manufactured by casting. In yet another example, the plurality of projections and/or the plurality of grooves may be manufactured by press forming. In yet another example, the plurality of projections and/or the plurality of grooves may be manufactured by laser and/or thermal etching or eroding of the face material. In yet another example, the plurality of projections and/or the plurality of grooves may be manufactured by chemically eroding the face material using photo masks. In yet another example, the plurality of projections and/or the plurality of grooves may be manufactured by electro/chemically eroding the face material using a chemical mask such as wax or a petrochemical substance. In yet another example, the plurality of projections and/or the plurality of grooves may be manufactured by abrading the face material using air or water as the carry medium of the abrasion material such as sand. Any one or a combination of the methods discussed above can be used to manufacture one or more of the plurality of projections and/or the plurality of grooves on the face portion. The apparatus, methods, and articles of manufacture described herein are not limited in this regard.

In the example of FIGS. 44-50, a golf club head 4400 may include a body portion 4410 having a toe portion 4430, a heel portion 4440, a front portion 4450, a rear portion 4460 having a back wall portion 4484 (shown in FIG. 46), a top portion 4470, and a sole portion 4480. The body portion 4410 may include a hosel portion 4445 configured to receive a shaft (not shown) with a grip (not shown). The golf club head 4400 and the grip may be located on opposite ends of the shaft to form a golf club. The front and rear portions 4450 and 4460, respectively, may be on opposite ends of the body portion 4410. The front portion 4450 may include a face portion 4455 (e.g., a strike face). The face portion 4455 may be used to impact a golf ball and may be similar in configuration to any face portion described herein including face portion 3200. The face portion 4455 may be associated with a loft plane that defines the loft angle of the golf club head 4400. The golf club head 4400 may be manufactured by any of the methods described herein and from any one or more of the materials described herein or associated with any of the golf club heads described herein. Although FIGS. 44-46 may depict a particular type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, etc.). The apparatus, methods, and articles of manufacture described herein are not limited in this regard.

Figure 45:
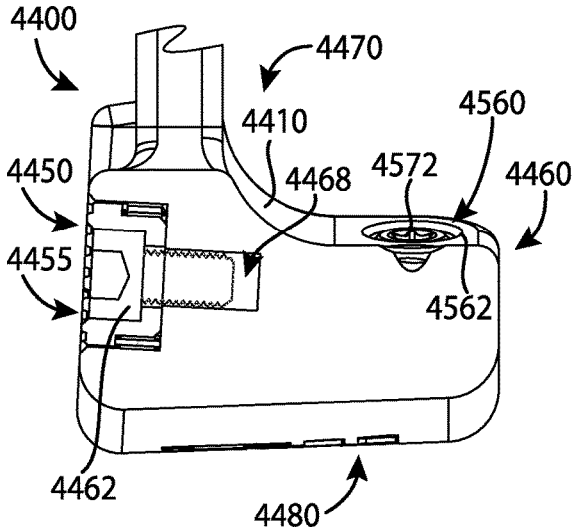
FIG. 45 depicts a cross-sectional view of the golf club head of FIG. 44 taken at lines 45-45 of FIG. 44.
Figure 46:
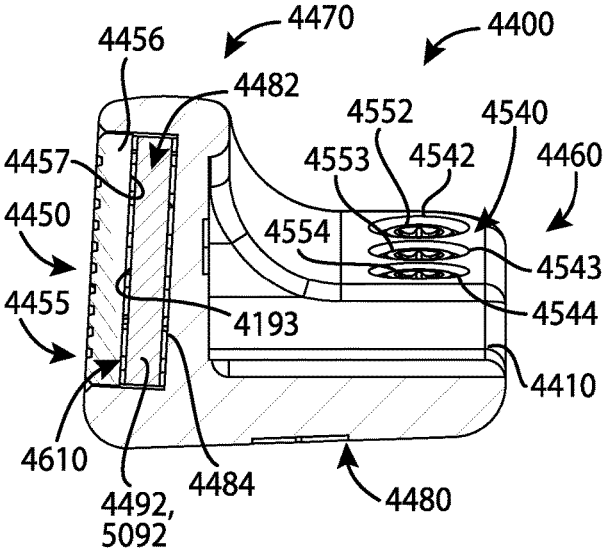
FIG. 46 depicts a cross-sectional view of the golf club head of FIG. 44 taken at lines 46-46 of FIG. 44.
Figure 47:
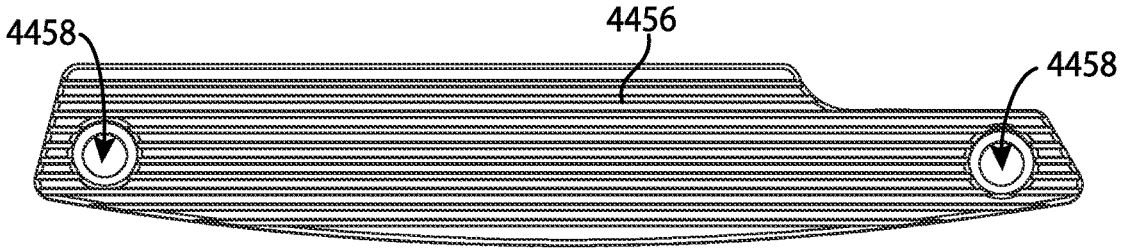
FIG. 47 depicts a front view of a face insert of the golf club head of FIG. 44 according to an example of the apparatus, methods, and articles of manufacture described herein.

The body portion 4410 may include one or more weight ports and one or more weight portions. In the example of FIGS. 44-50, the body portion 4410 may include a first set of weight ports 4540 (shown in FIG. 46 as weight ports 4542, 4543, and 4544) proximate to the toe portion 4430 and extending between the toe portion 4430 and the heel portion 4440 and configured to receive weight portions 4552, 4553, and 4554. The body portion 4410 may also include a second set of weight ports 4560 (one weight port 4562 is shown in FIG. 45) proximate to the heel portion 4440 and extending between the toe portion 4430 and the heel portion 4440 and configured to receive weight portions (one weight portion 4572 is shown in FIG. 45). The golf club head 4400 may include any number of weight ports and weight portions at any location on the body portion 4410. The configurations of the weight ports and the weight portions (e.g., inner diameter, outer diameter, size, shape, distance from an adjacent weight port or weight portion, etc.) of the golf club head 4400 may be similar in many respects to the weight ports and weight portions of any of the golf club heads described herein. Alternatively, the body portion 4410 may not include any weight ports and/or weight portions. The apparatus, methods, and articles of manufacture described herein are not limited in this regard.

In the example of FIGS. 44-50, the face portion 4455 may include a face insert 4456, which may be attached to the front portion 4450 via any manufacturing methods and/or processes (e.g., a bonding process, a welding process, a brazing process, a mechanical locking method, a mechanical fastening method, any combination thereof, or other suitable types of manufacturing methods and/or processes). In the example of FIGS. 44-50, the face insert 4456 may include two fastener holes 4458 proximate to the toe portion and heel portion of the face insert 4456. Each of the fastener holes 4458 may be configured to receive a fastener 4462 for attachment of the face insert 4456 to the body portion 4410. The fasteners 4462 may have similar or different weights to balance and/or provide heel or toe weight bias for the golf club head 4400. The body portion 4410 may include two fastener ports 4468 (one fastener port 4468 shown in FIG. 45) configured to receive the fasteners 4462. Each fastener port 4468 may have internal threads that are configured to engage external threads on the fasteners 4462. As described herein, the face portion 4455 may include a peripheral recessed portion (not shown) configured to receive the face insert 4456 so that the face insert 4456 is positioned flush or substantially flush with the face portion 4455. The face insert 4456 may be attached to the face portion 4455 by any of the methods described herein. The apparatus, methods, and articles of manufacture described herein are not limited in this regard.

The body portion 4410 may include an interior cavity 4482 extending between the front portion 4450 and the rear portion 4460 and between the toe portion 4430 and the heel portion 4440. In the example of FIGS. 44-50, the interior cavity 4482 may be defined by a recess in the front portion 4450 that is covered by the face insert 4456. The interior cavity 4482 may extend from near the toe portion 4430 to near the heel portion 4440 and from near the top portion 4470 to near the sole portion 4480. Alternatively, the interior cavity 4482 may extend between the fastener ports 4468 of the body portion 4410. In one example, the interior cavity 4482 may be located at and/or near the regions of the face portion 4455 that generally strike a golf ball. The physical characteristics of the interior cavity 4482 such as interior cavity height relative to the physical characteristics of the body portion 4410 such as the height of the body portion 4410 may be similar in many respects to any of the golf club heads described herein. The apparatus, methods, and articles of manufacture described herein are not limited in this regard.

In one example, the interior cavity 4482 may be unfilled (i.e., empty space). Alternatively, the interior cavity 4482 may be partially or entirely filled with a filler material 4492 to absorb shock, isolate vibration, and/or dampen noise when the face portion 4455 strikes a golf ball. The filler material 4492 may be an elastic polymer or elastomer material similar to any of the filler materials described herein. For example, at least 50% of the interior cavity 4482 may be filled with a TPE material to absorb shock, isolate vibration, and/or dampen noise when the golf club head 4400 strikes a golf ball via the face portion 4455. In one example, the filler material 4492 may be injected into the interior cavity 4482 by any of the methods described herein (e.g., from one or more of the weight ports). In another example, the filler material 4492 may be in the form of an insert having a shape that is similar to the shape of the interior cavity 4482. The insert, exemplarily shown in FIG. 50 as filler insert 5092, may be placed in the interior cavity 4482 prior to the face insert 4456 being fastened to the face portion 4455. The apparatus, methods, and articles of manufacture described herein are not limited in this regard.

In one example, the body portion 4410 may include a bonding portion 4610. The bonding portion 4610 may provide connection, attachment, and/or bonding of the filler material 4492 or filler insert 5092 to the face insert 4456. The bonding portion 4610 may be a bonding agent, a combination of bonding agents, one or more bonding structures or attachment devices, a combination of bonding structures and/or attachment devices, and/or a combination of one or more bonding agents, one or more bonding structures, and/or one or more attachment devices. For example, the golf club head 4400 may include a bonding agent to improve adhesion and/or mitigate delamination between the face insert 4456 and any filler material or filler insert to fill the interior cavity 4482 of the golf club head 4400. In one example, the filler material 4492 or filler insert 5092 may include bonding or adhesive properties to bond or adhere to the body portion 4410. The apparatus, methods, and articles of manufacture described herein are not limited in this regard.

In one example, the bonding portion 4610 may include a bonding agent having a low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion 4610 may include a bonding agent having LOCTITE® materials manufactured by Henkel Corporation, Rocky Hill, Conn. The apparatus, methods, and articles of manufacture are not limited in this regard.

Figure 48:
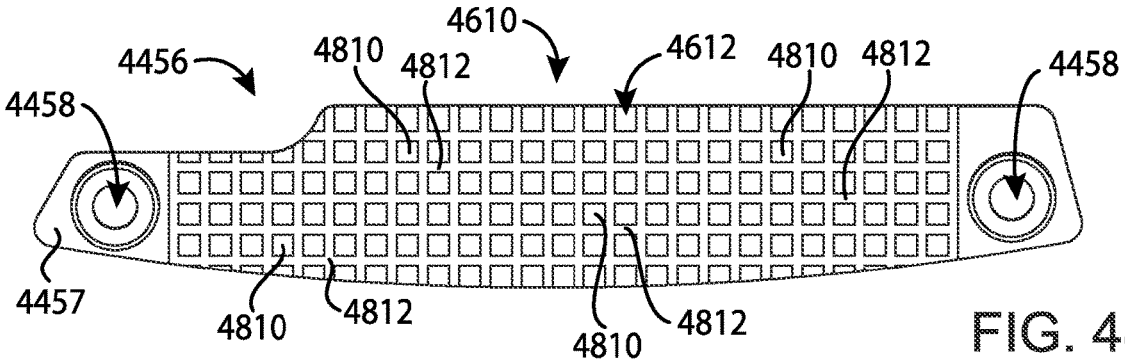
FIG. 48 depicts a back view of the face insert of FIG. 47.
Figure 49:
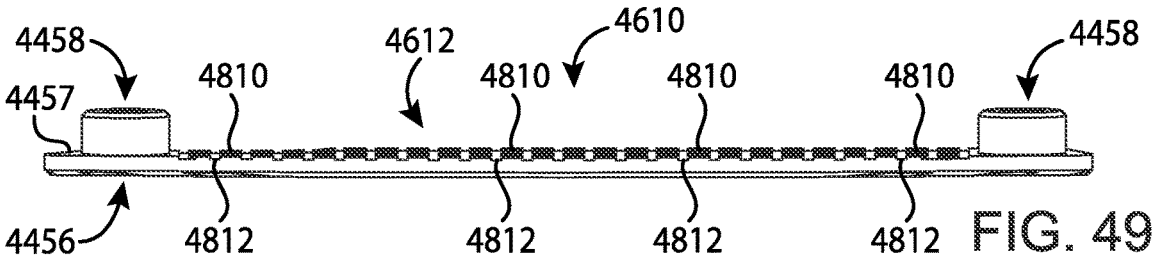
FIG. 49 depicts a bottom view of the face insert of FIG. 47.

In one example, as shown in FIGS. 48 and 49, the bonding portion 4610 may include a bonding structure 4612 on a back side 4457 of the face insert 4456 and/or on a front side 4493 (shown in FIG. 46) of the filler material 4492, which may include filler insert 5092. In one example, as shown in FIGS. 48 and 49, the back side 4457 of the face insert 4456 may include a plurality of projections 4810 defining a plurality of channels 4812 between the projections 4810. The projections 4810 may have any shape, size, height, configuration, arrangement, spacing, or other features. In the example of FIGS. 48 and 49, the projections 4810 may have a generally rectangular shape or square shape that may be arranged in a rectangular array (i.e., rows and columns) on the back side 4457 of the face insert 4456. Accordingly, the channels 4812 may extend in a direction from the toe portion 4430 to the heel portion 4440 and in a direction from the top portion 4470 to the sole portion 4480. The channels 4812 may have any orientation, size, shape, configuration, arrangement, spacing, and/or other features that may depend on the physical properties of the projections 4810 and the arrangement of the projections 4810 on the back side 4457 of the face insert 4456. The apparatus, methods, and articles of manufacture described herein are not limited in this regard.

In one example, when the filler material 4492 is an elastic polymer or an elastomer material, the filler material 4492 may be injection molded in the interior cavity 4482. When the filler material 4492 is injection molded in the interior cavity 4482, the filler material 4492 may surround the projections 4810 and may fill the channels 4812 to increase the bonding area between the filler material 4492 and the back side 4457 of the face insert 4456. Accordingly, the bonding structure 4612 may provide a stronger bond between the filler material 4492 and the face insert 4456. In one example, a bonding agent (not shown), such as any of the bonding agents described herein, may be applied to the back side 4457 of the face insert 4456 before injection molding the filler material 4492 in the interior cavity 4482 to provide further bonding strength between the filler material 4492 and the back side 4457 of the face insert 4456. The bonding process may include single or multiple stage time and/or temperature curing of the bonding agent. The apparatus, methods, and articles of manufacture described herein are not limited in this regard.

Figure 50:
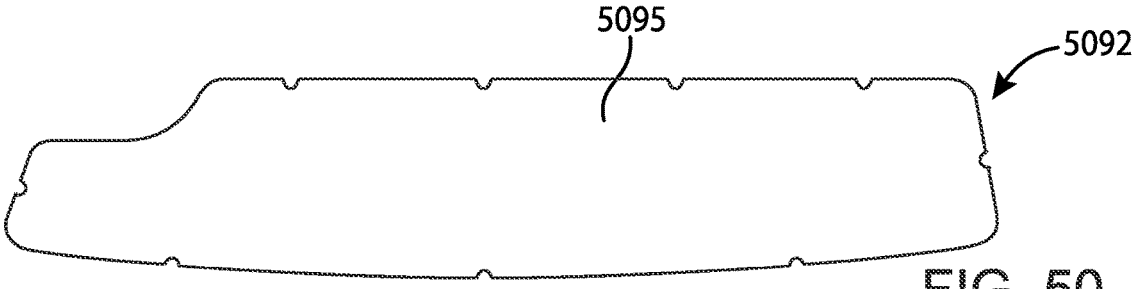
FIG. 50 depicts a back view of a filler insert of the golf club head of FIG. 44 according to an example of the apparatus, methods, and articles of manufacture described herein.
Figure 51:
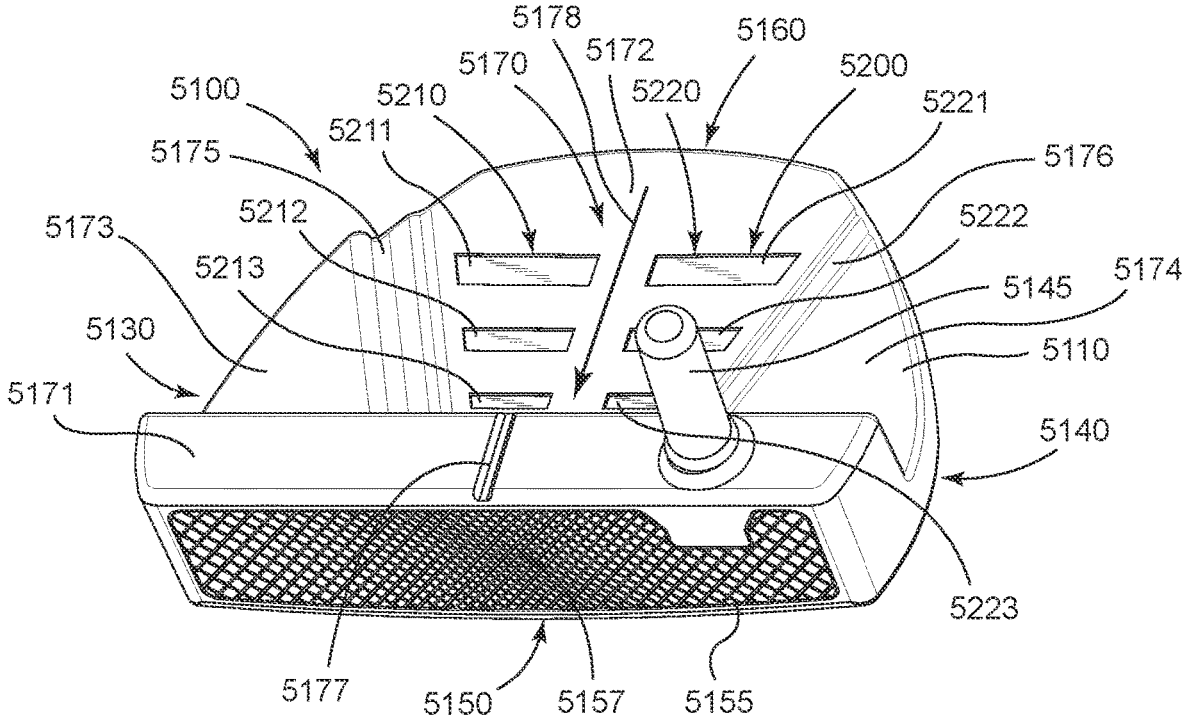
FIG. 51 depicts a top perspective view of a golf club head according to an example of the apparatus, methods, and articles of manufacture described herein.
Figure 52:
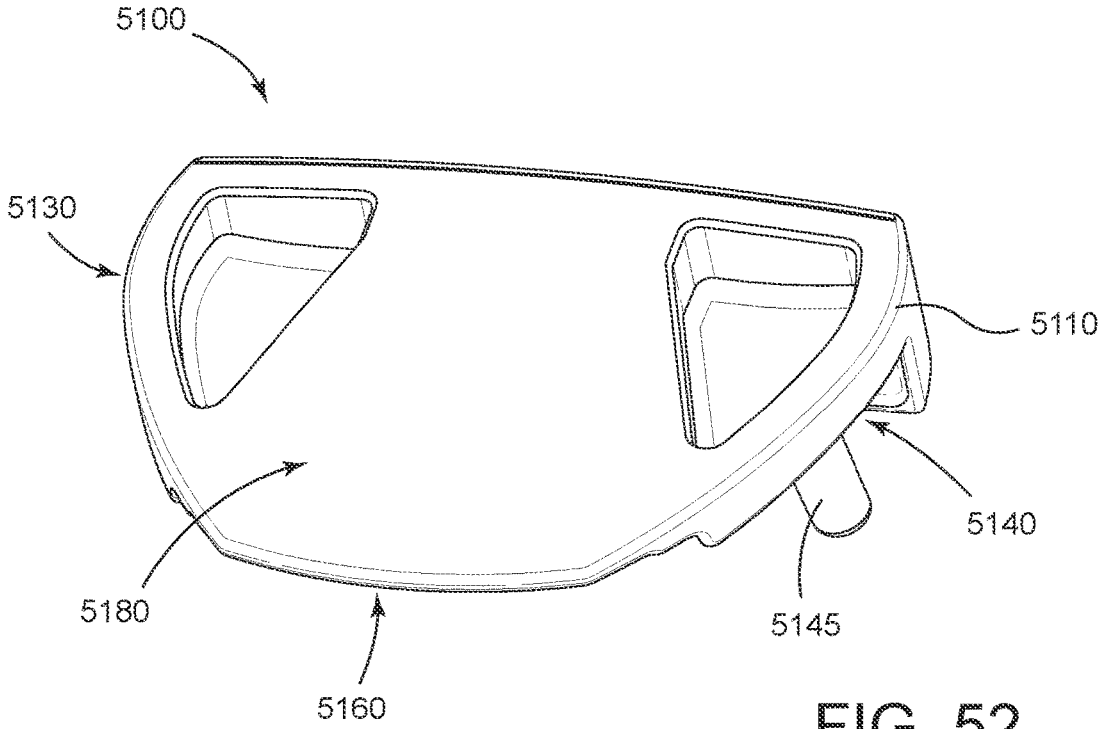
FIG. 52 depicts a bottom perspective view of the golf club head of FIG. 51.

In one example, as shown in FIG. 50, the filler material 4492, which may be constructed from an elastic polymer material or an elastomer material, may be in the form of the filler insert 5092, which may be molded or formed outside of the interior cavity 4482 and placed in the interior cavity 4482 prior to attachment of the face insert 4456 to the face portion 4455. The back side 4457 of the face insert 4456 or the front side 4493 of the filler insert 5092 (i.e., the side facing the face insert 4456) may include the bonding structure (not shown for the filler insert 5092 of FIG. 50) as described herein to increase the bonding strength between the face insert 4456 and the filler insert 5092 after a bonding agent is applied to the back side 4457 of the face insert 4456 and/or the front side 4493 of the filler insert 5092. In one example (not shown), both the back side 4457 of the face insert 4456 and the front side 4493 of the filler insert 5092 may include one or more bonding structures similar to any of the bonding structures described herein. For example, the back side 4457 of the face insert 4456 may include the bonding structure 4612 as described herein and the front side 4493 of the filler insert 5092 may include a mating and/or a complementary structure to the bonding structure 4612. The apparatus, methods, and articles of manufacture described herein are not limited in this regard.

In one example, the face insert 4456 may be bonded to the elastic polymer or elastomer filler insert 5092 before being attached to the body portion 4410 of the golf club head 4400. A bonding agent, such as any of the bonding agents described herein may be applied to the back side 4457 of the face insert 4456 and/or the front side 4493 of the filler insert 5092. The face insert 4456 may then be attached and bonded to the filler insert 5092. The bonding process may include single or multiple stage time and/or temperature curing of the bonding agent. The attached face insert 4456 and the filler insert 5092 may then be attached to the body portion 4410 as described herein. The apparatus, methods, and articles of manufacture described herein are not limited in this regard.

In one example, the face insert 4456 may be constructed from one or more metals or metal alloys such as steel, aluminum, titanium, tungsten or alloys thereof. Accordingly, the filler material 4492 or the filler insert 5092 may be constructed from an elastic polymer material or an elastomer material as described herein to absorb shock, isolate vibration, and/or dampen noise when the face portion 4455 strikes a golf ball. The face insert 4456 may be constructed from a non-metallic material such as a composite material, plastic material, or a polymer material. In one example, the face insert 4456 may be constructed from a thermoplastic polyurethane (TPU) material (hereinafter referred to for this example as the TPU face insert 4456). The filler insert 5092 may be constructed from metal or metal alloys such as steel, aluminum, titanium, tungsten or alloys thereof. In one example, the filler insert 5092 may be constructed form aluminum or an aluminum alloy (hereinafter referred to for this example as the aluminum filler insert 5092). The TPU face insert 4456 may absorb shock, isolate vibration, and/or dampen noise when the face portion 4455 strikes a golf ball. The aluminum filler insert 5092 may limit the deflection of the TPU face insert 4456 and provide structural support for the TPU face insert 4456 when the TPU face insert 4456 strikes a golf ball. The apparatus, methods, and articles of manufacture described herein are not limited in this regard.

The back side 4457 of the TPU face insert 4456 or the front side 4493 of the aluminum filler insert 5092 may include the bonding structure 4612 as described herein and shown in FIGS. 48 and 49. In another example, both the back side 4457 of the TPU face insert 4456 and the front side 4493 of the aluminum filler insert 5092 may include the bonding structure 4612 as described herein. In one example, only the back side 4457 of the TPU face insert 4456 may include the bonding structure 4612 while the front side 4493 of the aluminum filler insert 5092 may not include a bonding structure. The bonding structure 4612 may provide increased bonding strength when the TPU face insert 4456 is attached to the aluminum filler insert 5092 with a bonding agent as described herein. The apparatus, methods, and articles of manufacture described herein are not limited in this regard.

In one example, the TPU face insert 4456 may be bonded to the aluminum filler insert 5092 before being attached to the body portion 4410 of the golf club head 4400. A bonding agent, such as any of the bonding agents described herein may be applied to the back side 4457 of the TPU face insert 4456 and/or the front side 4493 of the aluminum filler insert 5092. The TPU face insert 4456 may then be attached and bonded to the aluminum filler insert 5092. The bonding process may include single or multiple stage time and/or temperature curing of the bonding agent. The attached TPU face insert 4456 and the aluminum filler insert 5092 may then be attached to the body portion 4410 as described herein. The apparatus, methods, and articles of manufacture described herein are not limited in this regard.

As described herein, the back side 4457 of the face insert 4456 or the front side 4493 of the filler insert 5092 (i.e., the side facing the face insert 4456) may include the bonding structure 4612 to increase the bonding strength between the face insert 4456 and the filler insert 5092 after a bonding agent is applied to the back side 4457 of the face insert 4456 and/or the front side 4493 of the filler insert 5092. In one example, both the back side 4457 of the face insert 4456 and the front side 4493 of the filler insert 5092 may include one or more bonding structures similar to any of the bonding structures described herein. For example, the back side 4457 of the face insert 4456 may include the bonding structure 4612 as described herein and the front side 4493 of the filler insert 5092 may include a mating and/or a complementary structure to the bonding structure 4612. The apparatus, methods, and articles of manufacture described herein are not limited in this regard.

In one example, a back side 5095 (shown in FIG. 50) of the filler insert 5092 may also include a bonding structure (not shown), such as any of the bonding structures described herein, to attach the filler insert 5092 to the walls of the interior cavity 4482. For example, a bonding agent such as any of the bonding agents described herein may be applied to one or more walls of the interior cavity 4482 and/or the bonding structure on the back side 5095 of the filler insert 5092. The filler insert 5092 may then be bonded to the walls of the interior cavity 4482. The apparatus, methods, and articles of manufacture described herein are not limited in this regard.

With the support of the back wall portion 4484 (shown in FIG. 46) of the body portion 4410 and the filler material 5092, the face insert 4456 may be relatively thin without degrading the structural integrity, sound, and/or feel of the golf club head 4400. In one example, the face insert 4456 may have a thickness of less than or equal to 0.075 inch (1.905 millimeters). In another example, the face insert 4456 may have a thickness of less than or equal to 0.060 inch (1.524 millimeters). In yet another example, the face insert 4456 may have a thickness of less than or equal to 0.050 inch (1.270 millimeters). Further, the face insert 4456 may have a thickness of less than or equal to 0.030 inch (0.762 millimeters). The apparatus, methods, and articles of manufacture described herein are not limited in this regard.

In the example of FIGS. 51-54, a golf club head 5100 may include a body portion 5110 having a toe portion 5130, a heel portion 5140, a front portion 5150 with a face portion 5155 for impacting a golf ball 5156, a rear portion 5160, a top portion 5170, and a sole portion 5180. The body portion 5110 may include a hosel portion 5145 configured to receive a shaft (not shown) with a grip (not shown). The face portion 5155 may be similarly configured to the example face portion 3200 of FIGS. 32-39. The top portion 5170 may include a first surface portion 5171, a second surface portion 5172, a third surface portion 5173, and a fourth surface portion 5174. The first surface portion 5171 may be adjacent the face portion 5155 and may correspond to an uppermost extent of the top portion 5170. The second surface portion 5172 may be adjacent the rear portion 5160 and may correspond to a lowermost extent of the top portion 5170. The third surface portion 5173 may be adjacent the toe portion 5130 and may correspond to an intermediate extent of the top portion 5170. For example, the third surface portion 5173 may be raised relative to the second surface portion 5172 and may be lowered relative to the first surface portion 5171. The fourth surface portion 5174 may be adjacent the heel portion 5140 and may also correspond to an intermediate extent of the top portion 5170. For example, the fourth surface portion 5174 may be raised relative to the second surface portion 5172 and may be lowered relative to the first surface portion 5171. A first transition portion 5175 may separate the second surface portion 5172 and the third surface portion 5173. In the present example, the first transition portion 5175 may be stepped and may extend diagonally across the body portion 5110. For example, the first transition portion 5175 may extend inwardly from the toe portion 5130 toward the face portion 5155. A second transition portion 5176 may separate the second surface portion 5172 and the fourth surface portion 5174. In the present example, the second transition portion 5176 may be stepped and may extend diagonally across the body portion 5110. For example, the second transition portion 5176 may extend inwardly from the heel portion 5140 toward the face portion 5155. Collectively, the second surface portion 5172, the first transition portion 5175, and the second transition portion 5176 may provide a first guiding means that directs and gradually sharpens an individual's focus in a rear-to-front direction of the golf club head 5100 generally depicted by direction arrow 5178 in FIG. 51. The apparatus, methods, and articles of manufacture described herein are not limited in this regard.

In the present example, a visual guide portion 5177 may be located at the first surface portion 5171. In one example, as illustrated in FIGS. 51-54, the visual guide portion 5177 may be a recessed line portion of the first surface portion 5171. The visual guide portion 5177 may have a certain color to further distinguish the visual guide portion 5177 on the first surface portion 5171. In another example, the visual guide portion 5177 may be laser etched onto the top portion 5570. In another example, the visual guide portion 5177 may be painted onto the top portion 5570. In another example, the visual guide portion 5177 may be a separate part that is adhered or otherwise affixed to the first surface portion 5171. In yet another example, the visual guide portion 5177 may be an integral part of the body portion 5110 and co-manufactured with the body portion 5110. The visual guide portion 5177 may extend longitudinally across the first surface portion 5171 and may be aligned with a center longitudinal axis 5111 of the body portion 5110. In alternative examples, the visual guide portion 5177 may extend onto the second surface portion 5172. The visual guide portion 5177 may be continuous or segmented. Alternatively, the visual guide portion 5177 may be configured as one or more dots in addition to, or in place of, one or more lines. In the present example, the visual guide portion 5177 may provide a first sighting means that assists an individual with aligning the center longitudinal axis 5111 with an intended target line generally depicted by direction arrow 5411 in FIG. 53. The apparatus, methods, and articles of manufacture described herein are not limited in this regard.

Figure 53:
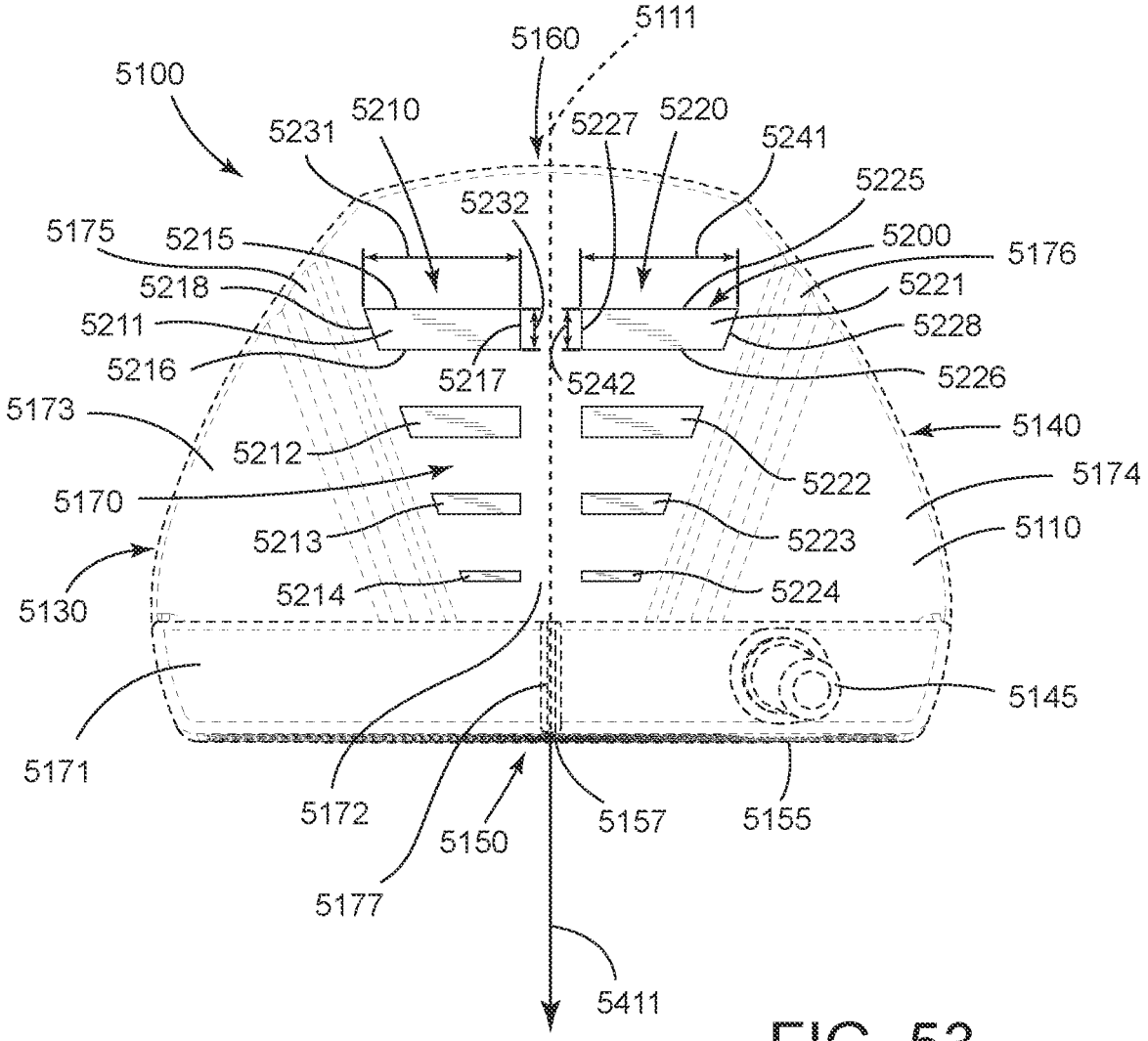
FIG. 53 depicts a top view of the golf club head of FIG. 51.
Figure 54:
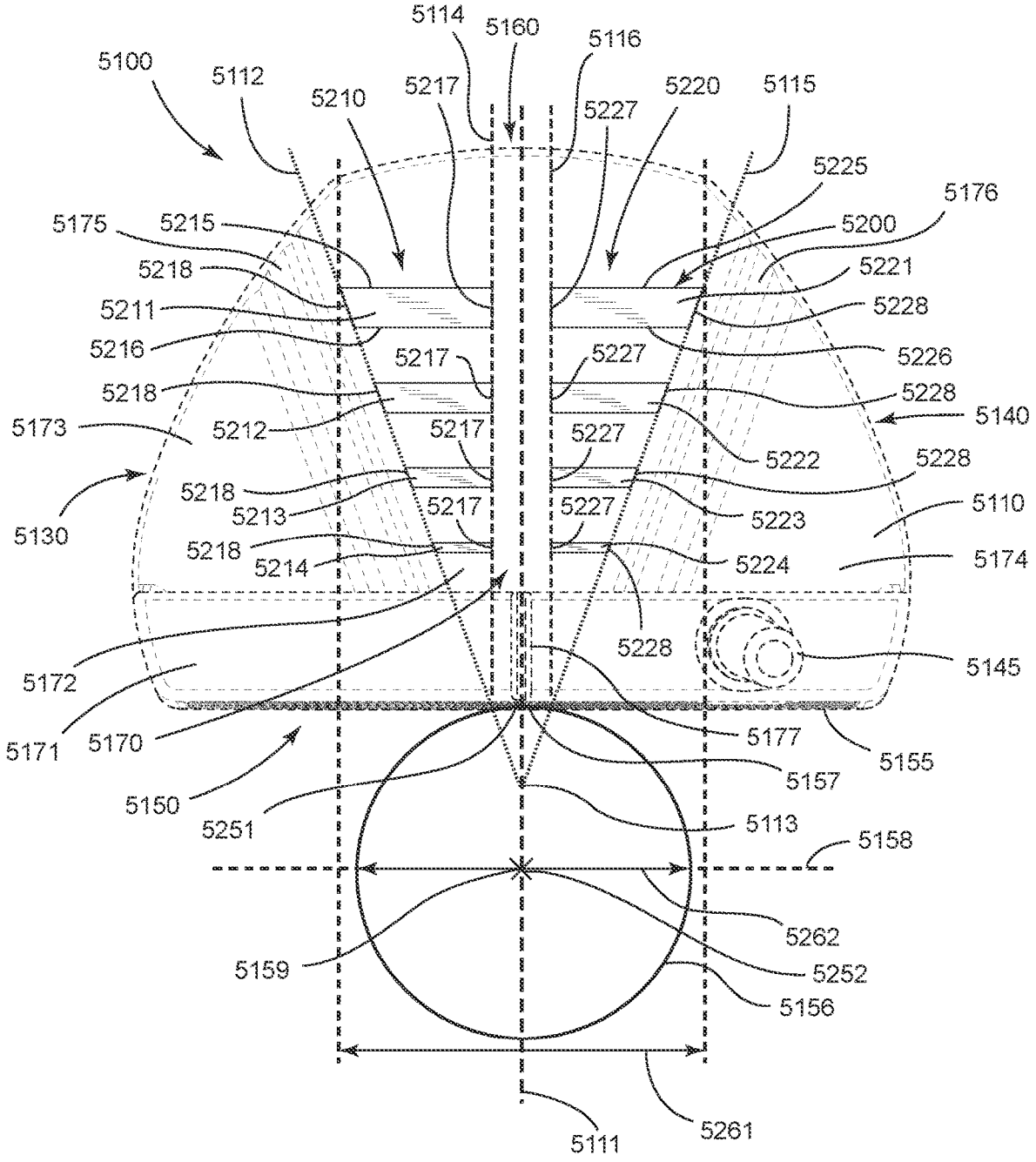
FIG. 54 depicts the golf club head of FIG. 53 contacting a golf ball.

For purposes of clarity, the body portion 5110 is shown in FIGS. 53 and 54 in phantom lines and may further include an alignment aid 5200 at the second surface portion 5172. The alignment aid 5200 may be located rearward of the visual guide portion 5177 and may include a first plurality of strip portions 5210 and a second plurality of strip portions 5220 arranged side-by-side to create a visual runway effect to assist an individual with striking the golf ball 5156 along the intended target line 5411. As will be described herein, the alignment aid 5200 may provide a second guiding means that directs and gradually sharpens an individual's focus in the rear-to-front direction 5178 and a second sighting means that assists the individual with aligning the center longitudinal axis 5111 with the intended target line 5411. Accordingly, the alignment aid 5200 may be provided as a stand-alone feature or may be provided to complement and bolster the first guiding means provided by the second surface portion 5172, the first transition portion 5175, and the second transition portion 5176, and the first sighting means provided by the visual guide portion 5177. The apparatus, methods, and articles of manufacture described herein are not limited in this regard.

In the example of FIGS. 51-54, the first plurality of strip portions 5210 may include a first strip portion 5211, a second strip portion 5212, a third strip portion 5213, and a fourth strip portion 6014 spaced apart longitudinally across the second surface portion 5172 of the top portion 5170. Alternatively, the first plurality of strip portions 5210 may include less than four strip portions or more than four strip portions. The first strip portion 5211, second strip portion 5212, third strip portion 5213, and fourth strip portion 6014 may be located between the toe portion 5130 and the center longitudinal axis 5111 of the body portion 5110. The first strip portion 5211, the second strip portion 5212, the third strip portion 5213, and/or the fourth strip portion 5214 may be equidistant or unevenly spaced from the center longitudinal axis 5111. Relative to one another, the first strip portion 5211, the second strip portion 5212, the third strip portion 5213, and the fourth strip portion 6014 may be evenly spaced apart, unevenly spaced apart, or a combination thereof. Each of the first plurality of strip portions 5210 may have a quadrilateral shape or other geometric shape including, but not limited to, an oval shape, a circular shape, a triangular shape, a crescent shape, and a chevron shape. In the illustrated example, and with specific reference to the first strip portion 5211 for purpose of clarity, each of the first plurality of strip portions 5210 may be configured as a right trapezoid (i.e., a trapezoid having two adjacent right angles) defined by two parallel sides or bases (e.g., base 5215 and base 5216) and two non-parallel sides or legs (e.g., straight leg 5217 and diagonal leg 5218) connected thereto. The first plurality of strip portions 5210 may successively increase or decrease in surface area in a frontward direction (i.e., toward the front portion 5150). In the illustrated example, the first plurality of strip portions 5210 successively decrease in surface area in the frontward direction such that the first strip portion 5211 has the largest surface area followed in turn by the second strip portion 5212, the third strip portion 5213, and the fourth strip portion 6014. More specifically, the first plurality of strip portions 5210 may successively decrease in maximum length (e.g., maximum length 5231) and/or maximum width (e.g., width 5232) in the frontward direction. For example, the first strip portion 5211 may have the largest maximum length 5231 and width 5232 followed by the second strip portion 5212, the third strip portion 5213, and the fourth strip portion 6014. In one example, the first plurality of strip portions 5210 may be laser etched onto the second surface portion 5172. In another example, the first plurality of strip portions 5210 may be painted, cut, or be separate parts that are adhered to the second surface portion 5172. In yet another example, the first plurality of strip portions 5210 may be an integral part of the body portion 5110 and co-manufactured with the body portion 5110. The apparatus, methods, and articles of manufacture described herein are not limited in this regard.

In the example of FIGS. 51-54, the first plurality of strip portions 5210 may be configured such that the diagonal legs 5218 of the first strip portion 5211, second strip portion 5212, third strip portion 5213, and fourth strip portion 6014 are aligned with one another to generate a first focal axis 5112 that extends diagonally across the top portion 5170 and meets the center longitudinal axis 5111 at a focal point 5113 located forward of the face portion 5155. In the present example, the diagonal legs 5218 of the first plurality of strip portions 5210 are configured such that the first focal axis 5112 is parallel or substantially parallel with the first transition portion 5175. Additionally, the first plurality of strip portions 5210 may be configured such that the straight legs 5217 of the first strip portion 5211, second strip portion 5212, third strip portion 5213, and fourth strip portion 6014 are aligned along a first longitudinal axis 5114 that extends parallel to the center longitudinal axis 5111 of the body portion 5110. The apparatus, methods, and articles of manufacture described herein are not limited in this regard.

In the example of FIGS. 51-54, the second plurality of strip portions 5220 may mirror the first plurality of strip portions 5210, or in other words, the first and second plurality of strip portions 5210 and 5220 may be symmetric about the center longitudinal axis 5111. In another example, the first and second plurality of strip portions 5210 and 5220 may be asymmetric. In yet another example, the second plurality of strip portions 5220 may have a different number of strip portions than the first plurality of strip portions 5210. The second plurality of strip portions 5220 may include a first strip portion 5221, a second strip portion 5222, a third strip portion 5223, and a fourth strip portion 5224 spaced apart from one another in a longitudinal direction across the second surface portion 5172 of the top portion 5170. The first strip portion 5221, the second strip portion 5222, the third strip portion 5223, and the fourth strip portion 5224 may be located between the heel portion 5140 and the center longitudinal axis 5111 of the body portion 5110. The first strip portion 5221, the second strip portion 5222, the third strip portion 5223, and/or the fourth strip portion 5224 may be equidistant or unevenly spaced from the center longitudinal axis 5111. Relative to one another, the first strip portion 5221, the second strip portion 5222, the third strip portion 5223, and the fourth strip portion 5224 may be evenly spaced apart, unevenly spaced apart, or a combination thereof. Each of the second plurality of strip portions 5220 may have a quadrilateral shape or other geometric shape including, but not limited to, an oval shape, a circular shape, a triangular shape, a crescent shape, and a chevron shape. In the illustrated example, and with specific reference to the first strip portion 5221 for purpose of clarity, each of the second plurality of strip portions 5220 may be configured as a right trapezoid defined by two parallel sides or bases (e.g., base 5225 and base 5226) and two non-parallel sides or legs (e.g., straight leg 5227 and diagonal leg 5228) connected thereto. The second plurality of strip portions 5220 may successively increase or decrease in surface area in a direction moving from the rear portion 5160 toward the front portion 5150. In the illustrated example, the second plurality of strip portions 5220 successively decrease in surface area in a direction moving from the rear portion 5160 toward the front portion 5150 such that the first strip portion 5221 has the largest surface area followed in turn by the second strip portion 5222, the third strip portion 5223, and the fourth strip portion 5224. More specifically, the second plurality of strip portions 5220 may successively decrease in maximum length (e.g., maximum length 5241) and/or maximum width (e.g., width 5242) toward the front portion 5150. For example, the first strip portion 5221 may have the largest maximum length 5241 and width 5242 followed by the second strip portion 5222, the third strip portion 5223, and the fourth strip portion 5224. In one example, the second plurality of strip portions 5220 may be laser etched onto the second surface portion 5172. In another example, the second plurality of strip portions 5220 may be painted, cut, or be separates parts that are adhered to the second surface portion 5172. In yet another example, the second plurality of strip portions 5220 may be an integral part of the body portion 5110 and co-manufactured with the body portion 5110. The apparatus, methods, and articles of manufacture described herein are not limited in this regard.

In the example of FIGS. 51-54, the second plurality of strip portions 5220 may be configured such that the diagonal legs 5228 of the first strip portion 5221, the second strip portion 5222, the third strip portion 5223, and the fourth strip portion 5224 are aligned with one another to generate a second focal axis 5115 that extends diagonally across the top portion 5170 and meets the center longitudinal axis 5111 at the focal point 5113. In the present example, the diagonal legs 5228 of the second plurality of strip portions 5220 are configured such that the second focal axis 5115 is parallel or substantially parallel with the second transition portion 5176. Additionally, the second plurality of strip portions 5220 may be configured such that the straight legs 5227 of the first strip portion 5221, the second strip portion 5222, the third strip portion 5223, and the fourth strip portion 5224 are aligned along a second longitudinal axis 5116 that extends parallel to the center longitudinal axis 5111 of the body portion 5110. The apparatus, methods, and articles of manufacture described herein are not limited in this regard.

With respect to the examples provided herein, the focal point 5113 may be defined as a point at which the first focal axis 5112 meets with the second focal axis 5115 when the golf club head 5100 is directly viewed from above at an address position and contacts the golf ball 5156 or is in close proximity thereto. In the illustrated example, the focal point 5113 is located on the center longitudinal axis 5111 between the face portion 5155 and a central horizontal axis 5158 of the golf ball 5156, the central horizontal axis 5158 being parallel or substantially parallel with the face portion 5155. In another example, the focal point 5113 may coincide with an intersection 5251 between the center longitudinal axis 5111 and the central strike portion 5157 of the face portion 5155. In another example, the focal point 5113 may be located on the center longitudinal axis 5111 at a position rearward of the face portion 5155. In another example, the focal point 5113 may coincide with an intersection 5252 between the center longitudinal axis 5111 and a central vertical axis 5159 of the golf ball 5156. The central vertical axis 5159 may be perpendicular to the central horizontal axis 5158 and is shown going into the page of FIG. 54 for purpose of illustration. In yet another example, the focal point 5113 may be located forward of the central horizontal axis 5158 of the golf ball 5156. The apparatus, methods, and articles of manufacture described herein are not limited in this regard.

In the example of FIGS. 51-54, the first plurality of strip portions 5210 may be spaced from the second plurality of strip portions 5220 such that a maximum distance 5261 between the diagonal leg 5218 of the first strip portion 5211 of the first plurality of strip portions 5210 and the diagonal leg 5228 of the first strip portion 5221 of the second plurality of strip portions 5220 is greater than or equal to a diameter 5262 (e.g., 1.680 inches or 4.2672 centimeters) of the golf ball 5156. Alternatively, the maximum distance 5261 may be less than the diameter 5262 of the golf ball 5156. The apparatus, methods, and articles of manufacture described herein are not limited in this regard.

As described herein, the first plurality of strip portions 5210 and the second plurality of strip portions 5220 are arranged side-by-side to create a visual runway effect to assist an individual with striking the golf ball 5156 along the intended target line 5411. Either alone, or in conjunction with the first guiding means, the arrangement and the progressively decreasing size of the first plurality of strip portions 5210 and the second plurality of strip portions 5220 in the rear-to-front direction 5178 may gradually draw and sharpen an individual's focus toward the focal point 5113 to assist the individual in striking a golf ball 5156 with the central strike portion 5157 of the face portion 5155. Additionally, either alone, or in conjunction with the first sighting means, the equal spacing of the first plurality of strip portions 5210 and the second plurality of strip portions 5220 relative to the center longitudinal axis 5111 may assist an individual in aligning the center longitudinal axis 5111 with the intended target line 5411 so that the golf ball 5156 may be squarely struck with the central strike portion 5157 of the face portion 5155. Further, the arrangement and the progressively decreasing size from the rear portion 5160 to the front portion 5150 of the first plurality of strip portions 5210 and the second plurality of strip portions 5220 as described herein may provide a stationary and moving visual indicator that may assist an individual with keeping the face portion 5155 aligned perpendicular or substantially perpendicular to the intended target line before, during and after the putting stroke. The apparatus, methods, and articles of manufacture described herein are not limited in this regard.

Figure 55:
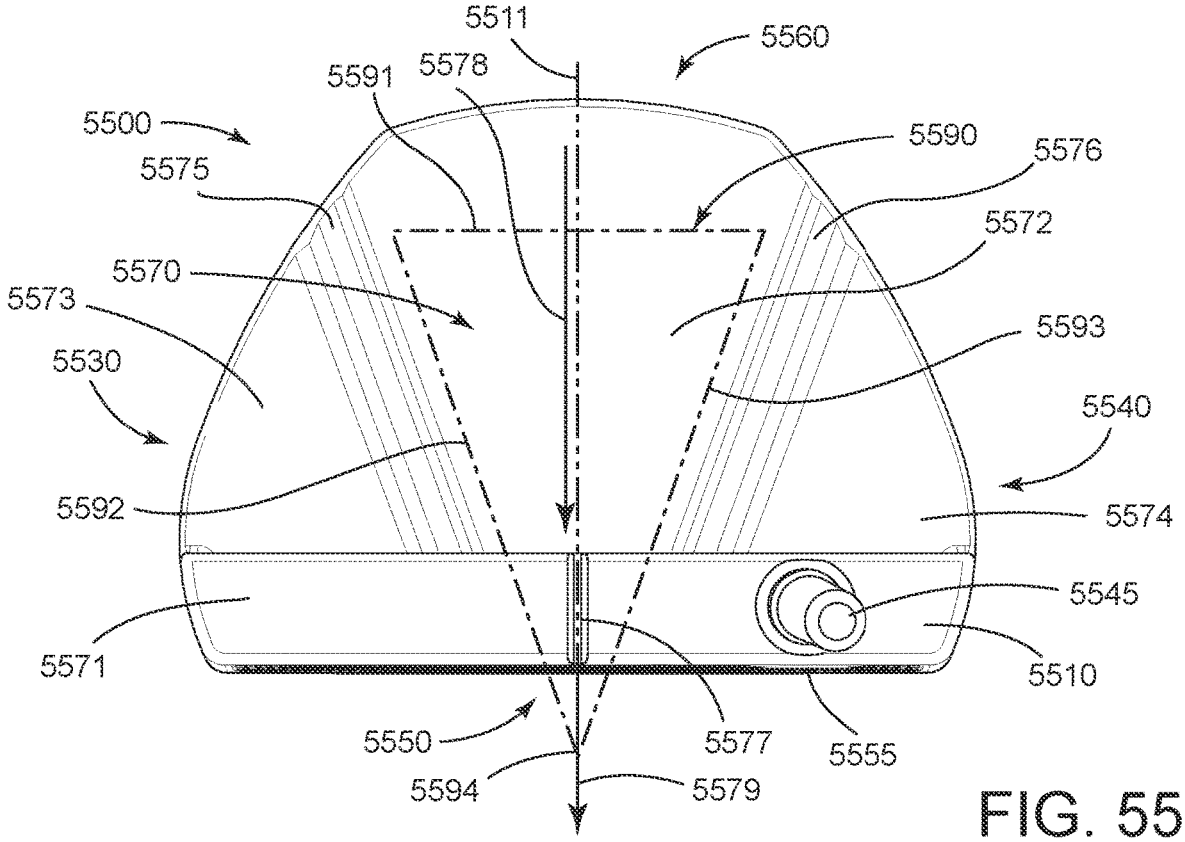
FIG. 55 depicts a top view of a golf club head according to an example of the apparatus, methods, and articles of manufacture described herein.

In the example of FIG. 55, a golf club head 5500 may include a body portion 5510 having a toe portion 5530, a heel portion 5540, a front portion 5550 with a face portion 5555 for impacting a golf ball (not shown), a rear portion 5560, a top portion 5570, and a sole portion (not shown). The body portion 5510 may also include a hosel portion 5545 configured to receive a shaft (not shown) with a grip (not shown). The face portion 5555 may be similarly configured to the example face portion 3200 of FIGS. 32-39. The top portion 5570 may include a first surface portion 5571, a second surface portion 5572, a third surface portion 5573, and a fourth surface portion 5574. The first surface portion 5571 may be adjacent the face portion 5555 and may correspond to an uppermost extent of the top portion 5570. The second surface portion 5572 may be adjacent the rear portion 5560 and may correspond to a lowermost extent of the top portion 5570. The third surface portion 5573 may be adjacent the toe portion 5530 and may correspond to an intermediate extent of the top portion 5570. For example, the third surface portion 5573 may be raised relative to the second surface portion 5572 and may be lowered relative to the first surface portion 5571. The fourth surface portion 5574 may be adjacent the heel portion 5540 and may also correspond to an intermediate extent of the top portion 5570. For example, the fourth surface portion 5574 may be raised relative to the second surface portion 5572 and may be lowered relative to the first surface portion 5571. A first transition portion 5575 may separate the second surface portion 5572 and the third surface portion 5573. In the present example, the first transition portion 5575 may be stepped and may extend diagonally across the body portion 5510. For example, the first transition portion 5575 may extend inwardly from the toe portion 5530 toward the face portion 5555. A second transition portion 5576 may separate the second surface portion 5572 and the fourth surface portion 5574. In the present example, the second transition portion 5576 may be stepped and may extend diagonally across the body portion 5510. For example, the second transition portion 5576 may extend inwardly from the heel portion 5540 toward the face portion 5155. Collectively, the second surface portion 5572, the first transition portion 5575, and the second transition portion 5576 provide a visual narrowing effect or a first guiding means that directs and gradually sharpens an individual's focus in a rear-to-front direction of the golf club head 5500 generally depicted by direction arrow 5578. The apparatus, methods, and articles of manufacture described herein are not limited in this regard.

The body portion 5510 may further include a visual guide portion 5577 at the top portion 5570 and adjacent to the face portion 5555. In one example, the visual guide portion 5577 may be similar in many respects to the visual guide portion 5177 of the example of FIGS. 51-54. The visual guide portion 5577 may be aligned with a center longitudinal axis 5511 of the golf club head 5500, which is exemplarily shown by a dash-two-dotted line. The visual guide portion 5577 may have a variable length that extends partially or entirely across the top portion 5570. The visual guide portion 5577 may be continuous or segmented. Alternatively, the visual guide portion 5577 may be configured as one or more dots in addition to, or in place of, a line(s). In the present example, the visual guide portion 5577 may be contained in a virtual outline 5590 and may provide a first sighting means that assists an individual with aligning the center longitudinal axis 5511 with an intended target line generally depicted by direction arrow 5579. Alternatively, the visual guide portion 5577 may be outside the virtual outline 5590. Alternatively still, the visual guide portion 5577 may be omitted. The apparatus, methods, and articles of manufacture described herein are not limited in this regard.

The virtual outline 5590 may be superimposed on the body portion 5510 to coincide or partially coincide with at least a portion of second surface portion 5572. The virtual outline 5590 may be bisected by the center longitudinal axis 5511 of the golf club head 5500. The virtual outline 5590 may be shaped as a triangle or other geometric shape including, but not limited to, a trapezoid, a rhombus, and a kite. In the illustrated example, the virtual outline 5590 may be shaped as an isosceles triangle pointing in a frontward club direction and including a base 5591, a first leg 5592, and a second leg 5593. In one example, as illustrated in FIG. 55, the base 5591 may extend between the toe portion 5530 and the heel portion 5540 and may be parallel or substantially parallel with the face portion 5555. In another example (not shown), the base 5591 may be defined by a perimeter edge portion of the body portion 5510 that extends between the first transition portion 5575 and the second transition portion 5576. In other words, the entire second surface portion 5572 may function as a portion of the virtual outline 5590. The first leg 5592 and the second leg 5593 may extend from opposite ends of the base 5591 and meet to define an apex 5594 that intersects with the center longitudinal axis 5511 at a position forward of the face portion 5555. The intersection between the apex 5594 and the center longitudinal axis 5511 is referred to herein as the aimpoint. The position of the aimpoint may vary by shifting the virtual outline 5590 in a forward direction (e.g., toward the face portion 5555), shifting the virtual outline 5590 in a rearward direction (e.g., toward the rear portion 5560), and/or changing the dimensions of the virtual outline 5590. Accordingly, the virtual outline 5900 may be configured such that the aimpoint is located forward of the face portion 5555, rearward of the face portion 5555, or coincident with the face portion 5555. The apparatus, methods, and articles of manufacture described herein are not limited in this regard.

In the present example, the virtual outline 5590 is configured to complement and reinforce the visual narrowing effect produced by the second surface portion 5572, the first transition portion 5575, and the second transition portion 5576. In one example, as illustrated in FIG. 55, the virtual outline 5590 may be within a space defined by rear portion 5560, the first transition portion 5575 and a virtual extension thereof intersecting the center longitudinal axis 5511, and the second transition portion 5576 and a virtual extension thereof intersecting the center longitudinal axis 5511. For example, the first leg 5592 and the second leg 5593 may be evenly spaced from the first transition portion 5575 and the second transition portion 5576, respectively, such that the first leg 5592 may be parallel or substantially parallel with the first transition portion 5575 and the second leg 5593 may be parallel or substantially parallel with the second transition portion 5576. In another example (not shown), the first leg 5592 and the second leg 5593 may extend within and parallel with the first transition portion 5575 and the second transition portion 5576, respectively. The apparatus, methods, and articles of manufacture described herein are not limited in this regard.

As described below in the examples of FIGS. 56-58, the virtual outline 5590 may contain an alignment aid or function as a blank canvas on the top portion 5570 for providing one or more alignment aids. An alignment aid bound by the virtual outline 5590 may provide a second guiding means that directs and gradually sharpens an individual's focus in the rear-to-front direction 5578 and a second sighting means that assists the individual with aligning the center longitudinal axis 5511 with the intended target line 5579. Accordingly, an alignment aid may be provided within the virtual outline 5590 as a standalone feature or may be provided to complement and bolster the first guiding means and the first sighting means. Either alone, or in conjunction with the first guiding means and the first sighting means, an alignment aid contained within the virtual outline 5590 may provide a stationary visual indicator that may assist an individual with positioning the golf club head 5500 relative to a golf ball and an intended target line and may further provide a moving visual indicator that may assist the individual with squarely striking the golf ball down the intended target line. The apparatus, methods, and articles of manufacture described herein are not limited in this regard.

Figure 56:
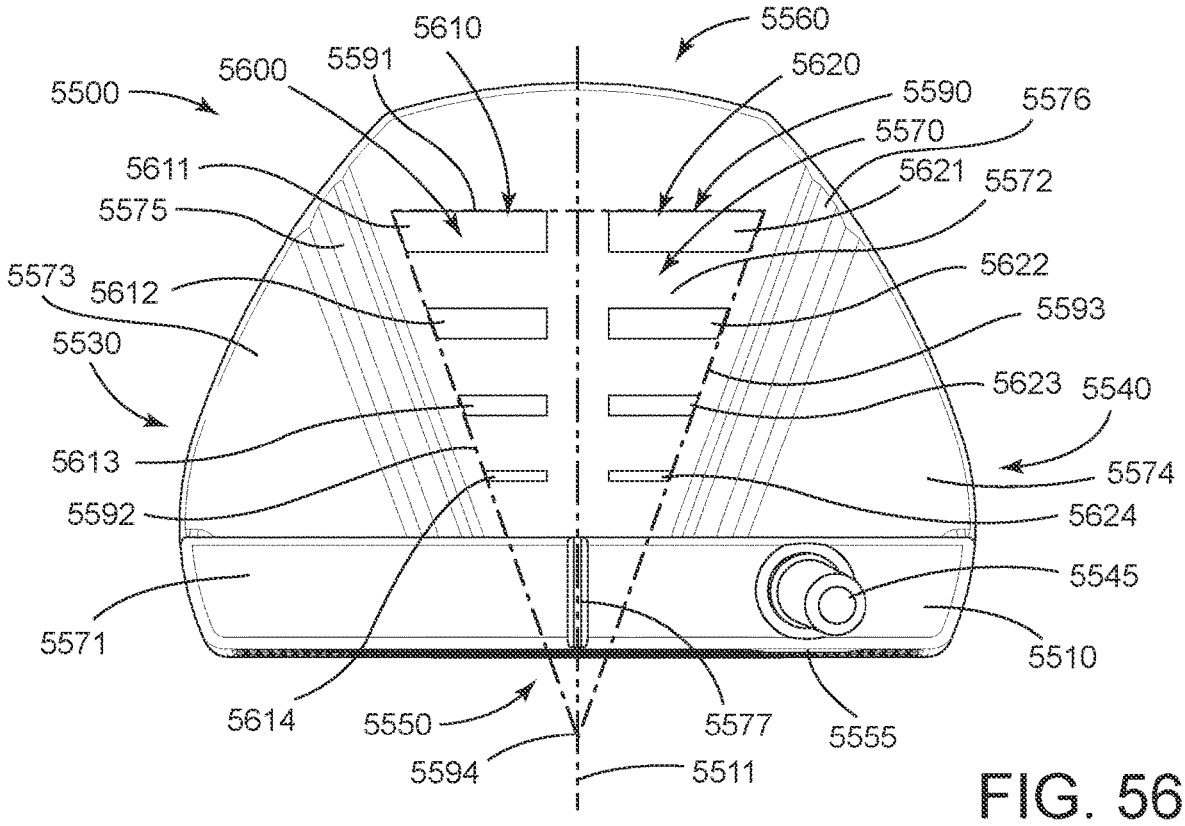
FIG. 56 depicts the golf club head of FIG. 55 with an example alignment aid.

In the example of FIG. 56, the golf club head 5500 of FIG. 55 is shown having an alignment aid 5600 bounded by the virtual outline 5590. The alignment aid 5600 may include a first plurality of strip portions 5610 (e.g., shown as strip portions 5611, 5612, 5613 and 5614) and a second plurality of strip portions 5620 (e.g., shown as strip portions 5621, 5622, 5623, and 5624) located at the second surface portion 5572 of the top portion 5570 and positioned rearward of the visual guide portion 5577. The first plurality of strip portions 5610 and the second plurality of strip portions 5620 may be laser etched onto the second surface portion 5572, painted onto the second surface portion 5572, cut into the second surface portion 5572, be separate parts that are adhered or otherwise affixed to the second surface portion 5572, or any combination thereof. In the illustrated example, the first plurality of strip portions 5610 and the second plurality of strip portions 5620 may be located between the toe portion 5530 and the center longitudinal axis 5511 and between the heel portion 5540 and the center longitudinal axis 5511, respectively. The first plurality of strip portions 5610 and the second plurality of strip portions 5620 may differ in shape, size (e.g., width, length, and/or height), and/or visual appearance. In the illustrated example, the first plurality of strip portions 5610 and the second plurality of strip portions 5620 may be symmetric to one another about the center longitudinal axis 5511 and may have a right trapezoid shape. The first plurality of strip portions 5610 and the second plurality of strip portions 5620 may be visually distinguishable from surrounding portions of the golf club head 5500. In one example, the first plurality of strip portions 5610 and the second plurality of strip portions 5620 may be a different color than the surrounding portions of the golf club head 5500. In another example, the first plurality of strip portions 5610 and the second plurality of strip portions 5620 may have a different texture than the surrounding portions of the golf club head 5500. In yet another example, the first plurality of strip portions 5610 and the second plurality of strip portions 5620 may be recessed relative to the surrounding portions of the golf club head 5500, level with the surrounding portions of the golf club head 5500, raised relative to the surrounding portions of the golf club head 5500, or any combination thereof. Accordingly, the first plurality of strip portions 5610 and the second plurality of strip portions 5620 may be configured as two-dimensional and/or three-dimensional elements. The apparatus, methods, and articles of manufacture described herein are not limited in this regard.

The first plurality of strip portions 5610 and the second plurality of strip portions 5620 may be spaced apart along a longitudinal direction of the golf club head 5500. The first plurality of strip portions 5610 and the second plurality of strip portions 5620 may be perpendicular or substantially perpendicular to the center longitudinal axis 5511 and may be parallel or substantially parallel to the face portion 5555. In one example, as illustrated in FIG. 56, the first plurality of strip portions 5610 and the second plurality of strip portions 5620 may be evenly spaced apart in a rear-to-front direction of the golf club head 5500 (e.g., as illustrated by the direction arrow 5578 in FIG. 55). In another example, the first plurality of strip portions 5610 and the second plurality of strip portions 5620 may be decreasingly spaced apart in the rear-to-front direction. In another example, the first plurality of strip portions 5610 and the second plurality of strip portions 5620 may be increasingly spaced apart in the rear-to-front direction or spaced apart according to any other spacing convention. Each strip portion of the first plurality of strip portions 5610 may extend continuously or discontinuously (e.g., segmented) between the first leg 5592 of the virtual outline 5590 and the center longitudinal axis 5511 and each strip portion of the second plurality of strip portions 5620 may extend continuously or discontinuously (e.g., segmented) between the second leg 5593 of the virtual outline 5590 and the center longitudinal axis 5511. The first plurality of strip portions 5610 and the second plurality of strip portions 5620 may or may not touch or border upon the virtual outline 5590 and/or the center longitudinal axis 5511. In the illustrated example, each strip portion of the first plurality of strip portions 5610 may touch or border upon the first leg 5592 of the virtual outline 5590 and end short of the center longitudinal axis 5511. Similarly, each strip portion of the second plurality of strip portions 5620 may touch or border upon the second leg 5593 of the virtual outline 5590 and end short of the center longitudinal axis 5511. Additionally, one strip portion (e.g., shown as strip portion 5611) of the first plurality of strip portions 5610 and one strip portion (e.g., shown as strip portion 5621) of the second plurality of strip portions 5620 may touch or border upon the base 5591 of the virtual outline 5590. The strip portions of the first plurality of strip portions 5610 and the second plurality of strip portions 5620 may be equidistant or variably spaced from the center longitudinal axis 5511. While the first plurality of strip portions 5610 and the second plurality of strip portions 5620 are generally shown as linear elements, one or more strip portions of the first plurality of strip portions 5610 and/or the second plurality of strip portions 5620 may be nonlinear including, but not limited to, curved, stepped, zigzagged, winding, oscillating, twisting, and the like. Additionally, while the first plurality of strip portions 5610 and the second plurality of strip portions 5620 are generally shown as individual discrete elements, a number of strip portions of the first plurality of strip portions 5610 and/or the second plurality of strip portions 5620 may be interconnected. Accordingly, strip portions of the first plurality of strip portions 5610 may comingle and/or mingle with strip portions of the second plurality of strip portions 5620. The apparatus, methods, and articles of manufacture described herein are not limited in this regard.

The first plurality of strip portions 5610 and the second plurality of strip portions 5620 may be ordered by increasing surface area (e.g., increasing width and/or length), decreasing surface area (e.g., decreasing width and/or length), a combination thereof, or at random in the rear-to-front direction of the golf club head 5500. In the illustrated example, the first plurality of strip portions 5610 and the second plurality of strip portions 5620 may be ordered by decreasing surface area (e.g., decreasing width and length) in the rear-to-front direction of the golf club head 5500. In the illustrated example, the orderly decrease in surface area in conjunction with the spaced apart relationship of the first plurality of strip portions 5610 and the second plurality of strip portions 5620 in the rear-to-front direction of the golf club head 5500 produces a visual runway, in effect directing and gradually sharpening an individual's focus in the rear-to-front direction toward the aimpoint. In practice, for example, the individual may assume an address position and scan the visual runway to determine whether the golf club head 5500 is properly aligned with an intended target line. This may be achieved by adjusting the position of the golf club head 5500 until the intended target line passes through the aimpoint and the visual guide portion 5577 and crosses between the first plurality of strip portions 5610 and the second plurality of strip portions 5620, or said differently, matches the center longitudinal axis 5511 of the golf club head 5500. The apparatus, methods, and articles of manufacture described herein are not limited in this regard.

Figure 57:
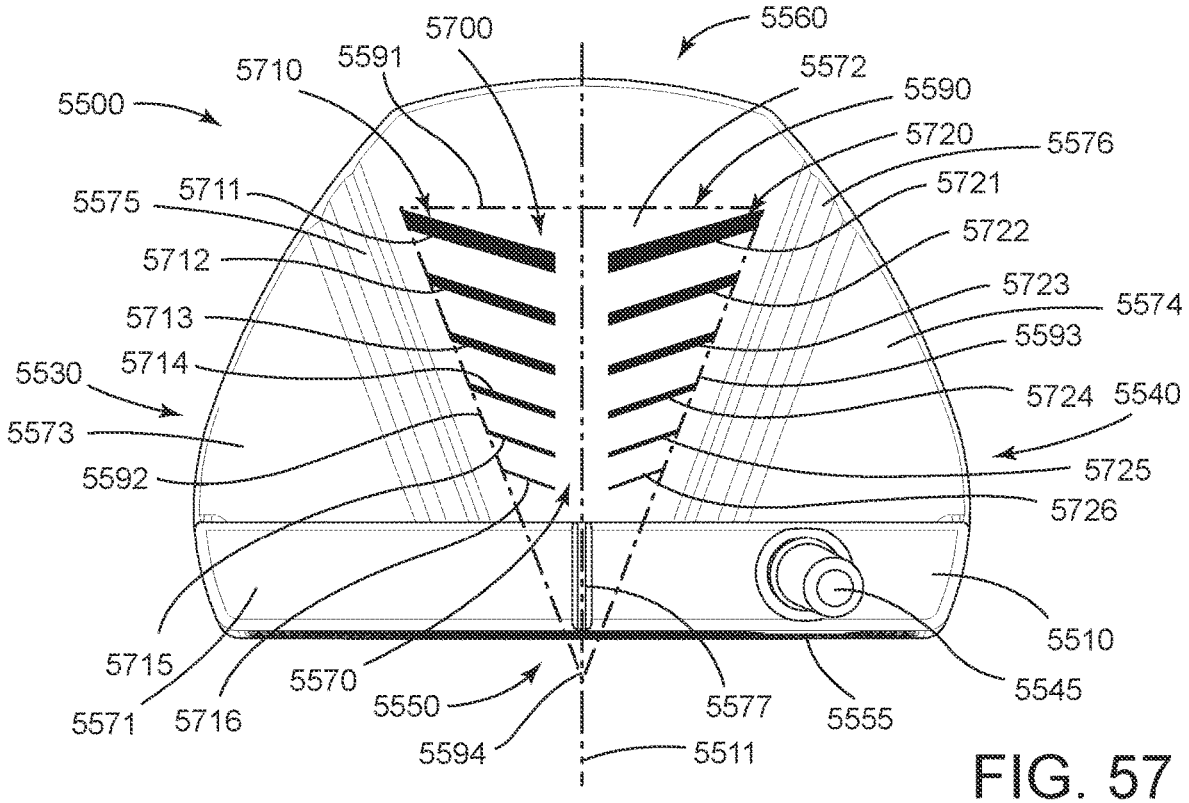
FIG. 57 depicts the golf club head of FIG. 55 with another example alignment aid.

In the example of FIG. 57, the golf club head 5500 is shown having an alignment aid 5700 bounded by the virtual outline 5590. The alignment aid 5700 may include a first plurality of strip portions 5710 (e.g., shown as strip portions 5711, 5712, 5713, 5714, 5715, and 5716) and a second plurality of strip portions 5720 (e.g., shown as strip portions 5721, 5722, 5723, 5724, 5725, and 5726) located at the second surface portion 5572 of the top portion 5570 and positioned rearward of the visual guide portion 5577. The first plurality of strip portions 5710 and the second plurality of strip portions 5720 may be laser etched onto the second surface portion 5572, painted onto the second surface portion 5572, cut into the second surface portion 5572, be separate parts that are adhered or otherwise affixed to the second surface portion 5572, or any combination thereof. In the illustrated example, the first plurality of strip portions 5710 and the second plurality of strip portions 5720 may be located between the toe portion 5530 and the center longitudinal axis 5511 and between the heel portion 5540 and the center longitudinal axis 5511, respectively. The first plurality of strip portions 5710 and the second plurality of strip portions 5720 may differ in shape, size (e.g., width, length, and/or height), and/or visual appearance. In the illustrated example, the first plurality of strip portions 5710 and the second plurality of strip portions 5720 may be symmetric about the center longitudinal axis 5511 and may have a trapezoidal shape. In another example, the first plurality of strip portions 5710 and the second plurality of strip portions 5720 may have a rectangle or parallelogram shape. The first plurality of strip portions 5710 and the second plurality of strip portions 5720 may be visually distinguishable from surrounding portions of the golf club head 5500. In one example, the first plurality of strip portions 5710 and the second plurality of strip portions 5720 may be a different color than the surrounding portions of the golf club head 5500. In another example, the first plurality of strip portions 5710 and the second plurality of strip portions 5720 may have a different texture than the surrounding portions of the golf club head 5500. In yet another example, the first plurality of strip portions 5710 and the second plurality of strip portions 5720 may be recessed relative to the surrounding portions of the golf club head 5500, level with the surrounding portions of the golf club head 5500, raised relative to the surrounding portions of the golf club head 5500, or any combination thereof. Accordingly, the first plurality of strip portions 5710 and the second plurality of strip portions 5720 may be configured as two-dimensional and/or three-dimensional elements. The apparatus, methods, and articles of manufacture described herein are not limited in this regard.

The first plurality of strip portions 5710 and the second plurality of strip portions 5720 may be spaced apart along a longitudinal direction of the golf club head 5500. As illustrated in the example of FIG. 57, each strip portion of the first plurality of strip portions 5710 may extend diagonally across the second surface portion 5572 to form an acute angle with a portion of the center longitudinal axis 5511 (i.e., virtually extending the strip portion to intersect the center longitudinal axis) that is between the strip portion and the rear portion 5560 and an obtuse angle with a portion of the center longitudinal axis 5511 that is between the strip portion and the front portion 5550. In other words, the strip portions of the first plurality of strip portions 5710 may have a forward extending orientation. In another example, each strip portion of the first plurality of strip portions 5710 may be arranged diagonally across the second surface portion 5572 to form an obtuse angle with a portion of the center longitudinal axis 5511 that is between the strip portion and the rear portion 5560 and an acute angle with a portion of the center longitudinal axis 5511 that is between the strip portion and the front portion 5550. In other words, the strip portions of the first plurality of strip portions 5710 may have a rearward extending orientation. The apparatus, methods, and articles of manufacture described herein are not limited in this regard.

As illustrated in the example of FIG. 57, each strip portions of the second plurality of strip portions 5720 may extend diagonally across the second surface portion 5572 to form an acute angle with a portion of the center longitudinal axis 5511 (i.e., virtually extending the strip portion to intersect the center longitudinal axis) that is between the strip portion and the rear portion 5560 and an obtuse angle with a portion of the center longitudinal axis 5511 that is between the strip portion and the front portion 5550. In other words, the strip portions of the second plurality of strip portions 5720 may have a forward extending orientation. In another example, each strip portion of the second plurality of strip portions 5720 may be arranged diagonally across the second surface portion 5572 to form an obtuse angle with a portion of the center longitudinal axis 5511 that is between the strip portion and the rear portion 5560 and an acute angle with a portion of the center longitudinal axis 5511 that is between the strip portion and the front portion 5550. In other words, the strip portions of the second plurality of strip portions 5720 may have a rearward extending orientation. The apparatus, methods, and articles of manufacture described herein are not limited in this regard.

In the illustrated example, the first plurality of strip portions 5710 and the second plurality of strip portions 5720 may be decreasingly spaced apart in a rear-to-front direction of the golf club head 5500 (e.g., see direction arrow 5578 in FIG. 55). Alternatively, the first plurality of strip portions 5710 and the second plurality of strip portions 5720 may be evenly spaced apart in the rear-to-front direction, increasingly spaced apart in the rear-to-front direction, or spaced apart according to any other spacing convention. Each strip portion of the first plurality of strip portions 5710 may extend continuously or discontinuously (e.g., segmented) between the first leg 5592 of the virtual outline 5590 and the center longitudinal axis 5511 and each strip portion of the second plurality of strip portions 5720 may extend continuously between the second leg 5593 of the virtual outline 5590 and the center longitudinal axis 5511. The first plurality of strip portions 5710 and the second plurality of strip portions 5720 may or may not touch or border upon the virtual outline 5590 and/or the center longitudinal axis 5511. In the illustrated example, each strip portion of the first plurality of strip portions 5710 may touch or border upon the first leg 5592 of the virtual outline 5590 and end short of the center longitudinal axis 5511. Similarly, each strip portion of the second plurality of strip portions 5720 may touch or border upon the second leg 5593 of the virtual outline 5590 and end short of the center longitudinal axis 5511. The strip portions of the first plurality of strip portions 5710 and the second plurality of strip portions 5720 may be equidistant or variably spaced from the center longitudinal axis 5511. While the first and second plurality of strip portions 5710 and 5720 are generally shown as linear elements, one or more strip portions of the first plurality of strip portions 5710 and/or the second plurality of strip portions 5720 may be nonlinear including, but not limited to, curved, stepped, zigzagged, winding, oscillating, twisting, and the like. Additionally, while each strip portion of the first plurality of strip portions 5710 and the second plurality of strip portions 5720 is generally shown as a discrete element, a number of strip portions of the first plurality of strip portions 5710 and/or the second plurality of strip portions 5720 may be interconnected. Accordingly, strip portions of the first plurality of strip portions 5610 may comingle and/or mingle with strip portions of the second plurality of strip portions 5620. The apparatus, methods, and articles of manufacture described herein are not limited in this regard.

The first plurality of strip portions 5710 and the second plurality of strip portions 5720 may be ordered by increasing surface area (e.g., increasing width and/or length), decreasing surface area (e.g., decreasing width and/or length), a combination thereof, or at random in the rear-to-front direction of the golf club head 5500. In the illustrated example, the first plurality of strip portions 5710 and the second plurality of strip portions 5720 may be ordered by decreasing surface area (e.g., decreasing width and length) in the rear-to-front direction of the golf club head 5500. In the illustrated example, the orderly decrease in surface area in conjunction with the spaced apart relationship of the first plurality of strip portions 5710 and the second plurality of strip portions 5720 in the rear-to-front direction of the golf club head 5500 produces a visual runway, in effect guiding and gradually sharpening an individual's focus in the rear-to-front direction toward the aimpoint. In practice, for example, the individual may assume an address position and scan the visual runway to determine whether the golf club head 5500 is properly aligned with the intended target line. This may be achieved by adjusting the position of the golf club head 5500 until the intended target line passes through the aimpoint and the visual guide portion 5577 and crosses between the first plurality of strip portions 5710 and the second plurality of strip portions 5720, or said differently, matches the center longitudinal axis 5511 of the golf club head 5500. The apparatus, methods, and articles of manufacture described herein are not limited in this regard.

Figure 58:
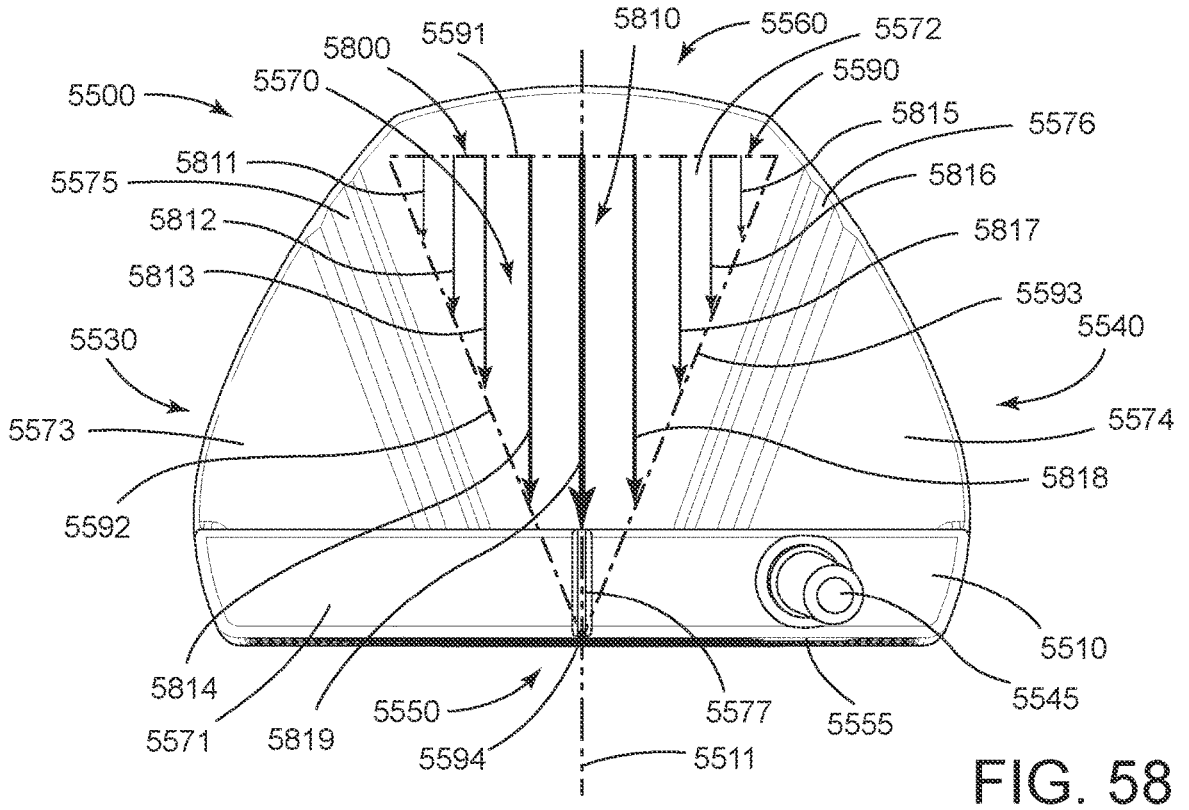
FIG. 58 depicts the golf club head of FIG. 55 with yet another example alignment aid.

In the example of FIG. 58, the golf club head 5500 is shown having another alignment aid 5800 bounded by the virtual outline 5590. For exemplary purposes, the virtual outline 5590 is shifted toward the rear portion 5560 such that the aimpoint or apex 5594 of the virtual outline 5900 coincides with the face portion 5555. Alternatively, the virtual outline 5590 may be shifted toward the rear portion 5560 such that the aimpoint or apex 5594 of the virtual outline 5900 is positioned rearward face portion 5555. The alignment aid 5800 may include a plurality of strip portions 5810 located at the second surface portion 5572 of the top portion 5570 and positioned rearward of the visual guide portion 5577. The plurality of strip portions 5810 may be laser etched onto the second surface portion 5572, painted onto the second surface portion 5572, cut into the second surface portion 5572, be separate parts that are adhered or otherwise affixed to the second surface portion 5572, or any combination thereof. In the illustrated example, the plurality of strip portions 5810 may include one or more strip portions (e.g., shown as strip portions 5811, 5812, 5813, 5814, 5815, 5816, 5817, 5818, and 5819). In the illustrated example, a certain number of strip portions (e.g., shown as strip portions 5811, 5812, 5813, and 5814) of the plurality of strip portions 5810 may be located between the toe portion 5530 and the center longitudinal axis 5511 and an equal number of strip portions (e.g., shown as strip portions 5815, 5816, 5817, and 5818) of the plurality of strip portions 5810 may be located between the heel portion 5540 and the center longitudinal axis 5511. In another example, the number of strip portions on each side of the center longitudinal axis 5511 may differ. Additionally, a middle strip portion (e.g., shown as strip portion 5819) of the plurality of strip portions 5810 may be aligned with the center longitudinal axis 5511. The plurality of strip portions 5810 may differ in shape, size (e.g., width, length, and/or height), and/or visual appearance. In the illustrated example, the plurality of strip portions 5810 may be symmetric to one another about the center longitudinal axis 5511 and may have an arrow shape. The plurality of strip portions 5810 may be visually distinguishable from surrounding portions of the golf club head 5500. In one example, the plurality of strip portions 5810 may be a different color than the surrounding portions of the golf club head 5500. In another example, the plurality of strip portions 5810 may have a different texture than the surrounding portions of the golf club head 5500. In yet another example, the plurality of strip portions 5810 may be recessed relative to the surrounding portions of the golf club head 5500, level with the surrounding portions of the golf club head 5500, raised relative to the surrounding portions of the golf club head 5500, or any combination thereof. Accordingly, the plurality of strip portions 5810 may be configured as two-dimensional and/or three-dimensional elements. The apparatus, methods, and articles of manufacture described herein are not limited in this regard.

The plurality of strip portions 5810 may be spaced apart in a lateral direction of the golf club head 5500. The plurality of strip portions 5810 may be parallel with the center longitudinal axis 5511 and may be perpendicular or substantially perpendicular with the face portion 5555. In the illustrated example, the plurality of strip portions 5810 may be increasingly spaced apart in an inward direction from the toe portion 5530 toward the center longitudinal axis 5511 and from the heel portion 5540 toward the center longitudinal axis 5511. In another example, the plurality of strip portions 5810 may be decreasingly spaced apart in the inward direction, evenly spaced apart in the inward direction, or spaced apart according to any other spacing convention. Each strip portion of the plurality of strip portions 5810 may extend continuously or discontinuously (e.g., segmented) between the base 5591 and the first leg 5592, the second leg 5593, or the aimpoint or apex 5594 of the virtual outline 5590. The plurality of strip portions 5810 may or may not touch or border upon the virtual outline 5590 and/or the center longitudinal axis 5511. In the illustrated example, the strip portions (e.g., shown as strip portions 5811, 5812, 5813, and 5814) of plurality of strip portions 5810 located between the toe portion 5530 and center longitudinal axis 5511 may touch or border upon the base 5591 and the first leg 5592 of the virtual outline 5590. The strip portions (e.g., shown strip portions 5815, 5816, 5817, and 5818) of the plurality of strip portions 5810 located between the heel portion 5540 and the center longitudinal axis 5511 may touch or border upon the base 5591 and the second leg 5593 of the virtual outline 5590. The middle strip portion (e.g., shown as strip portion 5819) aligned with the center longitudinal axis 5511 may touch or border upon the base 5591 and end short of the visual guide portion 5577, end short of the aimpoint or apex 5594 of virtual outline 5590, or touch or border upon the aimpoint or apex 5594 of the virtual outline 5590. While the plurality of strip portions 5810 are generally shown as linear elements, one or more strip portions of the plurality of strip portions 5810 may be nonlinear including, but not limited to, curved, stepped, zigzagged, winding, oscillating, twisting, and the like. Additionally, while the plurality of strip portions 5810 are generally shown as individual discrete elements, a number of strip portions of the plurality of strip portions 5810 may be interconnected. Accordingly, the strip portions of the plurality of strip portions 5810 may comingle in a variety of combinations. The apparatus, methods, and articles of manufacture described herein are not limited in this regard.

The plurality of strip portions 5810 may be ordered by increasing surface area (e.g., increasing width and/or length), decreasing surface area (e.g., decreasing width and/or length), a combination thereof, or at random in the inward club direction from the toe portion 5530 toward the center longitudinal axis 5511 and from the heel portion 5540 toward the center longitudinal axis 5511. In the illustrated example, the plurality of strip portions 5810 may be ordered by increasing surface area (e.g., increasing width and length) in the inward club direction of the golf club head 5500. In this configuration, the middle strip portion (e.g., shown as strip portion 5819) aligned with the center longitudinal axis 5511 may have the largest surface area (e.g., largest width and length) while the strip portion (e.g., shown as strip portion 5811) located closest to the toe portion 5530 and the strip portion (e.g., shown as strip portion 5815) located closest to the heel portion 5540 may have the smallest surface areas (e.g., smallest width and length). In the illustrated example, the orderly increase in surface area in conjunction with the spaced apart relationship of the plurality of strip portions 5810 in the inward club direction of the golf club head 5500 and the arrow shape of the strip portions produces a visual runway, in effect guiding and gradually sharpening an individual's focus in the rear-to-front direction toward the aimpoint. In practice, for example, the individual may assume an address position and scan the visual runway to determine whether the golf club head 5500 is properly aligned with the intended target line. This may be achieved by adjusting the position of the golf club head 5500 until the intended target line passes through the aimpoint, the visual guide portion 5577, and the middle strip portion (e.g., shown as strip portion 5819) of the plurality of strip portions 5810, or said differently, matches the center longitudinal axis 5511 of the golf club head 5500. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion having a toe portion, a heel portion, a front portion with a face portion, a rear portion, a top portion, and a sole portion, the top portion comprising:

a first surface portion adjacent to the face portion, the first surface portion corresponding to an uppermost extent of the top portion;

a second surface portion adjacent to the rear portion, the second surface portion corresponding to a lowermost extent of the top portion;

a third surface portion adjacent to the toe portion, the third surface portion being raised relative to the second surface portion;

a fourth surface portion adjacent to the heel portion, the fourth surface portion being raised relative to the second surface portion;

a first transition portion separating the third surface portion and the second surface portion, the first transition portion extending inwardly from the toe portion toward the face portion; and a second transition portion separating the fourth surface portion and the second surface portion, the second transition portion extending inwardly from the heel portion toward the face portion;

a virtual outline coinciding with at least a portion of the second surface portion, the virtual outline having a base, a first leg, and a second leg, the base extending between the toe portion and heel portion, and the first leg and the second leg extending from opposite ends of the base and meeting to define an apex that intersects with a center longitudinal axis of the golf club head, the first leg being parallel or substantially parallel to the first transition portion, and the second leg being parallel or substantially parallel to the second transition portion;

a visual guide portion at the first surface portion and rearward of the apex, the visual guide portion extending in a rear-to-front direction and aligned with the center longitudinal axis; and an alignment aid at the second surface portion and bounded by the virtual outline, the alignment aid having a first plurality of strip portions and a second plurality of strip portions, the first plurality of strip portions extending between the toe portion and the center longitudinal axis, and the second plurality of strip portions extending between the heel portion and the center longitudinal axis, wherein the second surface portion, first transition portion, and the second transition portion provide a visual narrowing effect in a rear-to-front direction of the golf club head, wherein the virtual outline is configured to complement the visual narrowing effect, wherein the first plurality of strip portions have different surface areas and an edge of each strip portion of the first plurality of strip portions is aligned with the first leg of the virtual outline, wherein the second plurality of strip portions have different surface areas and an edge of each strip portion of the second plurality of strip portions is aligned with the second leg of the virtual outline, wherein the first plurality of strip portions are evenly spaced apart in a rear-to-front direction of the golf club head and are ordered by decreasing surface area in the rear-to-front direction, and wherein the second plurality of strip portions are evenly spaced apart in the rear-to-front direction and are ordered by decreasing surface area in the rear-to-front direction.

2. A golf club head as recited in claim 1, wherein the first plurality of strip portions and the second plurality of strip portions are positioned rearward of the visual guide portion.

3. A golf club head as recited in claim 1, wherein the first plurality of strip portions and the second plurality of strip portions are equidistant from the center longitudinal axis.

4. A golf club head as recited in claim 1, wherein the apex is located forward of the face portion.

5. A golf club head as recited in claim 1, wherein the first plurality of strip portions and the second plurality of strip portions are equal in number.

6. A golf club head as recited in claim 1, wherein the first plurality of strip portions and the second plurality of strip portions are parallel or substantially parallel with the face portion.

7. A golf club head as recited in claim 1, wherein each strip portion of the first plurality of strip portions has a right trapezoid shape and each strip portion of the second plurality of strip portions has a right trapezoid shape.

8. A golf club head comprising:

a body portion having a toe portion, a heel portion, a front portion with a face portion configured to impact a golf ball, a rear portion, a top portion, and a sole portion, the top portion comprising:

a first surface portion adjacent to the face portion, the first surface portion corresponding to an uppermost extent of the top portion;

a second surface portion adjacent to the rear portion, the second surface portion corresponding to a lowermost extent of the top portion;

a third surface portion adjacent to the toe portion, the third surface portion being raised relative to the second surface portion;

a fourth surface portion adjacent to the heel portion, the fourth surface portion being raised relative to the second surface portion;

a first transition portion separating the third surface portion and the second surface portion, the first transition portion extending inwardly from the toe portion toward the face portion; and a second transition portion separating the fourth surface portion and the second surface portion, the second transition portion extending inwardly from the heel portion toward the face portion;

a virtual outline coinciding with at least a portion of the second surface portion, the virtual outline having a base, a first leg, and a second leg, the base extending between the toe portion and heel portion, and the first leg and the second leg extending from opposite ends of the base and meeting to define an apex that intersects with a center longitudinal axis of the golf club head, the first leg being parallel or substantially parallel to the first transition portion, and the second leg being parallel or substantially parallel to the second transition portion;

a visual guide portion at the first surface portion and rearward of the apex, the visual guide portion extending in a rear-to-front direction and aligned with the center longitudinal axis; and an alignment aid at the second surface portion and bounded by the virtual outline, the alignment aid having a first plurality of strip portions and a second plurality of strip portions, the first plurality of strip portions having different surface areas and spaced apart in a rear-to-front direction of the golf club head, and the second plurality of strip portions having different surface areas and spaced apart in the rear-to-front direction, wherein the second surface portion, first transition portion, and the second transition portion provide a visual narrowing effect in a rear-to-front direction of the golf club head, wherein the virtual outline is configured to complement the visual narrowing effect, wherein the first plurality of strip portions extend from the first leg toward the center longitudinal axis, wherein the second plurality of strip portions extend from the second leg toward the center longitudinal axis, wherein the first plurality of strip portions are ordered by decreasing surface area in the rear-to-front direction, and wherein the second plurality of strip portions are ordered by decreasing surface area in the rear-to-front direction.

9. A golf club head as recited in claim 8, wherein the first plurality of strip portions end short of the center longitudinal axis and are equidistant to the center longitudinal axis.

10. A golf club head as recited in claim 8, wherein the second plurality of strip portions end short of the center longitudinal axis and are equidistant to the center longitudinal axis.

11. A golf club head as recited in claim 8, wherein the apex is located forward of the face portion, at the face portion, or rearward of the face portion.

12. A golf club head as recited in claim 8, wherein the first plurality of strip portions are evenly spaced apart in the rear-to-front direction, and wherein the second plurality of strip portions are evenly spaced apart in the rear-to-front direction.

13. A golf club head as recited in claim 8, wherein the first plurality of strip portions and the second plurality of strip portions are linear.

14. A golf club head as recited in claim 8, wherein the first plurality of strip portions and the second plurality of strip portions are symmetric about the center longitudinal axis.

15. A golf club head comprising:

a body portion having a toe portion, a heel portion, a front portion with a face portion configured to impact a golf ball, a rear portion, a top portion, and a sole portion, the top portion comprising:

a first surface portion adjacent to the face portion, the first surface portion corresponding to an uppermost extent of the top portion;

a second surface portion adjacent to the rear portion, the second surface portion corresponding to a lowermost extent of the top portion;

a third surface portion adjacent to the toe portion, the third surface portion being raised relative to the second surface portion;

a fourth surface portion adjacent to the heel portion, the fourth surface portion being raised relative to the second surface portion;

a first transition portion having a stepped configuration and separating the third surface portion and the second surface portion, the first transition portion extending inwardly from the toe portion toward the face portion; and a second transition portion having a stepped configuration and separating the fourth surface portion and the second surface portion, the second transition portion extending inwardly from the heel portion toward the face portion;

a virtual outline superimposed at the top portion, the virtual outline having an isosceles triangle shape with a first side parallel with the first transition portion, a second side parallel with the second transition portion, and an apex pointing in a frontward club direction and intersecting with a center longitudinal axis of the golf club head;

an alignment aid at the second surface portion and bounded by the virtual outline, the alignment aid having a first plurality of strip portions and a second plurality of strip portions, the first plurality of strip portions having different widths and lengths, and the second plurality of strip portions having different widths and lengths, wherein the second surface portion, first transition portion, and the second transition portion provide a visual narrowing effect in a rear-to-front direction of the golf club head, wherein the virtual outline is configured to complement the visual narrowing effect, wherein the first plurality of strip portions border upon the virtual outline, wherein the second plurality of strip portions border upon the virtual outline, wherein the first plurality of strip portions are spaced apart in a rear-to-front direction of the golf club head and are ordered by decreasing width and length in the rear-to-front direction, and wherein the second plurality of strip portions are spaced apart in the rear-to-front direction and are ordered by decreasing width and length in the rear-to-front direction.

16. A golf club head as recited in claim 15, wherein the first plurality of strip portions and the second plurality of strip portions both include at least three strip portions.

17. A golf club head as recited in claim 15, wherein the first plurality of strip portions are evenly spaced in the rear-to-front direction, and wherein the second plurality of strip portions are evenly spaced in the rear-to-front direction.

18. A golf club head as recited in claim 15, wherein the apex is located in front of the face portion.

19. A golf club head as recited in claim 15, wherein the first plurality of strip portions and the second plurality of strip portions are equidistant from the center longitudinal axis.

20. A golf club head as recited in claim 15, wherein the first plurality of strip portions and the second plurality of strip portions extend laterally across the body portion.

* * * * *